US011723428B2

(12) United States Patent
Aubonnet et al.

(10) Patent No.: US 11,723,428 B2
(45) Date of Patent: Aug. 15, 2023

(54) FOOTWEAR WITH STABILIZING SOLE

(71) Applicant: Deckers Outdoor Corporation, Goleta, CA (US)

(72) Inventors: Christophe Aubonnet, Tresserve (FR); Jean Luc Diard, Annecy (FR); Thibaut Poupard, Annecy (FR); Vincent Bouillard, Marcellaz Albanais (FR)

(73) Assignee: Deckers Outdoor Corporation, Goleta, CA (US)

( * ) Notice: Subject to any disclaimer, the term of this patent is extended or adjusted under 35 U.S.C. 154(b) by 104 days.

(21) Appl. No.: 17/187,713

(22) Filed: Feb. 26, 2021

(65) Prior Publication Data

US 2021/0259351 A1 Aug. 26, 2021

Related U.S. Application Data

(63) Continuation-in-part of application No. 16/258,074, filed on Jan. 25, 2019, now Pat. No. 11,219,267,
(Continued)

(51) Int. Cl.
*A43B 13/18* (2006.01)
*A43B 3/00* (2022.01)
(Continued)

(52) U.S. Cl.
CPC ..... *A43B 3/0042* (2013.01); *A43B 7/24* (2013.01); *A43B 13/14* (2013.01); *A43B 13/141* (2013.01);
(Continued)

(58) Field of Classification Search
CPC ..... A43B 7/14; A43B 7/142; A43B 13/141; A43B 13/186; A43B 13/183; A43B 13/181
(Continued)

(56) References Cited

U.S. PATENT DOCUMENTS

RE11,967 E * 2/1902 Roche ..... 118/712
741,012 A * 10/1903 Corey ..... A43B 13/181 36/3 R
(Continued)

FOREIGN PATENT DOCUMENTS

WO 2010033238 A1 3/2010
WO 2015138815 A2 9/2015
(Continued)

OTHER PUBLICATIONS

EP Extended Search Report & Opinion for corresponding EP Patent Application No. 22185361.7 dated Nov. 17, 2022 (7 pages).

*Primary Examiner* — Marie D Bays
(74) *Attorney, Agent, or Firm* — Greer, Burns & Crain, Ltd.

(57) ABSTRACT

An article of footwear including an upper and a sole secured to the upper, where the sole includes an upper surface. A support member is positioned on the sole, and includes at least one portion positioned a designated distance above the upper surface of the sole to form a space between the support member and the sole, where the portion of the support member moves through the space and toward the upper surface of the sole when pressure is applied to the portion of the support member, and flexes away from the upper surface when pressure is decreased or released from the portion of the support member.

16 Claims, 46 Drawing Sheets

Related U.S. Application Data which is a continuation-in-part of application No. 16/159,600, filed on Oct. 12, 2018, now Pat. No. 10,966,482.

(51) Int. Cl.
*A43B 13/14* (2006.01)
*A43B 13/22* (2006.01)
*A43B 7/24* (2006.01)

(52) U.S. Cl.
CPC ..... *A43B 13/143* (2013.01); *A43B 13/183* (2013.01); *A43B 13/223* (2013.01)

(58) Field of Classification Search
USPC ..... 36/28, 91, 166, 168, 169, 179
See application file for complete search history.

(56) References Cited

U.S. PATENT DOCUMENTS 855,163 A * 5/1907 Cotter ..... A43B 7/142 36/179
951,605 A * 3/1910 Hammer ..... A43B 7/142 36/147
1,347,061 A * 7/1920 Steinbrecher ..... A43B 7/142 36/76 R
1,523,469 A * 1/1925 Charless ..... A43B 7/223 36/180
1,575,645 A * 3/1926 Scholl ..... A43B 7/22 36/179
1,736,609 A 11/1929 Letourneau
1,870,751 A 8/1932 Reach
1,928,634 A * 10/1933 Spicer et al. ..... A43B 23/22 36/179
1,942,312 A 1/1934 Tutoky
1,962,527 A * 6/1934 Ringle ..... A43B 7/142 36/141
2,129,424 A * 9/1938 Jay ..... A43B 7/22 36/76 R
2,227,426 A * 1/1941 Davis, Jr. ..... A43B 7/142 36/160
2,413,545 A 12/1946 Cordi
2,428,244 A * 9/1947 Roles ..... A43B 7/142 36/82
2,435,822 A * 2/1948 Erickson ..... A43B 7/141 36/179
2,512,350 A * 6/1950 Ludlam ..... A43B 7/1445 36/179
3,036,389 A 5/1962 Wesch
3,077,886 A * 2/1963 Pirhonen ..... A43B 7/142 36/166
3,100,354 A 8/1963 Herman et al.
4,030,213 A 6/1977 Daswick
4,238,894 A 12/1980 Evans
4,241,523 A 12/1980 Daswick
4,259,792 A 4/1981 Halberstadt
4,314,413 A 2/1982 Dassler
4,468,870 A 9/1984 Sternberg
4,592,153 A 6/1986 Jacinto
4,827,631 A 5/1989 Thornton
4,910,884 A 3/1990 Lindh et al.
5,005,299 A 4/1991 Whatley
5,078,633 A 1/1992 Tolbert
5,181,873 A 1/1993 Tolbert
5,265,354 A 11/1993 Aliano
5,319,866 A * 6/1994 Foley ..... A43B 7/14 36/31
5,440,826 A 8/1995 Whatley
5,469,638 A * 11/1995 Crawford, III ..... A43B 13/18 36/27
5,528,842 A * 6/1996 Ricci ..... A43B 21/30 36/38
5,611,152 A * 3/1997 Richard ..... A43B 13/12 36/27
5,701,685 A 12/1997 Pezza
5,701,686 A 12/1997 Herr et al.
5,784,808 A 7/1998 Hockerson
6,065,230 A 5/2000 James
6,115,945 A 9/2000 Ellis
6,192,607 B1 * 2/2001 Kolada ..... A43B 7/142 36/179
6,199,302 B1 3/2001 Kayano
6,199,303 B1 3/2001 Luthi et al.
6,295,744 B1 10/2001 Ellis
6,405,458 B1 6/2002 Fleshman
6,477,791 B2 11/2002 Luthi et al.
6,578,290 B1 6/2003 Meynard
6,983,555 B2 1/2006 Lacorazza et al.
6,990,755 B2 * 1/2006 Hatfield ..... A43B 13/141 36/97
7,062,865 B1 6/2006 Nordt, III
7,140,125 B2 * 11/2006 Singleton ..... A43B 7/142 36/152
7,204,044 B2 4/2007 Hoffer et al.
8,424,225 B2 4/2013 Hazenberg et al.
8,656,613 B2 2/2014 Stockbridge et al.
8,881,427 B2 11/2014 Diard et al.
9,591,891 B1 3/2017 Baucom et al.
9,943,432 B1 * 4/2018 Butler ..... A61F 5/0127
10,441,021 B1 * 10/2019 Polk ..... A43B 3/12
10,842,224 B2 11/2020 Farina et al.
10,966,482 B2 4/2021 Aubonnet et al.
11,219,267 B2 1/2022 Aubonnet et al.
2002/0038522 A1 4/2002 Houser et al.
2003/0093920 A1 5/2003 Greene et al.
2003/0131497 A1 7/2003 Ellis, III
2003/0163933 A1 9/2003 Krafsur et al.
2003/0217482 A1 11/2003 Ellis, III
2004/0040183 A1 3/2004 Kerrigan
2004/0168350 A1 9/2004 Mathieu et al.
2005/0081401 A1 * 4/2005 Singleton ..... A43B 7/14 36/27
2005/0108897 A1 5/2005 Aveni
2006/0048411 A1 3/2006 Lindqvist et al.
2006/0048412 A1 3/2006 Kerrigan
2006/0174515 A1 * 8/2006 Wilkinson ..... A43B 21/32 36/27
2007/0169379 A1 7/2007 Hazenberg et al.
2007/0199211 A1 8/2007 Campbell
2007/0240331 A1 10/2007 Borel
2007/0271818 A1 11/2007 Rabushka
2008/0216350 A1 9/2008 Lindqvist et al.
2008/0271339 A1 11/2008 Fischer
2009/0013558 A1 1/2009 Hazenberg et al.
2009/0064538 A1 3/2009 Roether et al.
2009/0113758 A1 5/2009 Nishiwaki et al.
2009/0183393 A1 7/2009 Lee
2010/0199523 A1 8/2010 Mayden et al.
2010/0299965 A1 12/2010 Avar et al.
2010/0307025 A1 12/2010 Truelsen et al.
2011/0126428 A1 6/2011 Hazenberg et al.
2011/0138652 A1 6/2011 Lucas et al.
2011/0185590 A1 8/2011 Nishiwaki et al.
2011/0214313 A1 9/2011 James et al.
2012/0005924 A1 1/2012 Shiue et al.
2012/0151796 A1 6/2012 Diard et al.
2012/0159815 A1 6/2012 Dekovic et al.
2012/0246969 A1 10/2012 Baum et al.
2012/0324760 A1 12/2012 Ochoa
2013/0055596 A1 3/2013 Wan et al.
2013/0152428 A1 * 6/2013 Bishop ..... A43B 13/141 36/31
2013/0199057 A1 8/2013 Hurd et al.
2014/0000125 A1 * 1/2014 Butler ..... A43B 13/386 36/43
2014/0041261 A1 2/2014 Walker et al.
2014/0047740 A1 2/2014 Tucker et al.
2014/0068966 A1 3/2014 Chaffin
2014/0215853 A1 8/2014 Rushbrook et al.
2014/0259785 A1 9/2014 Lester et al.
2015/0026996 A1 * 1/2015 Baum ..... A43B 13/37 36/27

(56) References Cited

U.S. PATENT DOCUMENTS

| | | | | |
|---|---|---|---|---|
| 2015/0040432 | A1 | 2/2015 | Berend et al. | |
| 2015/0040435 | A1 | 2/2015 | Barnes et al. | |
| 2015/0089834 | A1 | 4/2015 | Baum et al. | |
| 2015/0230549 | A1 | 8/2015 | Bernhard et al. | |
| 2015/0257481 | A1 | 9/2015 | Campos, II et al. | |
| 2015/0282561 | A1 | 10/2015 | Swager Van Dok | |
| 2015/0351492 | A1 | 12/2015 | Dombrow et al. | |
| 2016/0058123 | A1* | 3/2016 | Peyton | A43B 13/141 36/25 R |
| 2016/0316852 | A1 | 11/2016 | Zhao et al. | |
| 2016/0366975 | A1 | 12/2016 | Toschi | |
| 2017/0055633 | A1 | 3/2017 | Hsu et al. | |
| 2017/0079373 | A1 | 3/2017 | Huard et al. | |
| 2017/0095033 | A1 | 4/2017 | Farina et al. | |
| 2017/0224049 | A1 | 8/2017 | Stien | |
| 2017/0273398 | A1* | 9/2017 | Butler | A43B 7/1445 |
| 2018/0098601 | A1 | 4/2018 | Hartenstein et al. | |
| 2018/0146744 | A1 | 5/2018 | Guest et al. | |
| 2018/0153253 | A1* | 6/2018 | Ward | A43B 13/186 |
| 2018/0338575 | A1 | 11/2018 | Elder et al. | |
| 2019/0104805 | A1 | 4/2019 | Del Biondi et al. | |
| 2019/0223548 | A1 | 7/2019 | Lussier et al. | |
| 2020/0093675 | A1* | 3/2020 | Hale | A61H 1/0266 |

FOREIGN PATENT DOCUMENTS

| | | | |
|---|---|---|---|
| WO | 2015175605 | A1 | 11/2015 |
| WO | 2016094714 | A1 | 6/2016 |

* cited by examiner

FOOTWEAR WITH STABILIZING SOLE

CROSS REFERENCE TO RELATED APPLICATIONS

This application is a continuation-in-part application of and claims priority to U.S. patent application Ser. No. 16/258,074 filed on Jan. 25, 2019, which is a continuation-in-part application of U.S. patent application Ser. No. 16/159,600 filed on Oct. 12, 2018, each of which are hereby incorporated by reference in their entireties.

BACKGROUND

The present application relates generally to footwear, and more particularly, to a stabilizing sole for an article of footwear that provides stability and uniformly supports a user's feet while reducing impact forces on the user's feet and enhancing forward propulsion during impact movements such as walking, jogging and running.

Running is particularly hard on a person's feet and body. For example, the impact of each foot striking the ground during running is the equivalent of three to five times of your body weight or more. There is a particular large impact force in the heel area of the foot during each heel strike. Insufficient cushioning and support and misalignment of a person's feet within their shoes reduces the absorption of this impact, thereby transferring more of the shock and stress from such impact forces to the user's body, and unnecessarily stressing the knees, hips and lower back. As a person runs, the shock and stress are repeated at every foot strike with the ground, which can cause stress injuries, pain and excess wear on a person's joints.

Further, the running motion is a succession of weight bearing phases and suspension phases, where a stride is a combination of a contact phase and a thrust phase. During the ground contact phase, there is a deceleration of the forward progress of a runner's body, where energy is stored in the muscles when the runner's leg bends to absorb shock from the contact between the runner's feet and the ground. During the forward thrust phase, the runner's body accelerates by applying the largest force possible to the ground in the shortest amount of time. This force is created by the leg muscles and the release of stored energy when the leg relaxes. In this way, the ground contact phase and the suspension phase minimize deceleration upon contact with the ground and maximize forward thrust of the runner.

When the feet and ankles are properly supported, aligned and sufficiently stabilized on the ground, a person's body is able to remain balanced and absorb large impact forces. Also, biomechanical efficiency improves to help reduce impact forces, while forming an efficient lever to channel power correctly during propulsion.

Therefore, it is desirable to provide footwear that uniformly supports, aligns and balances a person's feet during impact movements, such as walking, jogging and running, to help reduce the stresses on a person's feet and body from impact forces while enhancing propulsion of the person's body.

SUMMARY

The present article of footwear has a sole that provides enhanced balance on different types of surfaces, and balance and stability to a user's foot during walking, jogging and running.

In an embodiment, an article of footwear is provided and includes an upper and a sole secured to the upper, where the sole includes an upper surface. A support member is positioned on the sole, and includes at least one portion positioned a designated distance above the upper surface of the sole to form a space between the support member and the sole, where the portion of the support member moves through the space and toward the upper surface of the sole when pressure is applied to the portion of the support member, and flexes away from the upper surface when pressure is decreased or released from the portion of the support member.

In another embodiment, an article of footwear is provided and includes an upper, a sole secured to the upper and including an upper surface and a recessed spring area below the upper surface that is between a forefoot area and a heel area of the sole. Additionally, a support member is placed on the sole for support and stability. The support member has a curved portion that is positioned adjacent to the recessed spring area of the sole, where the curved portion of the support plate moves or flexes toward the recessed spring area when pressure is applied to the curved portion of the support plate, and flexes away from the recessed spring area when pressure is decreased or released from the curved portion of the support plate.

DETAILED DESCRIPTION

The present footwear includes a balanced sole attached to an upper to form an article of footwear that stabilizes and cushions a user's feet during walking, jogging and running while enhancing propulsion. More specifically, the present article of footwear includes a sole having a stabilizing portion that extends outwardly from the upper at a rear end of the article of footwear and an extended toe portion positioned at a height above the ground that provides enhanced stability and propulsion for a user's feet during movement on different ground surfaces.

Figure 1:
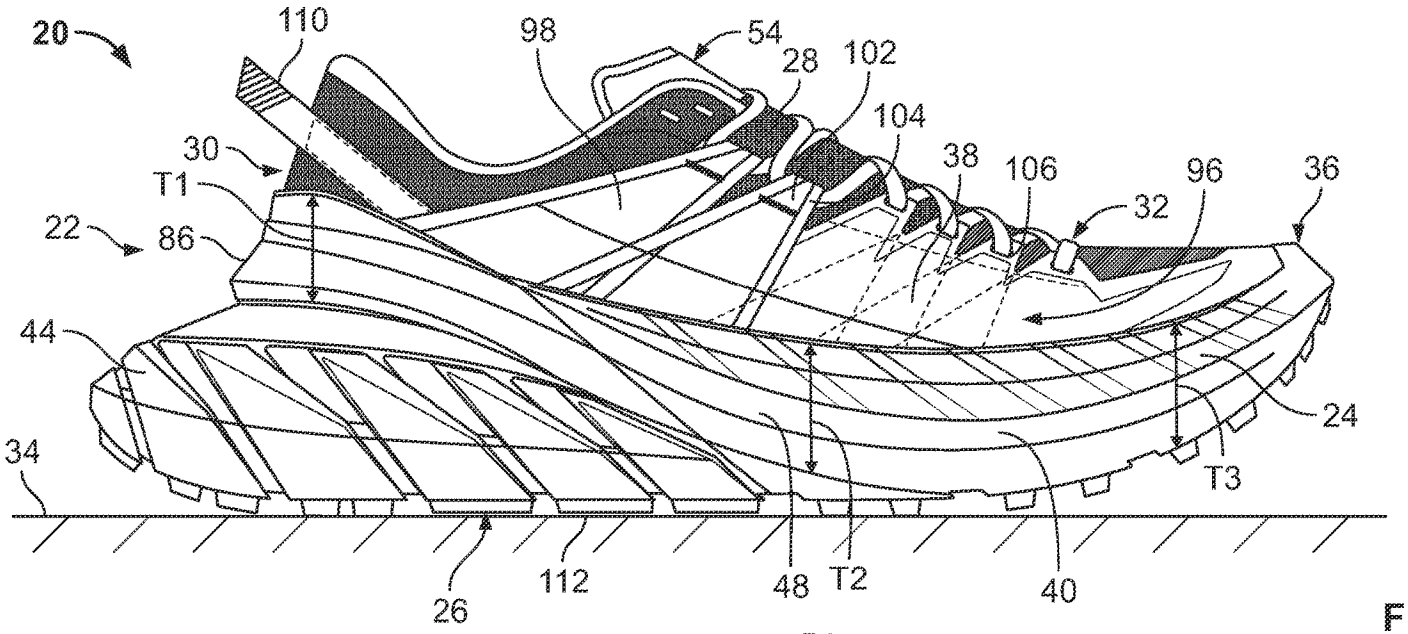
FIG. 1 is a right side view of an embodiment of the present footwear.

Referring now to FIGS. 1-16, an embodiment of the present article of footwear or shoe, generally indicated as 20, includes a sole 22 having a midsole 24 and an outsole 26, and an upper 28 attached to the sole. The midsole 24 extends from a heel portion 30 to a forefoot portion 32 of the shoe 20 and has a first height above the ground 34 at the heel portion 30 of the shoe 20 and a second height above the ground 34 at the front or toe portion 36 of the shoe. As shown in FIG. 1, the midsole 24 curves downwardly from the heel portion 30 toward the midfoot portion 38 of the shoe 20 and then curves upwardly from the midfoot portion 38 to the toe portion 36. In an embodiment, the midsole 24 has a first thickness T1 at the heel portion 30, a second thickness T2 at the midfoot portion 38 and a third thickness T3 at the forefoot portion 32 of the shoe where the second thickness is greater than the first and third thicknesses. In the illustrated embodiment, the first thickness T1 is 3.5 to 4.5 cm, the second thickness T2 is 4.0 cm to 6.0 cm and the third thickness T3 of the midsole is 3.0 cm to 5.0 cm. It should be appreciated that the thickness of the midsole may be the same from the heel to the forefoot of the shoe, and that the midsole 24 may also have any suitable thickness or combination of thicknesses based on the desired cushioning of the shoe. This construction provides more stability and cushioning in the midfoot and forefoot portions of the shoe 20 to help absorb impact forces when the forefoot portion 38 of the shoe repeatedly contacts the ground 34 during walking, jogging or running. In the illustrated embodiment, the midsole 24 is made of Ethylene Vinyl Acetate (EVA). It should be appreciated that the midsole 24 may be made of any suitable material or combination of materials.

As shown in FIGS. 1-3 and 5, in an example embodiment, the sole 22 has a forefoot portion 40 that has a length of 9.0 cm and curves to a point that is at a height of at least 2.0 cm above the ground 34. The extended length and increased height of the forefoot portion 40 are both designed to increase the contact time between the forefoot portion 32 of the shoe 20 and the ground 34 and lengthen a user's gait cycle, i.e., the period of time between when a user's foot initially contacts the ground and when that same foot contacts the ground again, during walking, jogging or running. The combination of increasing the contact time and lengthening the gait cycle enables a user to move more smoothly on the ground, increases the propulsion force of a user's foot on the ground and also helps to delay fatigue during walking, jogging or running.

Figure 17:
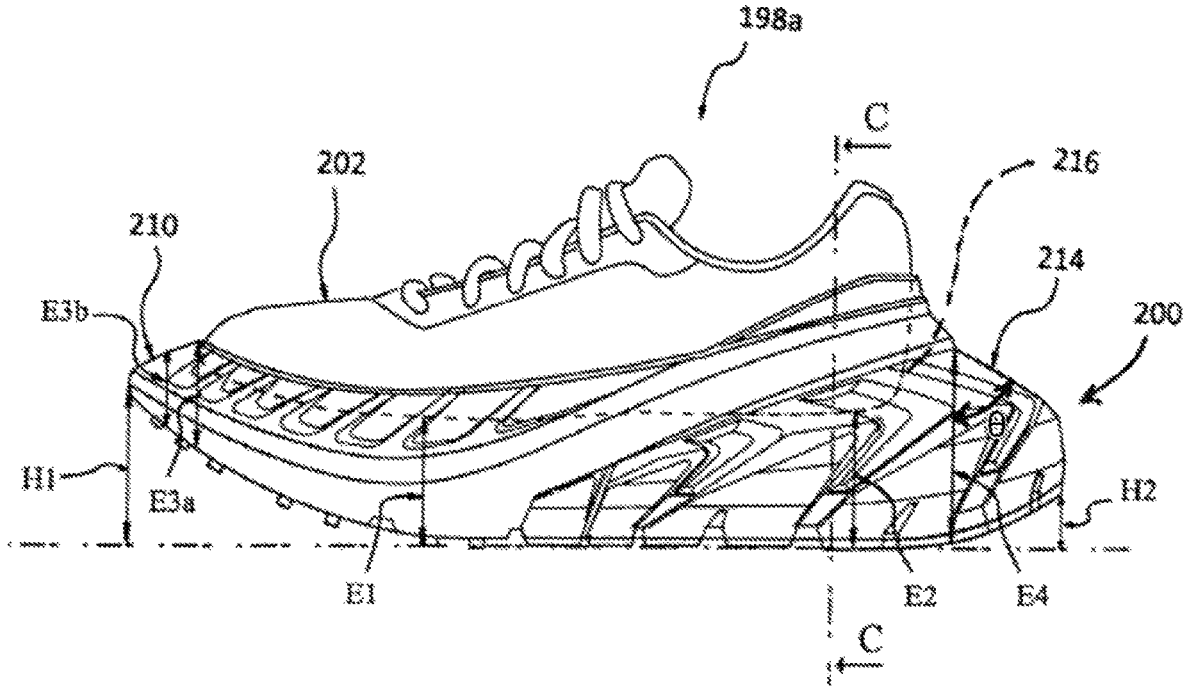
FIG. 17 is a left side view of another embodiment of the present footwear.

In the illustrated embodiment, the midsole 24 is attached to a top surface 42 of the outsole 26, and extends from the heel portion 30 to the toe portion 36 of the shoe 20. As shown in FIGS. 1-3, 5, 6 and 8, the outsole 26 includes a stabilizing portion 44 that extends outwardly from the midsole 24 at a designated angle θ and distance relative to the midsole. As shown in FIG. 17, the angle θ is the angle between the vertical line extending from the rear end of the midsole (such as E4) and a line at the top surface of the rear stabilizing member. To enhance stability and balance on different underlying surfaces, the stabilizing portion 42 extends about the periphery or perimeter of the heel portion 30 from a medial side 46 to a lateral side 48 of the shoe 20. In an embodiment, the stabilizing portion 44 forms an angle θ of at least 50 degrees, and more preferably, at least 75 degrees. In another embodiment, the angle θ is 65 to 80 degrees and more preferably 75-80 degrees, relative to the bottom surface 50 of the midsole 24, and extends outwardly from the midsole at least 4.0 cm, and preferably at least 5.0 cm from the rear end of the upper. By providing the stabilizing portion 44, which has a wider base near the heel portion 30, the present shoe 20 is able to remain relatively balanced and stable on different surfaces including uneven surfaces commonly found on trails and in urban areas. This construction thereby helps a user to walk, jog or run more smoothly and evenly on many different types of surfaces. In this embodiment, the stabilizing portion 44 is made of a combination of EVA and a foam material to provide both stability and cushioning to a user's feet during use. It should be appreciated that the stabilizing portion 44 may be made out of any suitable material or combination of materials.

Figure 12:
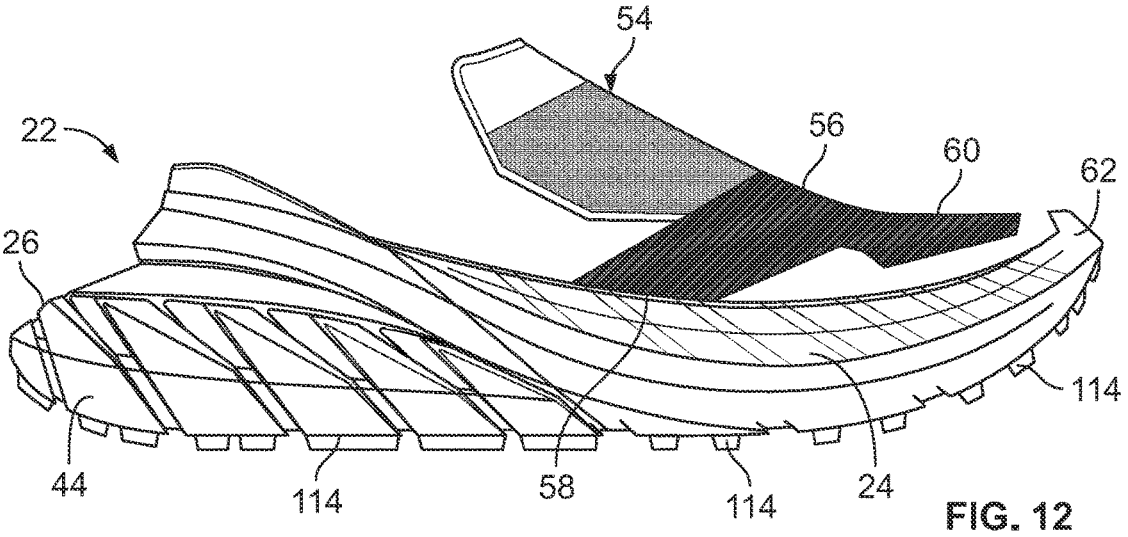
FIG. 12 is a right side view of the outsole of FIG. 6 including a tongue and gusset component attached to the outsole, where the left side view of the tongue and gusset component is a mirror images thereof.

Referring now to FIGS. 12 to 15B, the upper 28 is attached to the top surface 52 of the midsole 24 and is constructed of a plurality of different components. As shown in FIG. 12, a tongue 54 and an integrated gusset 56 are attached to the midsole 24. Specifically, the gusset 56 includes opposing lateral members 58 where one of the lateral members is attached to the medial side of the midsole 24 and the other lateral member is attached to the lateral side of the midsole 24 by stitching or other suitable attachment method. The gusset 56 further includes a forwardly extending top member 60 that is integrally formed with the lateral members 58 and extends over at least a portion of a user's foot near the toe cap 62. Preferably, the gusset 56 is made of a flexible fabric material but may be made with any suitable material.

Figure 3:
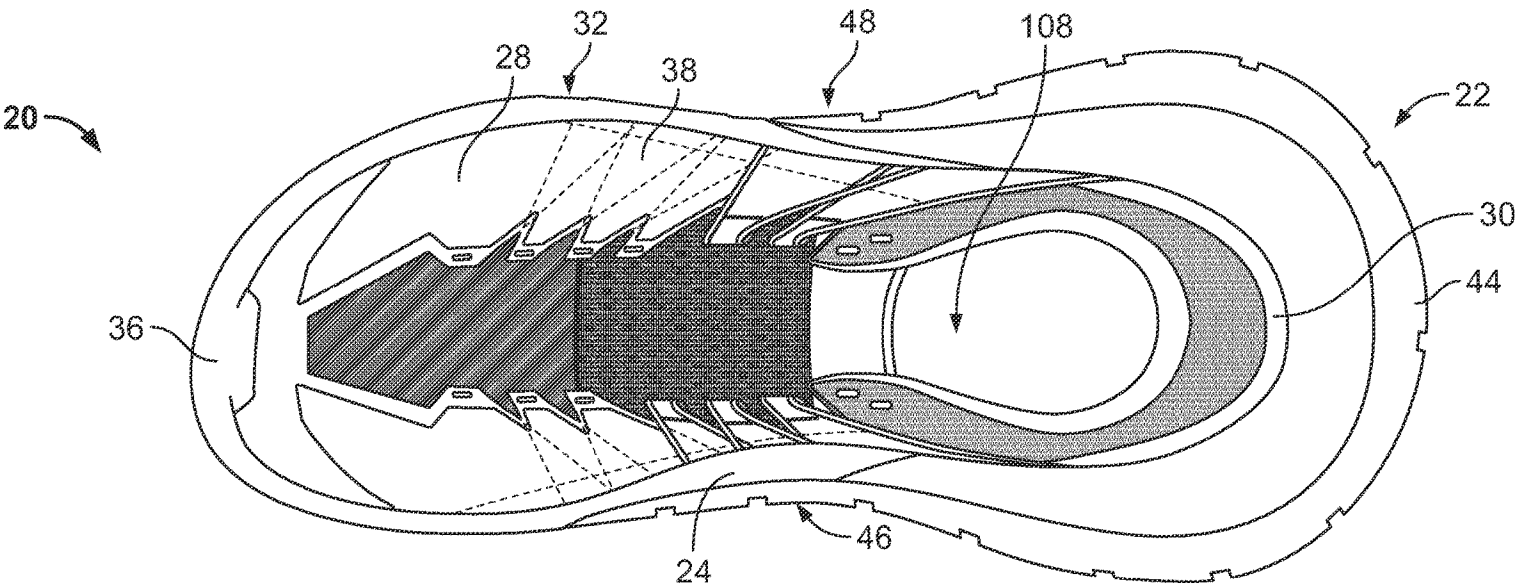
FIG. 3 is a top view of the footwear of FIG. 1 with the tongue and laces removed.
Figure 13B:
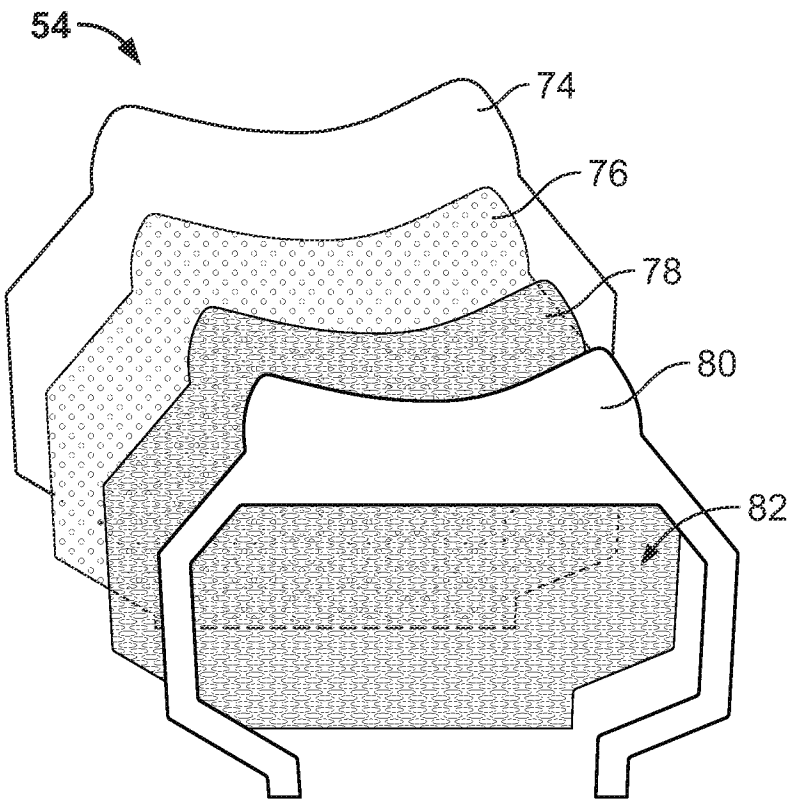
FIG. 13B is an exploded top view of the different material layers of the tongue shown in FIG. 13A.
Figure 13A:
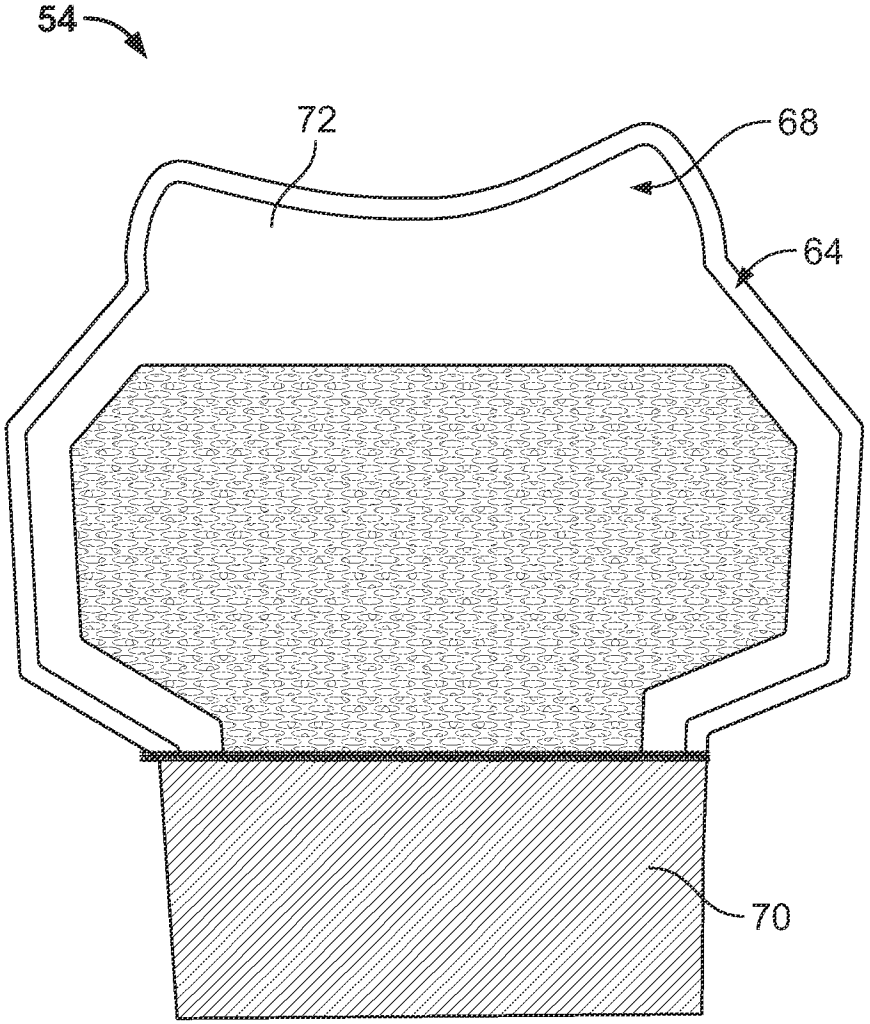
FIG. 13A is a top view of an embodiment of the tongue shown in FIG. 12.

The tongue 54 shown in FIGS. 13A and 13B has a body 64 with a connecting part 66 and a tongue member 68. In the illustrated embodiment, the tongue 54 is preferably made with a similar material as the gusset 56 but may be made with any suitable material. As shown in FIGS. 3 and 13A, the connecting part 66 is attached to the gusset 56 by stitching, an adhesive or other suitable attachment method. The tongue member 68 extends from the gusset 56 toward the heel portion 30 of the shoe 20, and each side of the tongue member 68 includes a flap 70 that extends around at least a portion of the opposing sides of a user's foot. A pull member 72 at the end of the tongue member 68 provides a gripping area so that a user may grip the tongue member to adjust the fit and position of the tongue 54 and shoe 20 relative to a user's foot.

FIG. 13B shows the different material layers that combine to form the tongue 54. A first layer or base layer 74 is made of a first material that is preferably a stretchable and breathable material. A second layer 76 is attached to the first layer by stitching or adhesive and is made of a breathable material. A third layer 78 is attached to the second layer 76 and is made of a thin material the overlays the second layer and promotes the flow of air through the second and third layers of the tongue. A fourth layer 80 having a central opening 82 that is attached to the third layer 78 so that the combination of the second and third layers is exposed on the top side of the shoe. The first, second, third and fourth layers 74, 76, 78 and 80 may be made with any suitable material or combination of materials.

Figure 14:
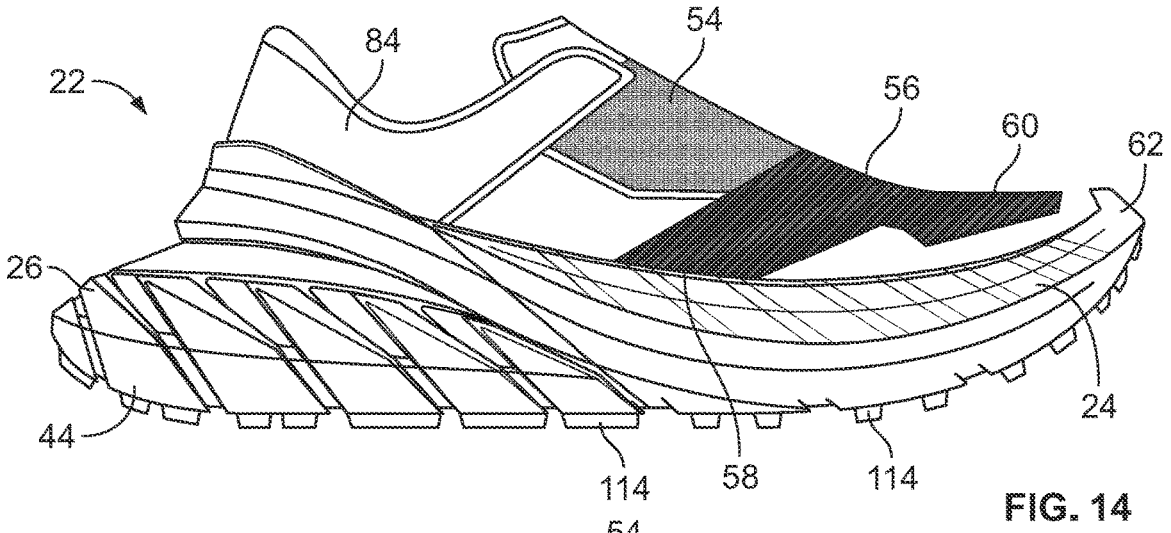
FIG. 14 is a right side view of the outsole of FIG. 12 including a rear collar attached to the outsole, where the left side view of the rear collar is a mirror image thereof.
Figure 15B:
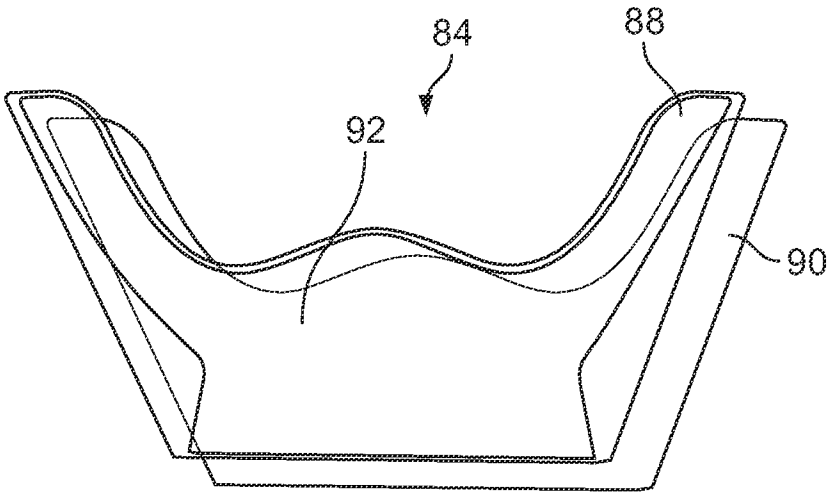
FIG. 15B is a rear view of the rear collar of FIG. 15A.
Figure 15A:
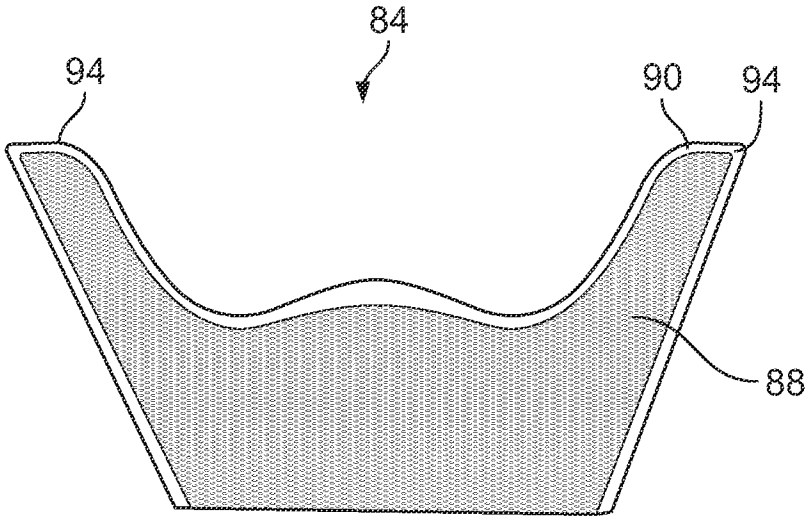
FIG. 15A is a front view of an embodiment of the rear collar shown in FIG. 14.

Referring to FIG. 14, a rear collar 84 is attached to the rear portion 86 of the midsole 24 by stitching or other suitable attachment method. As shown in FIGS. 16A and 16B, the rear collar 84 includes an outer lining 88, an inner lining 90 attached at least at the peripheral edge of the outer lining, and a foam material 92 positioned between the inner and outer linings. The foam material 92 is a polyurethane foam and is positioned in predetermined areas adjacent to a user's foot to provide cushioning and comfort. The rear collar 84 has upwardly extending arms 94 that extend to opposing sides of the tongue 54 as shown in FIG. 15 and overlap at least a portion of the outer surface of the tongue. In the illustrated embodiment, the inner and outer linings 88, 90 are made of a stretchable and breathable material, but may be made out of any suitable material.

Figure 2:
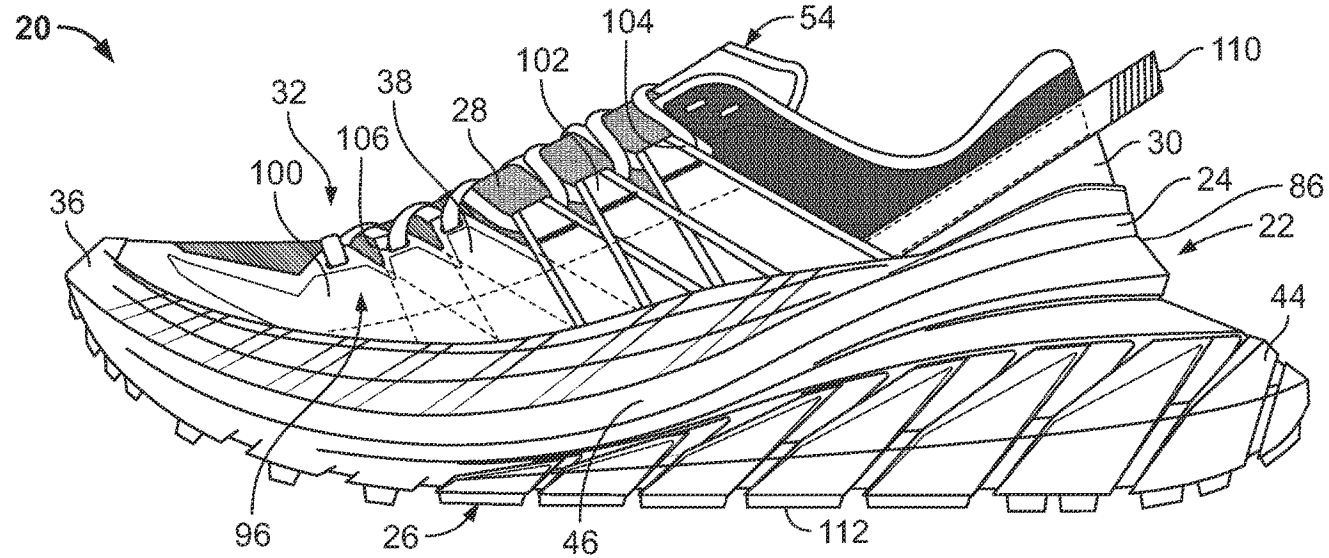
FIG. 2 is a left side view of the footwear of FIG. 1.
Figure 16:
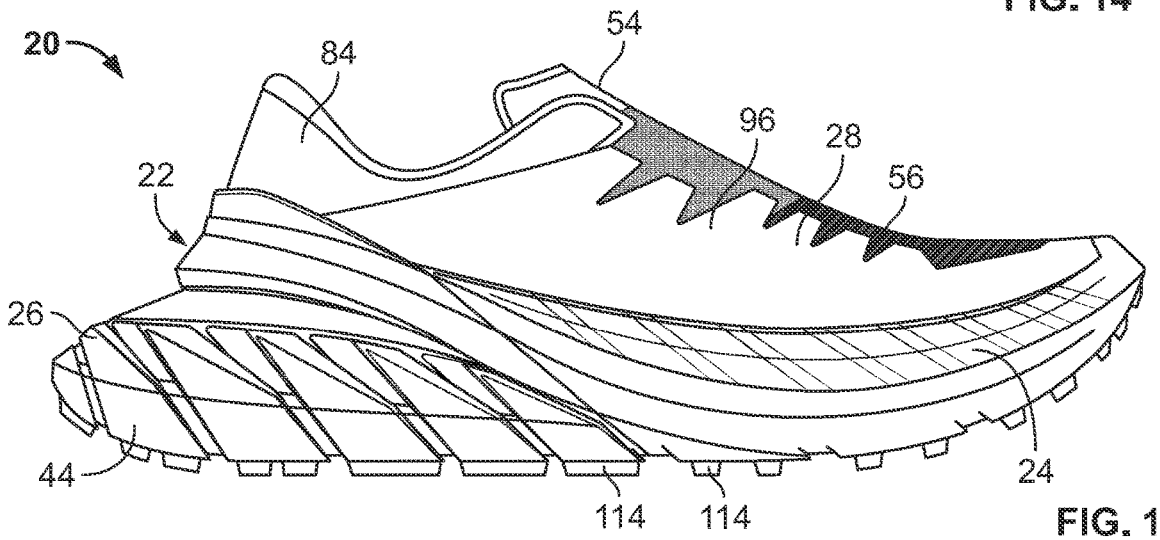
FIG. 16 is a right side view of the outsole of FIG. 15 including a vamp attached to the outsole, where the left side view of the vamp is a mirror image thereof.

Referring to FIG. 16, a vamp 96 having a general U-shape includes a first side 98 that extends along the medial side 46 of the shoe 20, and a second side 100 that extends along a lateral side 48 of the shoe 20. The vamp 96 further includes a toe portion 98 that connects the first and second sides 98, 100 and extends over at least a portion of the forefoot area of a user's foot. The vamp 96 is made of a durable material where the first and second sides 98, 100 of the vamp each include a series of tabs 102. Some of the tabs 102 form loops 104 and some of the tabs include holes 106. As shown in FIGS. 1 and 2, a shoe lace 108 is threaded through the loops 104 and holes 106 associated with the tabs 102 on the first and second sides 98, 100 of the vamp 96 in a crisscross pattern to adjust the fit of the shoe 20 on a user's foot. It should be appreciated that the first and second sides 98, 100 of the vamp 96 may include tabs forming loops, tabs including holes or a combination of tabs forming loops and tabs with holes.

As shown in FIG. 3, the upper 28 is constructed to have a wider throat area 108, i.e., width between the opposing sides of the upper, at the heel portion 30 to allow for even pressure distribution by the user's heel on the shoe and to provide more comfort to the user's foot. Further, the upper 28 is constructed to extend higher along a user's foot in the heel portion 30 to enhance the stability and comfort of the shoe 20.

To enhance the positioning of the shoe 20 on a user's foot, a strap 110 is attached to the heel portion 30 of the shoe and extends from the medial side 46 to the lateral side 48 of the shoe about the heel portion. As shown in FIG. 1, at least a portion of the strap 110 extends a distance away from the heel portion 30 to form a loop at the heel portion of the shoe 20. The strap 110 can therefore be grabbed by a user to adjust the position of the shoe 20 on the user's foot or help to pull the shoe 20 onto the user's foot. A part of the strap 110 includes a reflective material to help make the shoe 20 and thereby the user visible in low light conditions. The strap 110 is preferably made out of a fabric webbing material.

Figure 4:
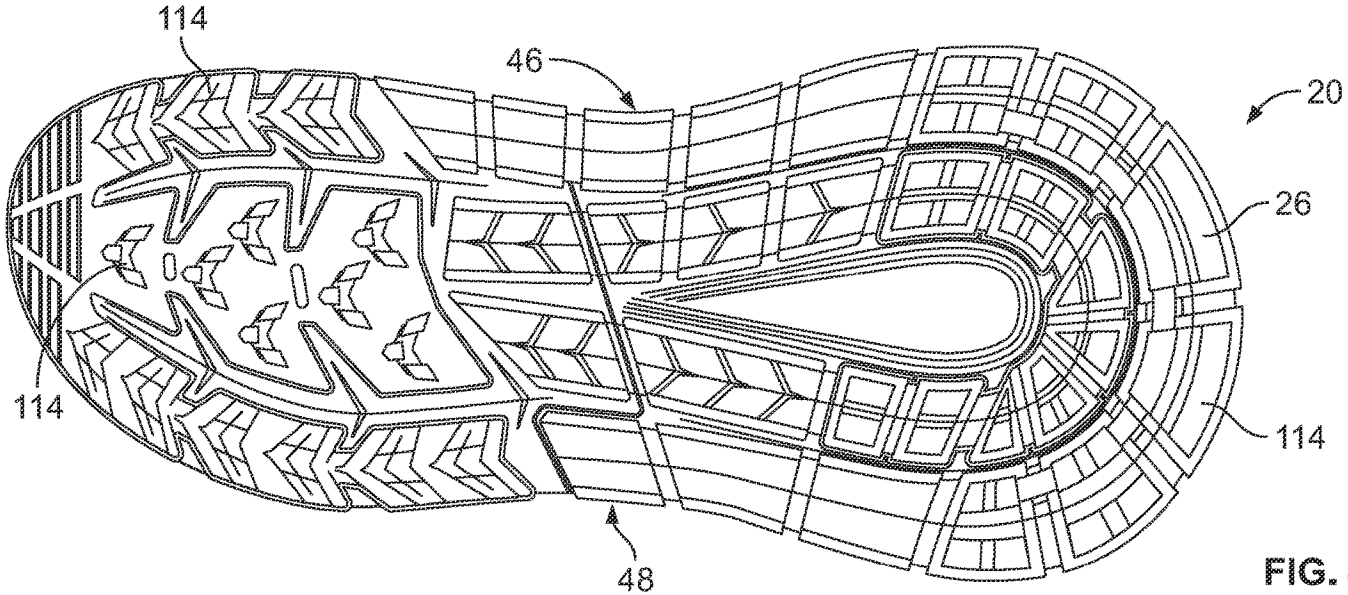
FIG. 4 is a bottom view of the footwear of FIG. 1.
Figure 5:
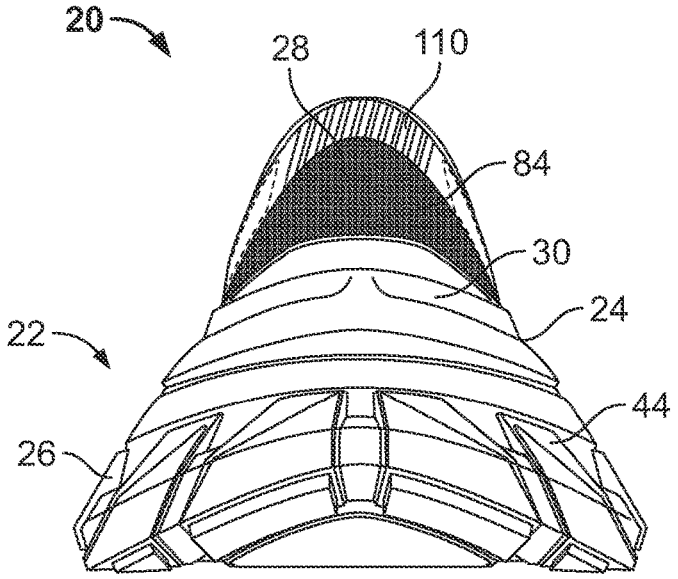
FIG. 5 is a rear view of the footwear of FIG. 1.
Figure 6:
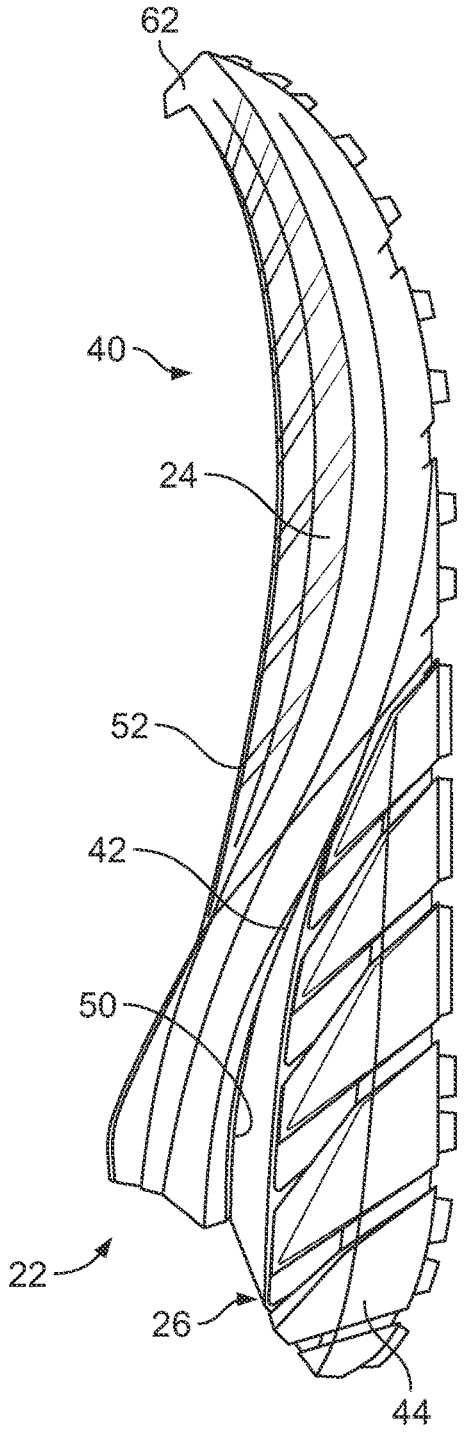
FIG. 6 is a right side view of an embodiment of an outsole of the footwear of FIG. 1.
Figure 7:
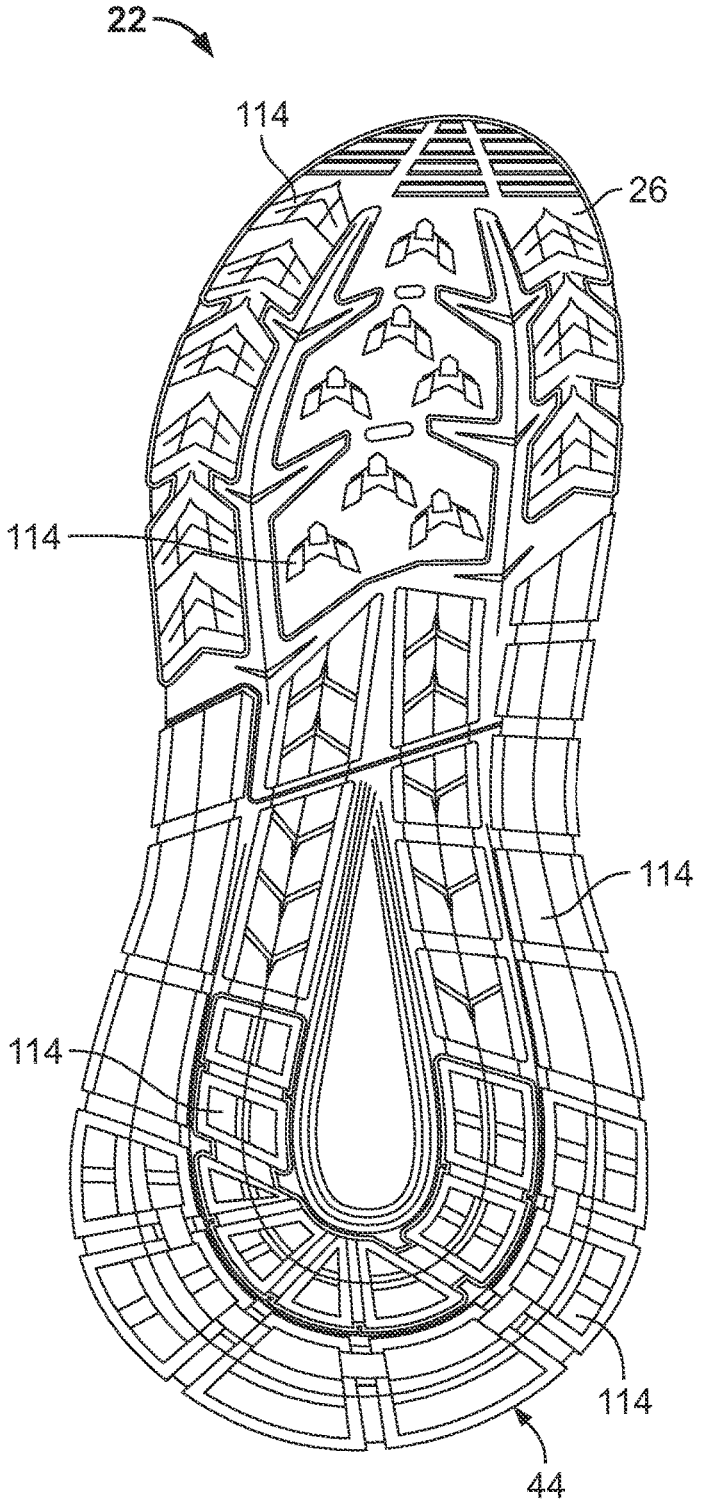
FIG. 7 is bottom view of the outsole of FIG. 6.
Figure 8:
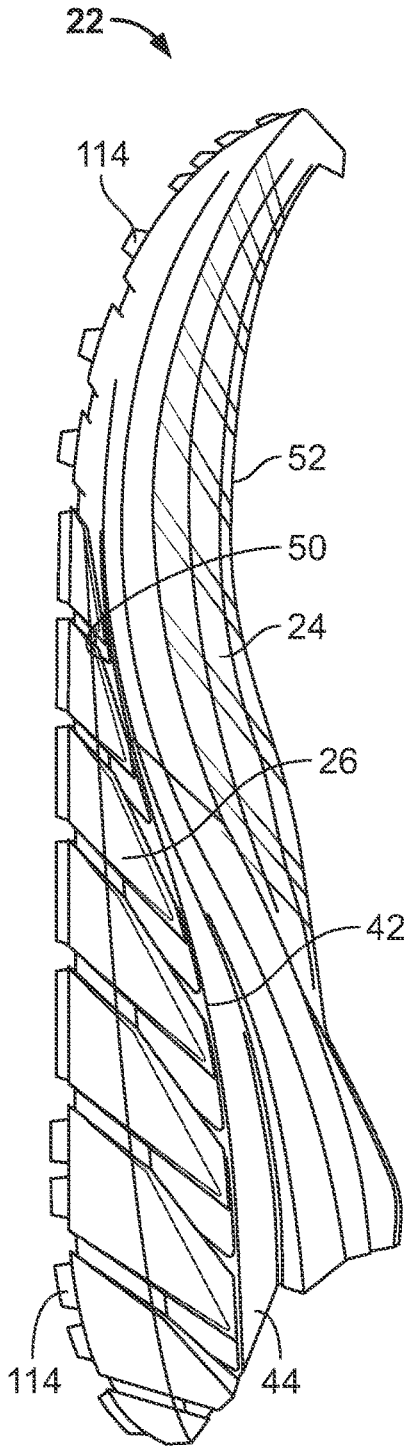
FIG. 8 is a left side view of the outsole of FIG. 6.
Figure 9:
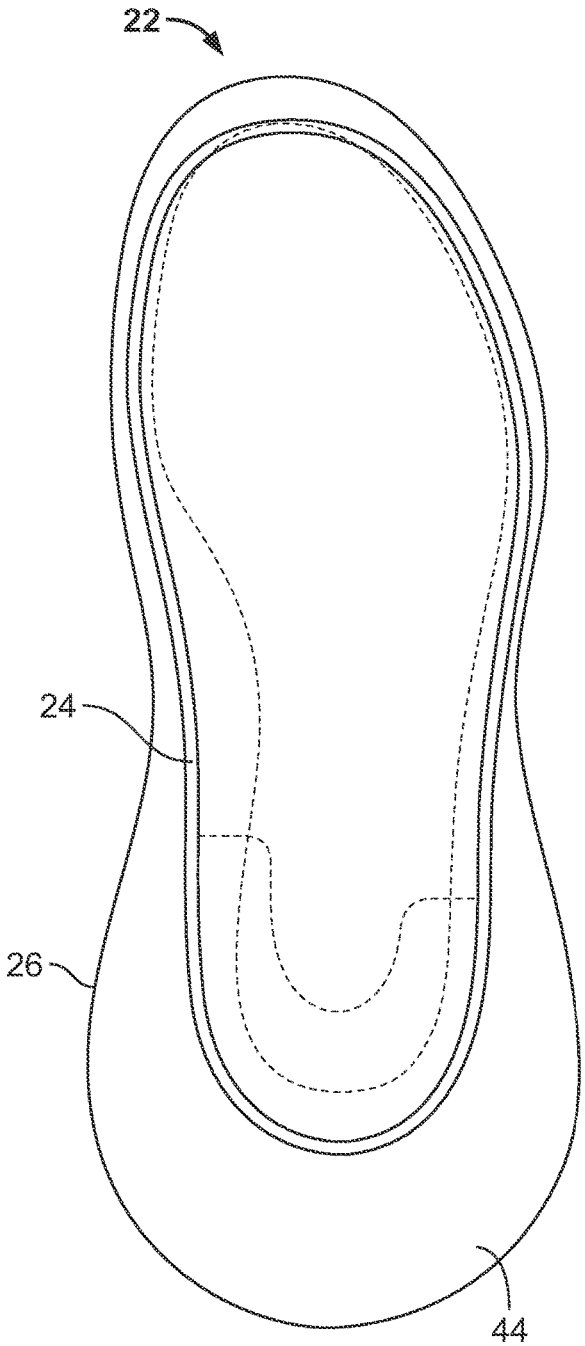
FIG. 9 is a top view of the outsole of FIG. 6.
Figure 10:
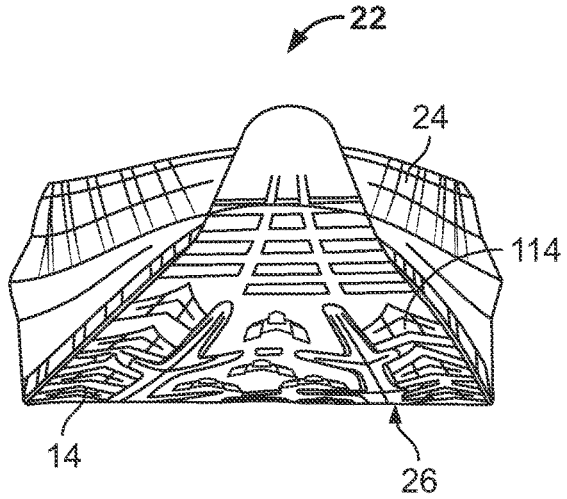
FIG. 10 is a front view of the outsole of FIG. 6.
Figure 11:
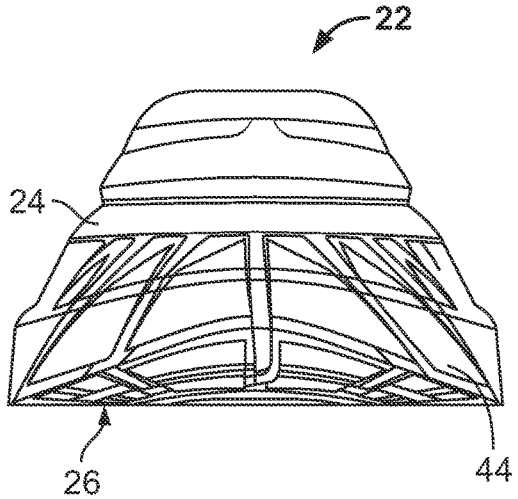
FIG. 11 is a rear view of the outsole of FIG. 6.

As shown in FIG. 4, a bottom surface 112 of the outsole 26 includes a plurality of tread members 114 that extend from the bottom surface. The tread members 114 are made of a rubber material and help the shoe 20 engage and grip an underlying surface. It should be appreciated that the tread members 114 may be any suitable size and shape, and may be any combination of sizes and shapes as shown in the illustrated embodiment.

Referring now to FIGS. 17-31, in the following embodiments of the present shoe 198, the sole 200 comprises three structural axes that are embodied by stabilizing members extending outwardly from the general profile of the upper 202, i.e. to the front, to the rear or laterally, where the stabilizing members perform independently from one another, and according to different combinations. According to different embodiments discussed in the following paragraphs, the stabilizing members may consist of the same material as the sole 200, a different material than the sole 200, synthetic materials, composite materials, an insert molded in a synthetic material, or any combination of suitable materials, and may extend partially over the sole or over the entire sole 200.

In the illustrated embodiments, the midsole 208 includes a peripheral rim 204 consisting of a wall 206 extending upwardly that creates a recessed portion or cradle on the top of the midsole that receives and surrounds the bottom part of the upper 202. In other words, the top part of the sole 200 comprises the midsole 208 consisting of a hollow profile open at the top that is intended to receive the upper 202, the midsole 208 including the peripheral rim 204. It should be appreciated that the shoe 198 may be equipped with a glued or removable insole or footbed. As shown in the figures, the sole 200 extends substantially under the entire bottom surface of the upper 202 and upwardly along at least a portion of the upper, where the thickness thereof is typically greater at the heel than at the toe. In this way, the peripheral wall 206 provides support to the sides of the upper 202 to help support and balance a user's foot while walking, jogging or running on uneven terrain. In an embodiment, the length (LU) of the upper 202 corresponds substantially to the shoe size, i.e., women's size 7, men's size 9.5, etc. Note that a conventional sole extends to the front beyond the upper profile over a length of approximately 2.0 to 25 millimeters, i.e. approximately 0.8% to 6% of the length (LU) of the upper 202, and generally covers the front upper end of the upper, i.e., a toe cap, so as to protect the user's toes. The length ranges relative to the upper are not routine for sports shoes, but more suitable for walking or safety shoes, which are not suitable for running and particularly not for a long-distance run, or a speed run, particularly because they have an outsole, generally substantially planar, thick and rigid, having a Shore D hardness between 55 and 65.

Referring to FIGS. 17-21, in an embodiment, a shoe 198*a* includes sole 200, comprising a front stabilizing member 210 extending outwardly, longitudinally from the front of the sole 200 relative to the general profile of the upper 202. The front stabilizing member 210 provides a propulsion effect at the end of a stride while a user is walking, jogging or running. In the illustrated embodiments, the length (L2) of the front stabilizing member 210 is 7% to 60% of the length (LU) of the upper 202, and preferably 9% to 60% of the length (LU). It is also contemplated that the front stabilizing member 210 may be 9% to 40% of the length (LU), 9% to 25% of the length (LU), or 20% to 25% of the length (LU).

In this embodiment, the length (L2) of the front stabilizing member 210 is 9% to 11% of the length (LU) of the upper 202. Alternatively, according to the embodiments illustrated in FIGS. 29 and 30, the length (L2) of the front stabilizing member 210 is 25% to 25% of the length (LU) of the upper 202. In one embodiment, not shown, the length (L2) of the front stabilizing member 210 is 25% to 60% of the length (LU) of the upper 202. Note that the length (L2) of the front stabilizing member 210 corresponds to the length between the distal end of the upper 202, relative to the heel, and the distal end of the front stabilizing member 210. The profile of the sole 200 extends to the front by the front stabilizing member 210. As shown, the front profile of the sole 200 curves upwardly, and thereby, decreases in thickness conventionally from the metatarsal region to the front end of the upper 202.

Figure 18:
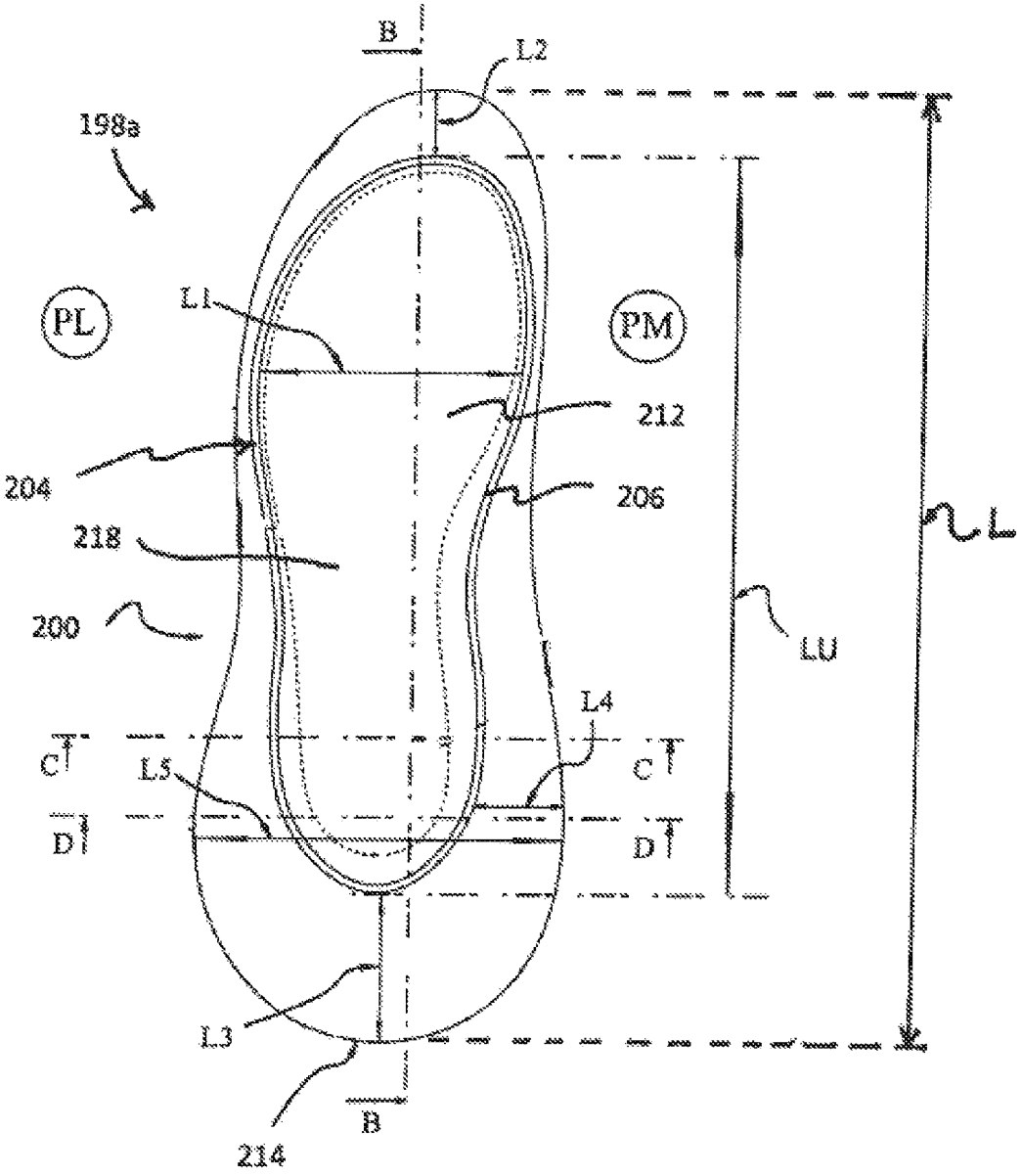
FIG. 18 is a top view of the footwear of FIG. 17.
Figure 19:
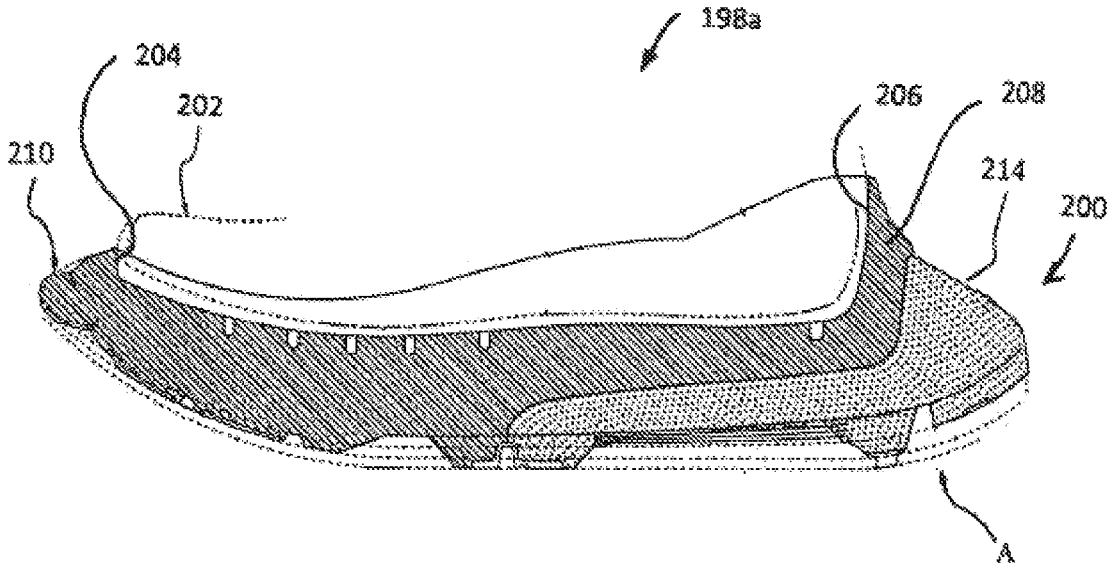
FIG. 19 is a cross-section view of the footwear shown in FIG. 18 substantially along line B-B in the direction generally indicated.
Figure 20:
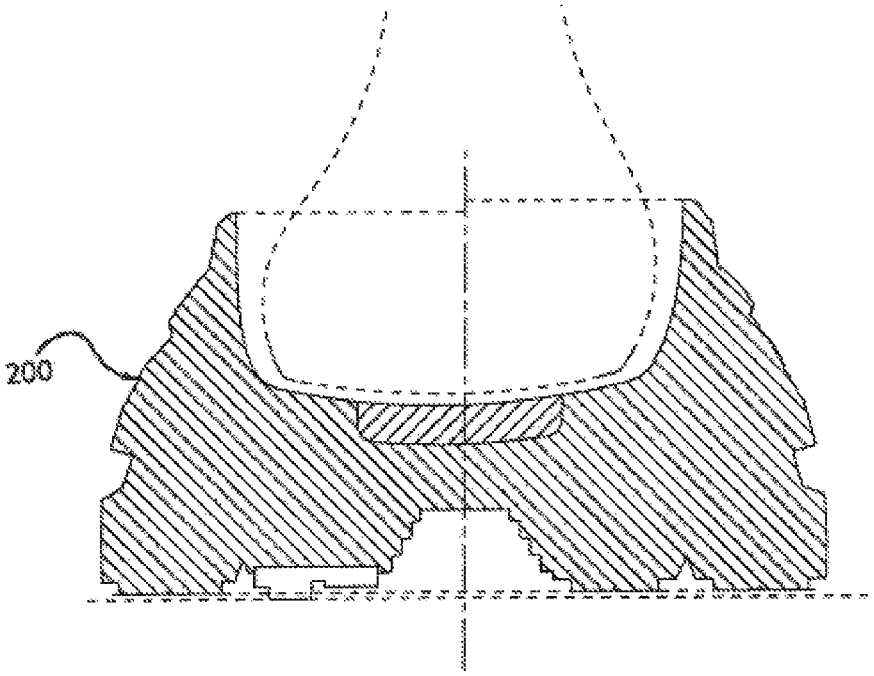
FIG. 20 is a cross-section view of the footwear shown in FIG. 18 substantially along line C-C in the direction generally indicated.
Figure 21:
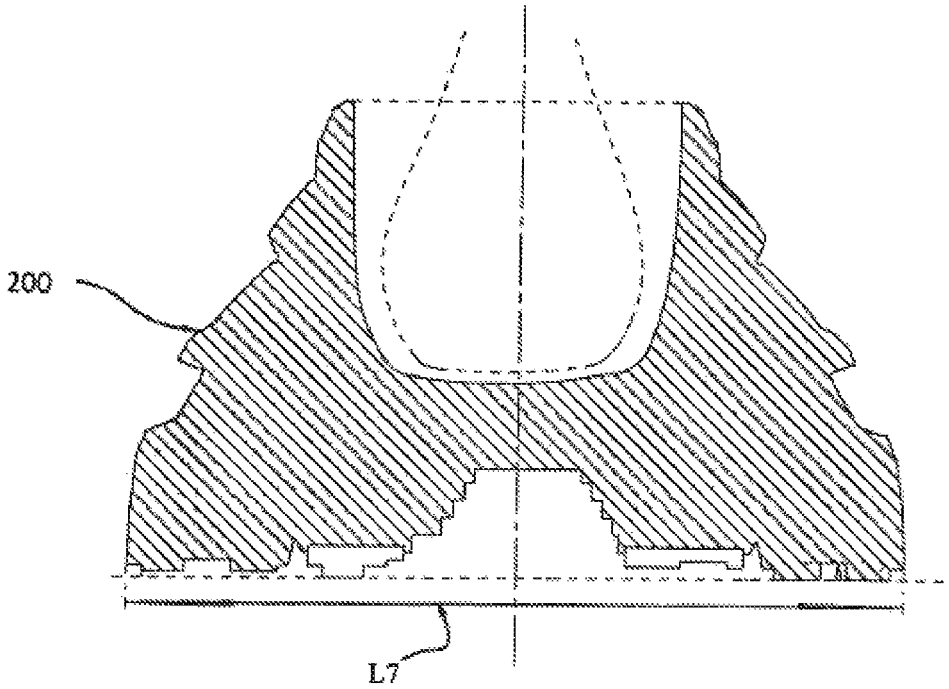
FIG. 21 is a cross-section view of the footwear shown in FIG. 18 substantially along line D-D in the direction generally indicated.
Figure 22:
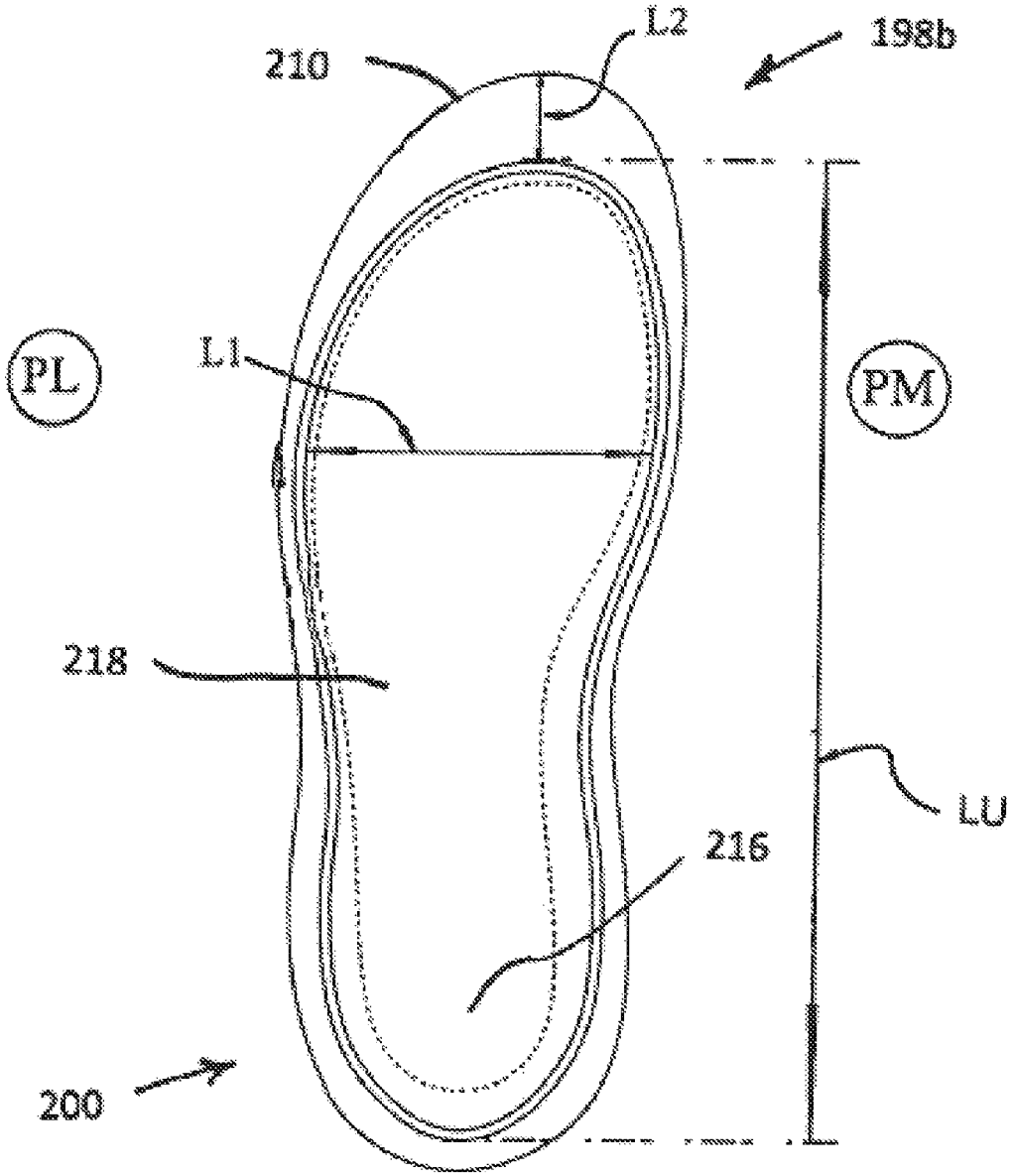
FIG. 22 is a top view of another embodiment of the present footwear having a front stabilizing member.

In an embodiment, the front stabilizing member 210 has a uniform, or substantially uniform thickness at thickness points (E3, E3*a*, E3*b*), along substantially the entire length (L) of the shoe (FIG. 18). Alternatively, the thickness points or thicknesses (E3, E3*a*, E3*b*) of the front stabilizing member 220 may decrease from the proximal end to the distal end of the sole 200 relative to the heel, or may be different thicknesses (E3, E3*a*, E3*b*). In the illustrated embodiment, the mean thickness (E3) of the front stabilizing member 210 is 2% to 30% of the length (LU) of the upper 202, i.e., the thickness (E3*a*) at the base of the front stabilizing member 210 is 2% to 30% of the length (LU) of the upper 202, and the thickness (E3*b*) substantially at the distal end of the front stabilizing member 210 is 2% to 30% of the length (LU) of the upper 202. Note that the thickness (E3*a*) at the base of the front stabilizing member 210 corresponds to the thickness of the sole 200 at the distal end of the upper 202 relative to the heel, whereas the thickness (E3*b*) substantially at the distal end of the front stabilizing member 210 corresponds to the thickness of the front stabilizing member 210 at approximately 4% of the length (LU) of the upper 202 relative to the distal end of the front stabilizing member 210. In this embodiment, the mean thickness (E3) of the front stabilizing member 210 is preferably 2% to 25% of the length (LU) of the upper 202, and more preferably 3% to 20% of the length (LU).

In one embodiment, the ratio between the thickness (E3*b*) at substantially the distal end thereof and the thickness (E3*a*) at the base of the front stabilizing member 210 is 0.25 to 2, more preferably 0.5 to 2. It should be appreciated that the thickness (E3) of the front stabilizing member 210 may be modulated according to the thickness of the sole 200, the constituent material(s) of the sole 200 and the length of the sole 200. A relatively large thickness (E3) of the front stabilizing member 210, measured from the bottom to the top of the front stabilizing member 210, makes it possible to store energy during the compression of the front stabilizing member 210 at the end of a stride and to release the stored energy during the launch phase of the weight bearing leg.

In the illustrated embodiment, the width (L2) of the widest part of the upper 202 is located at the metatarsal region and decreases toward the distal end of the upper 202, i.e., at the toe. As shown, the front stabilizing member 210 originates at the widest part of the front part of the upper 202 and extends distally, longitudinally outward. In other words, the front stabilizing member 210, forming an outward extension of the sole 200, extends from the widest zone of the front part of the upper 202 to the front, i.e. in the distal direction of the front end of the upper 202. Additionally, the curvature of the distal end of the front stabilizing member 210 is less than or equal to the curvature of the distal end of the upper 202. In the illustrated embodiment, the curvature is oriented toward the medial part (PM) of the shoe, where the volume of the medial part (PM) of the front stabilizing member 210 is greater than the volume of the lateral part (PL) of the front stabilizing member 210. Note that the curvature of the front stabilizing member 210 enhances the propulsion effect by increasing the volume in the medial part (PM) of the front stabilizing member 210, which promotes ground contact and relaunch of a user's stride.

In the above embodiment, the front stabilizing member 210 is an integral part of the sole 200 and protects the front of the sole 200 in the distal direction of the front end of the upper 202. In another embodiment, the front stabilizing member 210 has an upward curvature, i.e., directed from the bottom end of the sole 200 to the upper 202. In this embodiment, the height (H2) of the distal end of the bottom surface of the front stabilizing member 210 relative to the bottom surface of the center of the sole 200, i.e., with respect to the ground, is 0% to 60% of the length (LU) of the upper 202, preferably 3% to 30% of the length (LU) of the upper 202, more preferably 3% to 20% of the length (LU) of the upper 202. It should be appreciated that the height (H2) may be modified based on the material(s) of the front stabilizing member 210 and the specific use of the shoe.

In the illustrated embodiment, the thickness (E2) of the sole at the widest part of the upper, i.e., at the base of the metatarsals, is 9.5% to 30% of the length (LU) of the upper 202, preferably 20% and 30% of the length (LU) of the upper 202, more preferably 20% to 25% of the length (LU) of the upper 202. Note that the thickness (E2) corresponds to the distance between the bottom end of the upper 202 and the bottom end of the sole 200, where the end of the sole 200 is in contact with the ground. In this embodiment, the range of thickness (E2) of the sole 200 at the metatarsal region, i.e. at the widest part 212 of the upper 202, provides a progressive shock absorbing effect, during repeated rolling contact between the shoe and the ground during walking, jogging and running. It should be appreciated that in an embodiment, the present shoe may include sole 200 having only the front stabilizing member 210, such as with shoe 198*b* shown in FIG. 22. In this embodiment, the front stabilizing member 210 extends a distance or length (L2) from the front of the upper.

Referring to FIGS. 17-19, 23, 24, 26, 27, 29 and 30, the sole 200 according to one embodiment, comprises a rear stabilizing member 214, extending longitudinally to the rear relative to the general profile of the upper 202. In these embodiments, the rear stabilizing member 214 extends the rolling ground contact phase, by initiating the ground contact earlier and distally relative to the heel. Note that the rear stabilizing member 214 provides a more progressive impact compared to a conventional shoe, through a fluidity of the pressure paths during each strike at the heel with the ground.

In the illustrated embodiments, the length (L3) of the rear stabilizing member 214 is at least 20% of the length (LU) of the upper 202, and preferably 9% to 60% of the length (LU) of the upper 202, more preferably 22% and 40% of the length (LU) of the upper 202, and more preferably 23% and 25% of the length (LU) of the upper 202. Note that the length (L3) of the rear stabilizing member 214 corresponds to the distance between the proximal end of the upper 202, i.e. the rear end of the upper 202 at the heel, and the distal end of the rear stabilizing member 214. Preferably, the rear stabilizing member 214 has a uniform, or substantially uniform, thickness (E4) along substantially the entire length of the rear stabilizing member 214. It is also contemplated that the thickness (E4) of the rear stabilizing member 214 decreases from the proximal end to the distal end of the rear stabilizing member. It should be noted that the mean thickness (E4) of the rear stabilizing member 214 is 7% to 40% of the length (LU) of the upper 202, preferably 9% to 30% the length (LU) of the upper 202, and more preferably 22% to 25% the length (LU) of the upper 202. In an embodiment, the thickness (E4) of the rear stabilizing member is at least 1.0 cm. Also, the thickness (E4) of the rear stabilizing member 214 may be modified according to the thickness, the constituent material(s) and the length of the sole.

A relatively large thickness (E4) of the rear stabilizing member 214 helps to enhance shock absorption during compression of the rear stabilizing member at the start of a stride and promotes the initiation of the ground contact phase from a strike downstream from the heel to a heel contact, followed by a forward propulsion. Also, combining a large thickness (E4) of the rear stabilizing member 214 with a large thickness of the general profile of the sole 200 creates longitudinal shear strain at the sole, which reduces the strain sustained by the joints and the back of a user.

As shown in FIGS. 17-18, the thickness (E4) of the rear stabilizing member 214 is greater than the thickness (E2) of the sole 200 at the heel 216. Note that the thickness (E2) corresponds to the distance between the bottom end of the upper 202 at the heel 216 and the bottom surface of the sole 200, i.e. the end of the sole 200, that contacts the ground. In the illustrated embodiment, the top part of the rear stabilizing member 214 substantially encases an outer periphery of the top part of the heel, which promotes shock absorption during ground contact of the heel. As shown in FIG. 2, the rear stabilizing member 214 has a concave shape, along a cross-section perpendicular to the bottom surface of the sole 200, where the concave shape of the rear stabilizing member 214 provides optimized strain distribution.

Figure 29:
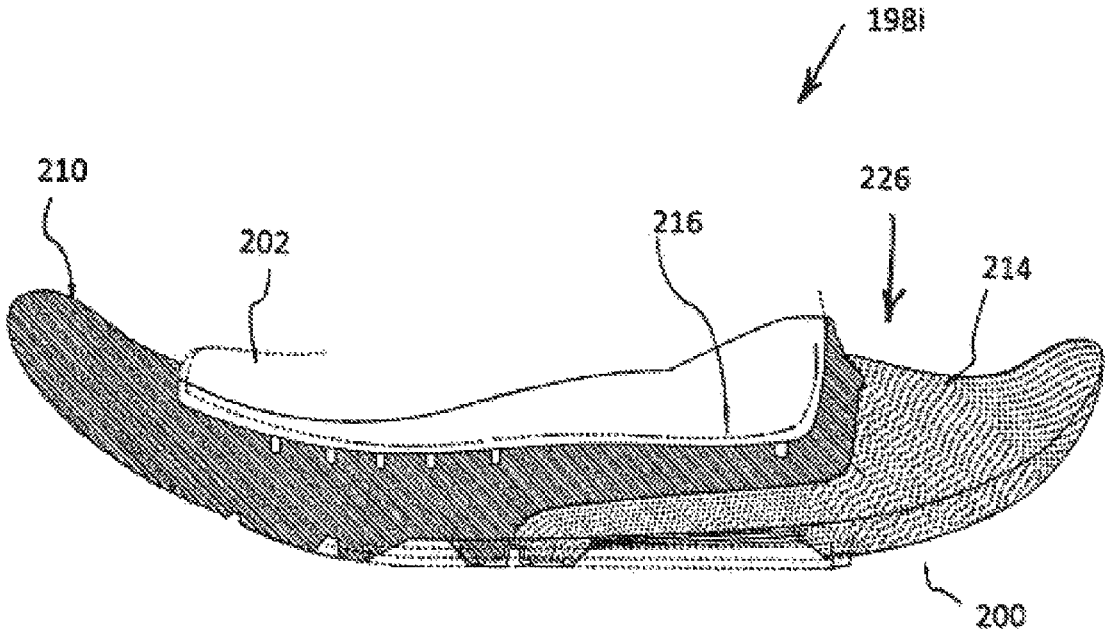
FIG. 29 is a cross-section view of the footwear in FIG. 27 taken substantially along line B-B in the direction generally indicated.
Figure 30:
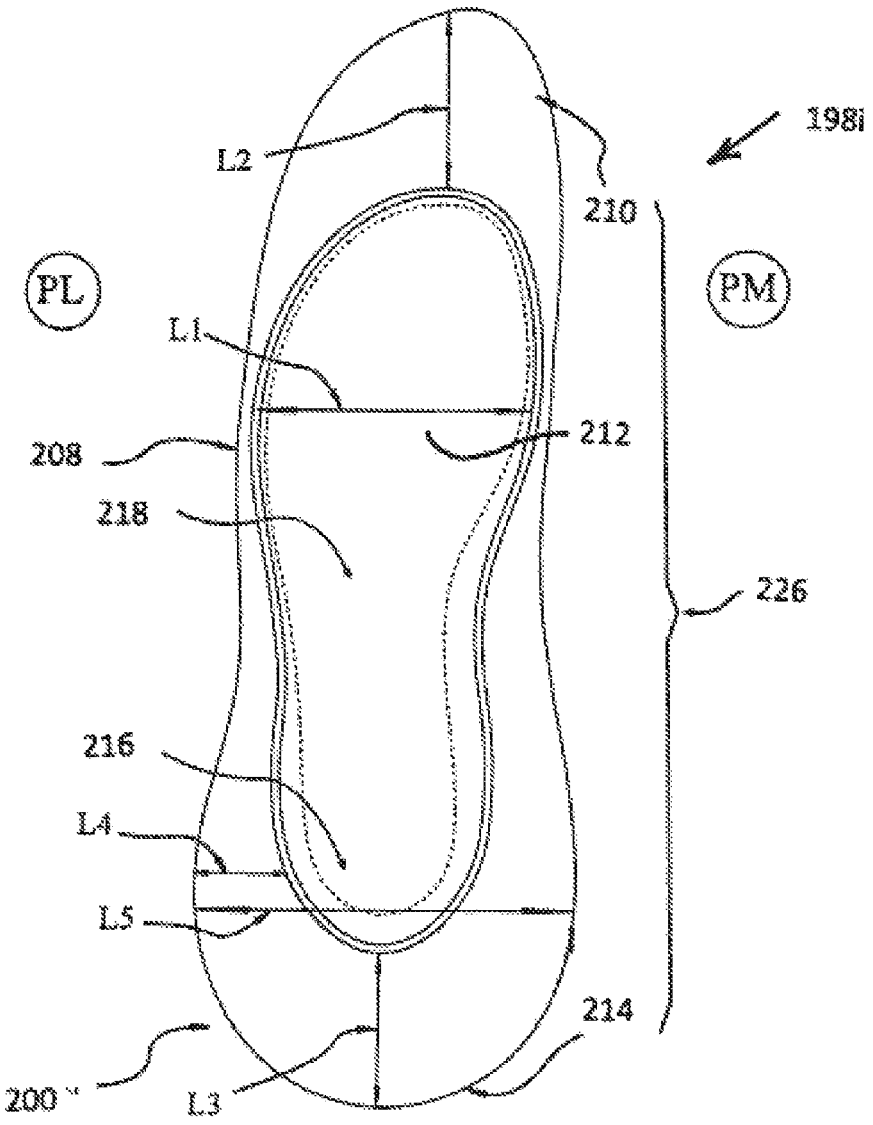
FIG. 30 is a top view of another embodiment of the present footwear having a front stabilizing member, lateral stabilizing members and a rear stabilizing member.

Referring to FIG. 29, in another embodiment, the rear stabilizing member 214 is raised upwardly, i.e. the rear stabilizing member is embodied by a tongue-shaped profile which has a concave curvature, along a perpendicular plane to the bottom surface of the sole 200.

Figure 24:
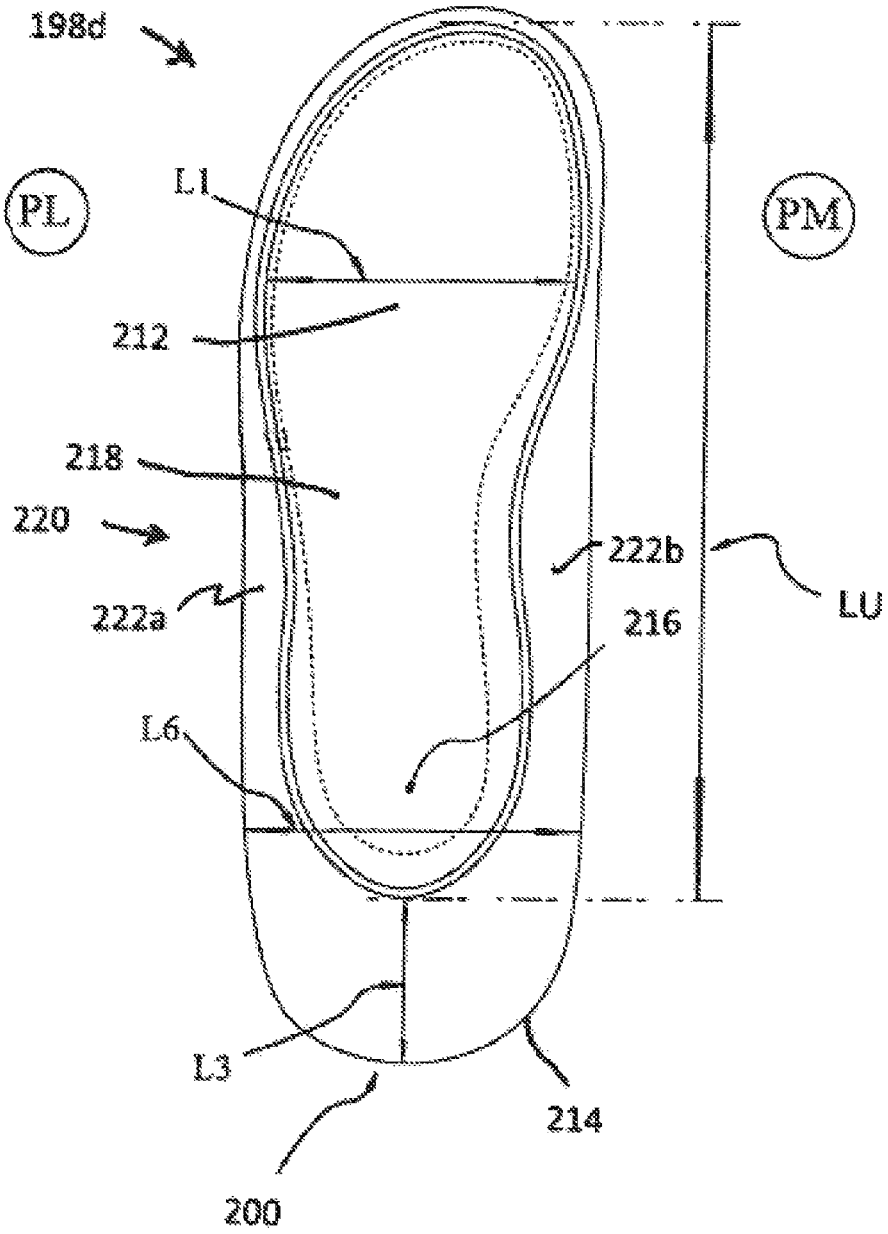
FIG. 24 is a top view of another embodiment of the present footwear having a rear stabilizing member.

Referring to FIG. 24, in a further embodiment, a shoe 198*d* includes sole 200 with rear stabilizing member 214, which originates at the widest part (L2) of the front part of the upper 202, and extends distally, longitudinally to the rear of the shoe, the lateral profile thereof following the rear lateral profile of the upper 202, but more broadly, extending distally beyond the heel. In this embodiment, the rear stabilizing member 214, forming an extension of the rear part of the sole 200, extends from the widest part 212 of the front part of the upper 202 to the rear, i.e., in the distal direction with respect to the heel.

Figure 23:
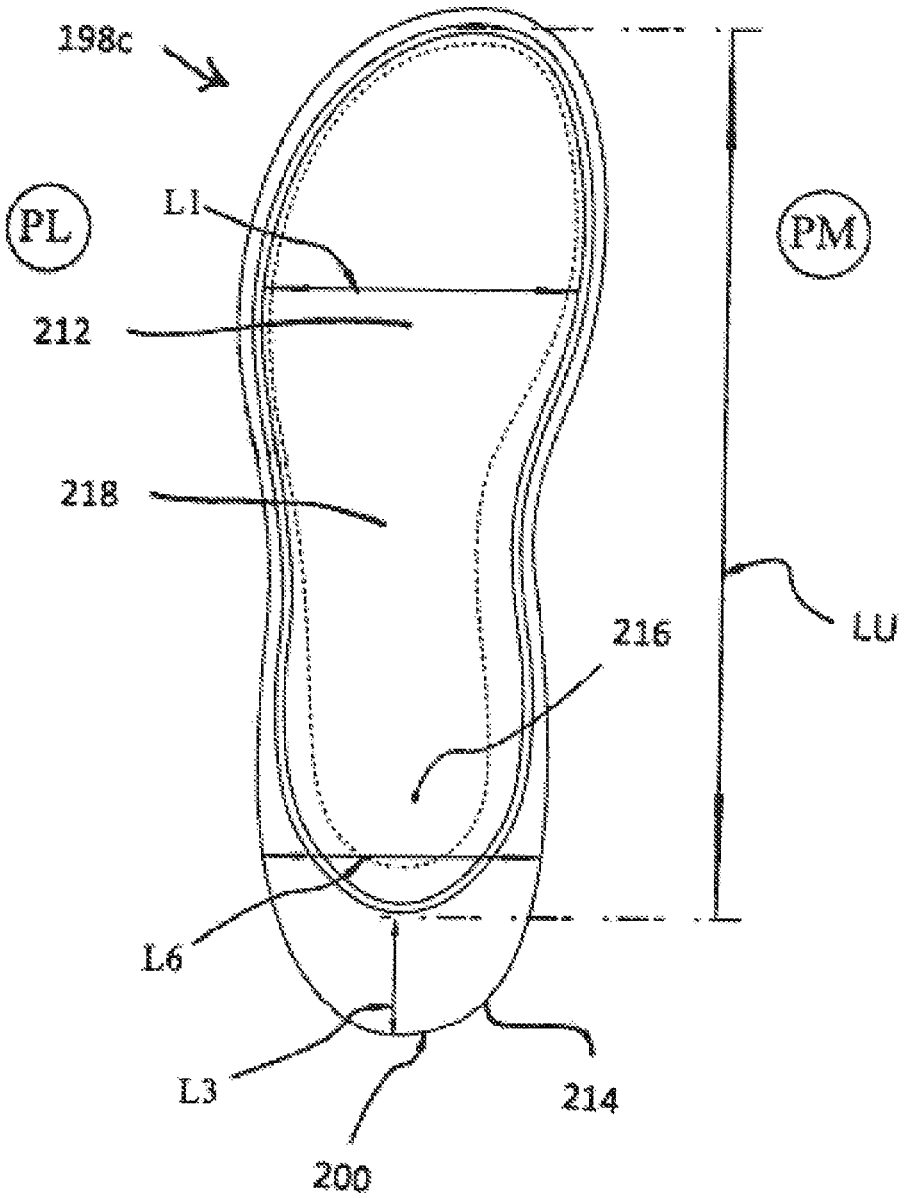
FIG. 23 is a top view of a further embodiment of the present footwear having a rear stabilizing member.

In another embodiment shown in FIG. 23, a shoe 198*c* has a sole where the rear stabilizing member 214 originates at the narrowing part 218 of the upper 202 facing the arch of the foot and extends distally longitudinally to the rear of the shoe, the lateral profile thereof following the lateral profile of the upper 202, and extending distally beyond the heel. In all of these embodiments, the difference in lateral thickness of the rear stabilizing member 214 relative to the lateral profile of the upper 202 is 2% to 6% of the length (LU) of the upper 202, as illustrated for example, in FIG. 24.

In an embodiment, the curvature of the distal end of the rear stabilizing member 214, along a sectional plane parallel with the bottom surface of the sole 200, is equal to, or greater than, the curvature of the proximal end of the upper 202 at the heel. In another embodiment, the distal curvature cited above relative to the heel, of the rear stabilizing member 214 is equal to that of the upper 202. In a further embodiment, the distal curvature cited above relative to the heel, of the rear stabilizing member 214 is greater than that of the upper 202. It should be noted that the relatively large width (L6) of the rear stabilizing member 214 enables optimized contact with the ground upon an early strike of a stride, i.e. distally with respect to the heel. To this end, the mean width (L6) of the rear stabilizing member 214 is 20% to 40% of the length (LU) of the upper 202.

In the illustrated embodiment, the rear stabilizing member 214 is an integral part of the sole 200 and protects the rear of the sole 200 in the distal direction of the rear end of the upper 202. Also, the bottom surface of the rear stabilizing member 214 has an upward curvature, i.e. directed from the bottom end of the sole 200 to the upper 202. Furthermore, the height (H2) of the distal end of the bottom surface of the rear stabilizing member 214 relative to the bottom surface of the center of the sole 200, i.e., with respect to the ground, is 0 to 60% of the length (LU) of the upper 202, preferably 3% to 60% of the length (LU) of the upper 202, more preferably, 4% to 60% of the length (LU) of the upper 202, more preferably 4% to 30% of the length (LU) of the upper 202, more preferably 5% to 20% of the length (LU) of the upper 202.

Figure 25:
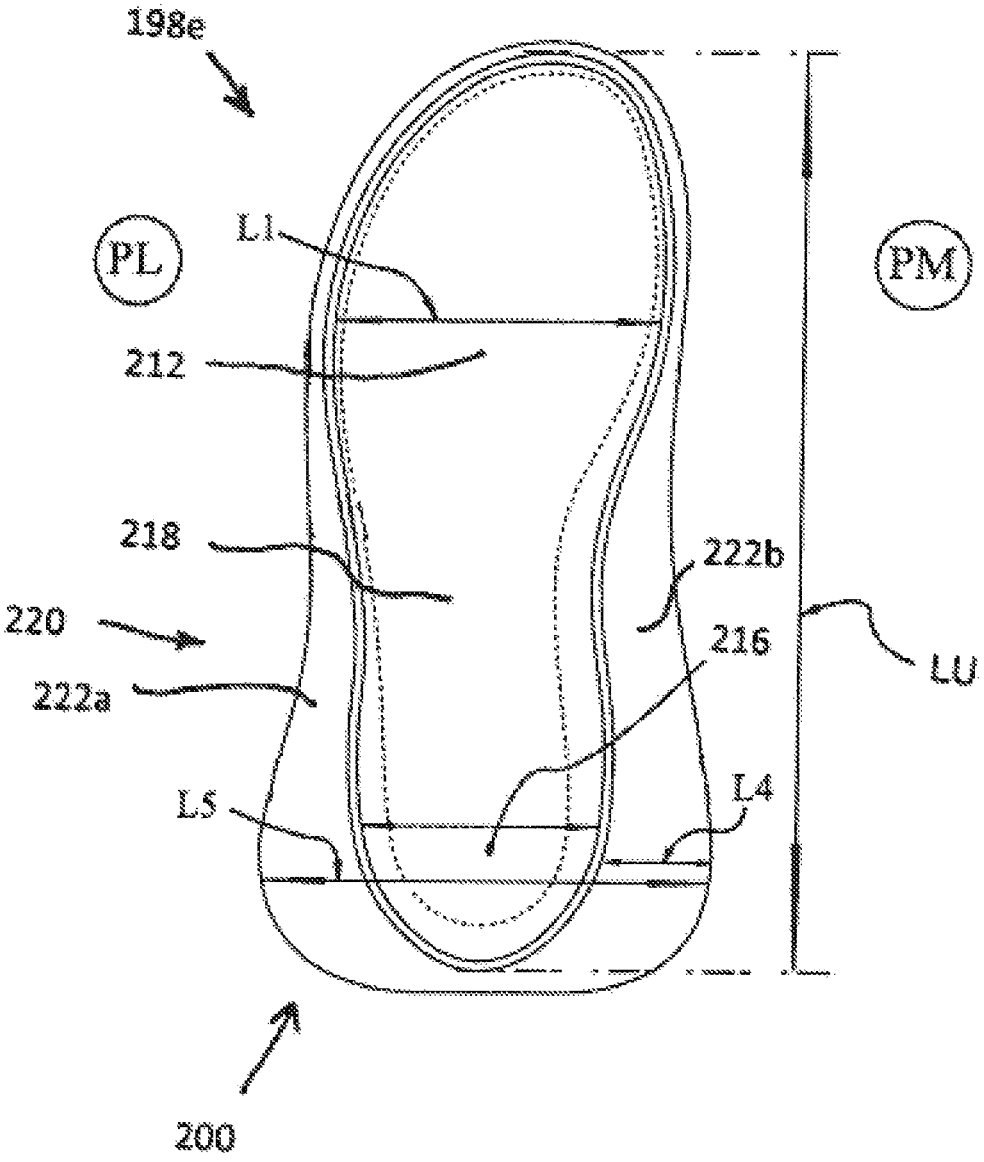
FIG. 25 is a top view of a further embodiment of the present footwear having lateral stabilizing members.

Referring to FIG. 25, in a further embodiment, a shoe 198*e* includes sole 200 comprising a lateral stabilizing member 220 located on both sides of the heel. The lateral stabilizing member 220 includes two lobes (222*a*, 222*b*), i.e., a lateral lobe 222*a* and a medial lobe 222*b*, that are located on and extend outwardly from opposing sides of the rear part of the upper 202 at the heel. During use of the shoe, the lateral stabilizing member 220 increases the lateral stability during a strike at the heel, by realigning the pressure paths toward the longitudinal median axis of the shoe profile. Further, upon poor positioning of the foot on ground contact, the lateral stabilizing member provides a sufficient delay time for the reflex mechanism to react and recover from the poor positioning, which helps to prevent injury to the user. Also, the lateral stabilizing member 220 helps to realign a user's feet during the strike phase, which limits fatigue by improving the regularity of motion during stride sequences. It should be appreciated that the lateral stabilizing member may extend outwardly from the medial side, the lateral side or both sides of the shoe.

In the illustrated embodiment, the lateral width (L4) of the lateral stabilizing member 220, on one side of the upper 202 at the heel, i.e., the lateral width (L4) of a lobe (222*a*, 222*b*), i.e., the distance the lobes each extend outwardly from the upper, is at least 5% of the length (LU) of the upper 202, and preferably 5% to 20% of the length (LU) of the upper 202, and more preferably 5% to 22% of the length (LU) of the upper 202. Furthermore, in an embodiment, the width of the medial lobe 222*b* or inner lobe (i.e., the medial distance that the lobe 222*b* extends from the upper), is less than the width of the lateral lobe 222*a* or the outer lobe (i.e., the lateral distance that the lobe 222*a* extends from the upper). It should be appreciated that the width of the medial lobe 222*b* may be greater than the width of the lateral lobe 222*a* or the medial and lateral lobes may have the same width. Further, the greatest lateral width (L5) from one edge to the other edge of the lateral stabilizing member 220, at the bottom surface of the sole 200, is 50% to 60% of the length (LU) of the upper 202, and preferably 52% and 57% of the length (LU) of the upper 202.

In an embodiment, the greatest width (L5) of the lateral stabilizing member 220 at the bottom surface of the sole 200 is equal to or greater than the largest width (L2) of the upper 202 at the metatarsal region. Further, the ratio between the greatest width (L5) of the lateral stabilizing member 220 at the bottom surface of the sole 200 and the greatest width (L2) of the upper 202 at the metatarsal region, is 2 to 3, preferably 2.2 to 2.5, more preferably 2.2 to 2.5. It should be appreciated that the ration may also be 2.25 to 2, or within a range greater than or equal to 2.3 and less than 2. Note that in the illustrated embodiment, the ratio of the shoe is at least less than 2.0, and preferably 0.6 to 0.9. As shown in FIG. 25, the outer profile of the lateral stabilizing member 220 originates at the widest part 222 of the front part of the upper 202, and more specifically, at the center or midfoot area of the upper 202, i.e., preferably at least at the center of the arch of the foot, to extend in a flared manner up to the rear end of the upper 202. Note also that the greatest width (L5) of the lateral stabilizing member 220 is located substantially facing the rear end of the upper 202, and at least located straight above the heel 226, so as to provide maximum stability at the ground contact zone of the heel.

In another embodiment, the lateral stabilizing member 220, or the part of the sole 200 forming the lateral stabilizing member 220, i.e., the lobes (222*a*, 222*b*), is more flexible than the other parts of the sole 200. In this way, the lateral stabilizing member 220 limits torque effects by limiting any overly abrupt return effects to a normal position of the shoe upon poor positioning of the heel on the ground and then recovery to a natural position.

In the illustrated embodiment, the lateral stabilizing member 220, i.e., the lobes (222*a*, 222*b*), include depressions, i.e., hollow parts, such as outer grooves, that soften the sole 200 on either side of the heel. In an embodiment, the lateral stabilizing member 220, i.e., the lobes (222*a*, 222*b*), is made of a more flexible material, i.e. having a lower Shore D hardness than the rest of the sole 200. It should be appreciated that the lateral stabilizing member may have the same or different hardness than the other parts of the sole 200.

Figure 26:
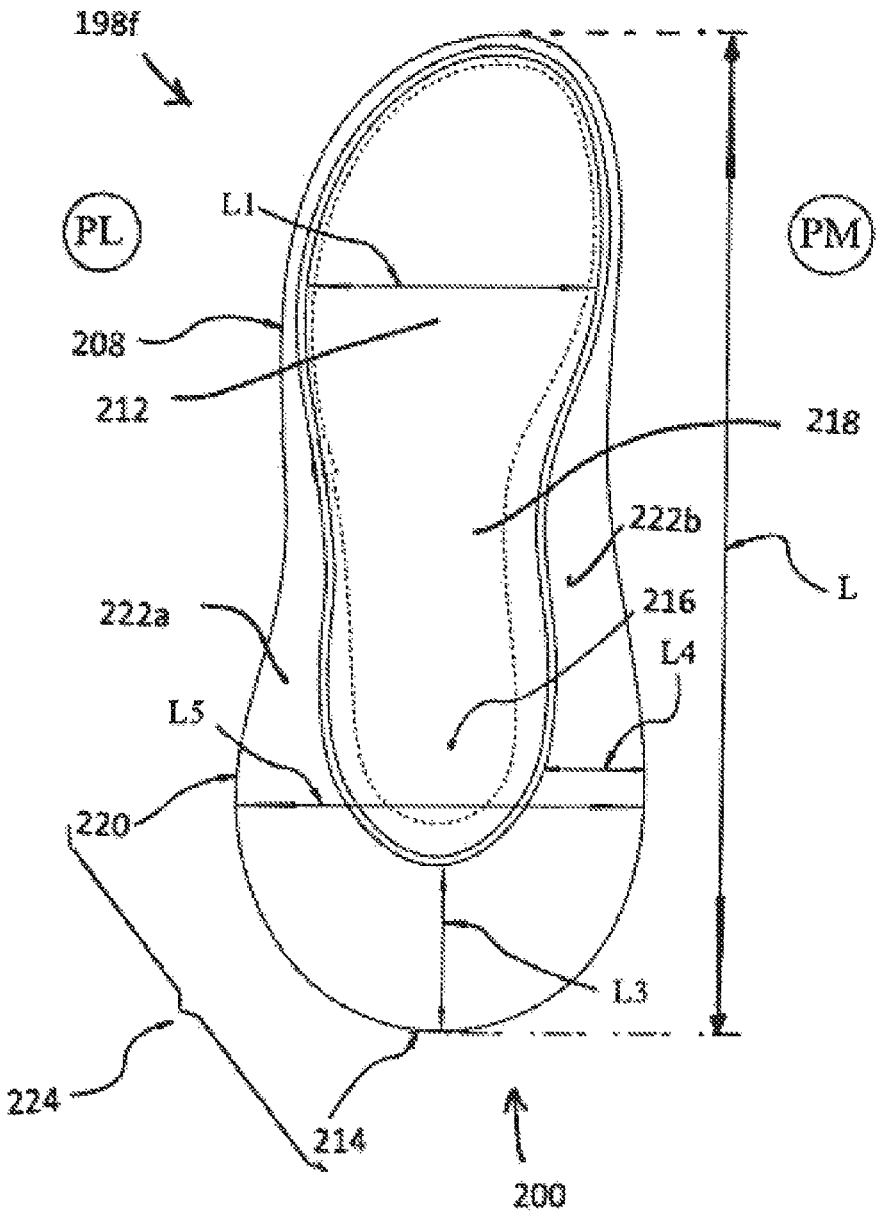
FIG. 26 is a top view of another embodiment of the present footwear having a peripheral rear stabilizing member.

In a further embodiment shown in FIG. 26, a shoe 198*f* includes sole 200 comprising a rear stabilizing member 214 and a lateral stabilizing member 220, thereby forming a rear peripheral stabilizing member 224 about the heel area of the shoe. In this embodiment, the rear peripheral stabilizing member 224 spreads out and realigns the stride, alleviates strain concentrations upon a heel strike, thereby spreading out the impact forces on a user's body. As shown in FIGS. 18 and 26, the rear peripheral stabilizing member 224 has an outer shape similar to an arc of a circle. As such, the rear peripheral stabilizing member 224 limits drifts and deviations relative to the positioning of the shoe along the preferential ground contact line of a natural stride. Note that the rear peripheral stabilizing member 224 thus extends distally relative to the heel over a length (L3) corresponding to the length of the rear stabilizing member 224 cited above, as well as over a width (L5) corresponding to that of the lateral stabilizing member 220.

Figure 27:
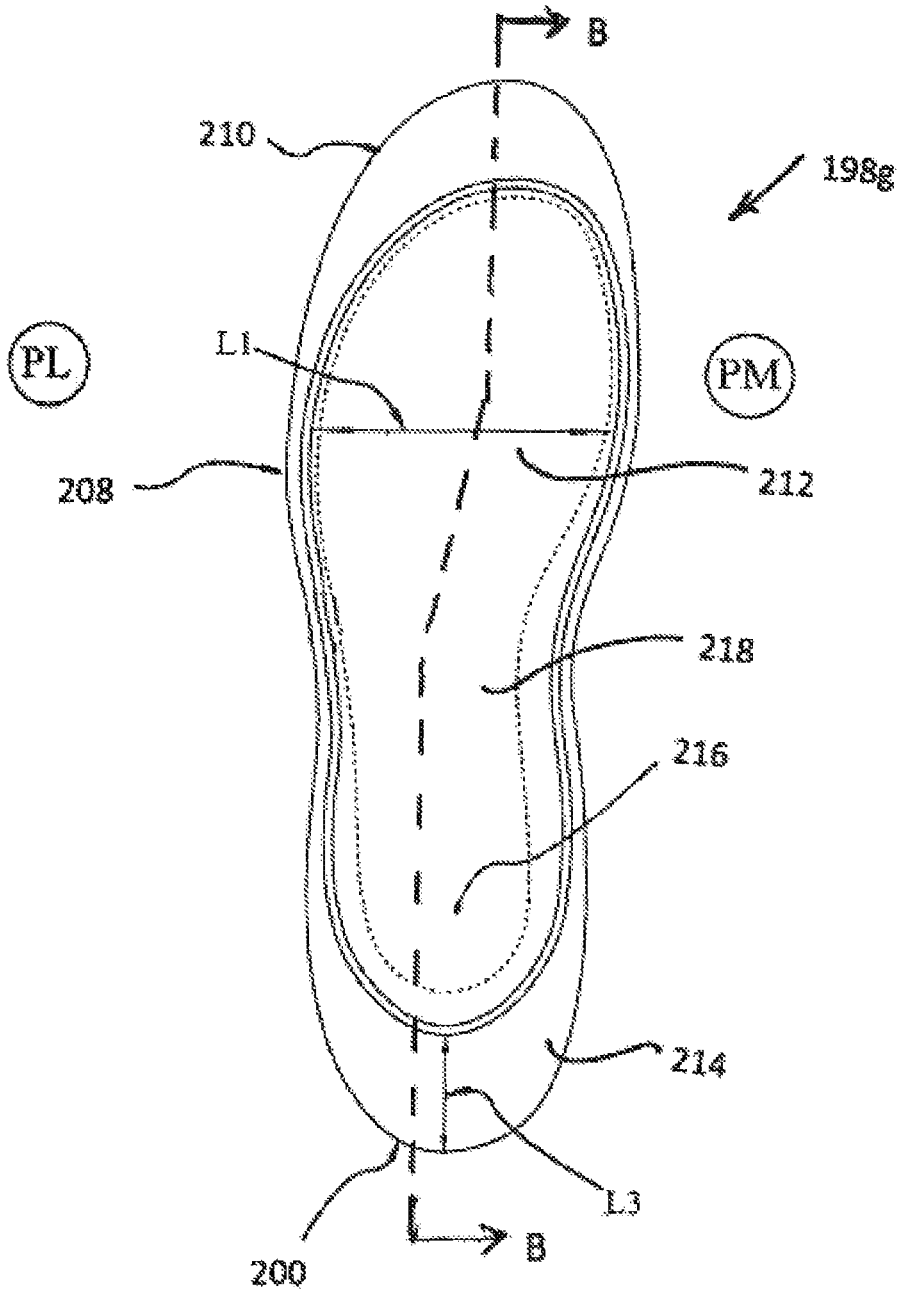
FIG. 27 is a top view of a further embodiment of the present footwear having a front stabilizing member and a rear stabilizing member.

Referring now to FIG. 27, in a further embodiment, a shoe 198*g* includes sole 200 comprising a front stabilizing member 210 and a rear stabilizing member 214, which increases the propulsion phase and generates a greater stride length or height. As such, the presence of the rear stabilizing member 214 in the combination cited above makes it possible, due to the increase particularly in the stride length, to initiate landing, and thereby initiate the ground strike phase earlier, which provides fluidity of motion of the user's stride. This fluidity of motion is provided both during the propulsion phase of a leg to the landing upstream from the heel on the other leg, and during the rear stride engagement phase to the forward rolling of the foot to the propulsion phase.

Figure 28:
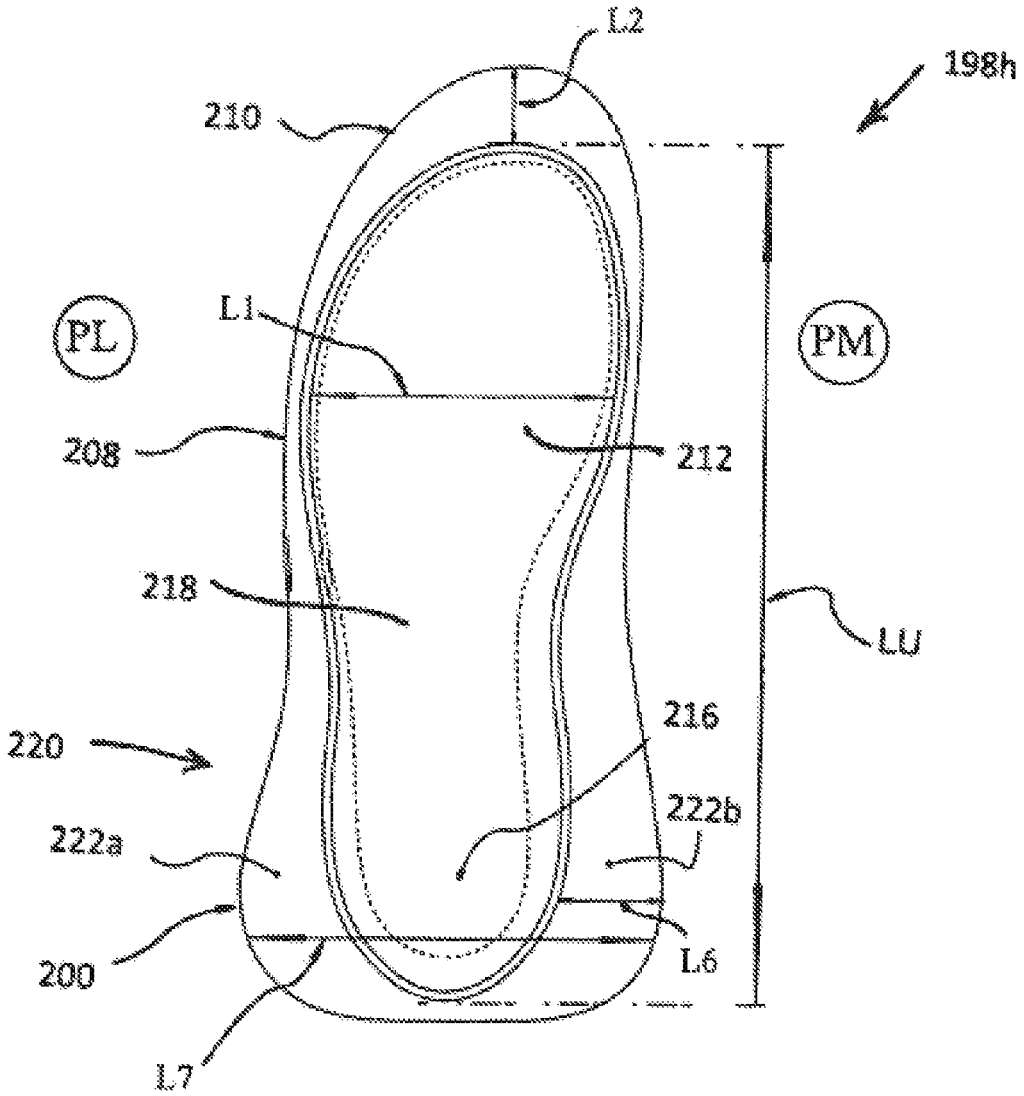
FIG. 28 is a top view of another embodiment of the present footwear having a front stabilizing member and lateral stabilizing members.

Referring to FIG. 28, in another embodiment, a shoe 198*h* includes sole 200 comprising a front stabilizing member 210 and a lateral stabilizing member 220. In the preceding embodiment, due to the support of the front stabilizing member 210, the risk of drift of the force line of the launch and suspension phase increases. The presence of the lateral stabilizing member 220 in this embodiment thereby realigns the rear ground contact during the landing phase and limits the risk of loss of balance and consequently, the risk of injuries.

Referring to FIGS. 17-19, 29 and 30, in a further embodiment, a shoe 198*i* includes sole 200, which has a front stabilizing member 210, as well as a rear peripheral stabilizing member 214 formed from a rear stabilizing member 214 and a lateral stabilizing member 220, to form a full peripheral stabilizing member 226 of the sole 200. The full peripheral stabilizing member 226 provides fluidity of a stride between the propulsion phase and the early landing phase and vice versa. Furthermore, the full peripheral stabilizing member 226 also limits the risk of drift along the preferential ground contact line, i.e., potential risks of drift of the landing phase, due to the propulsion phase, which is increased, and due to the strike phase initiation phase which is also early. In this embodiment, the material(s) of the sole 200 have a Shore D hardness between 30 and 35, but may have any suitable hardness value or combination of hardness values.

Figure 31:
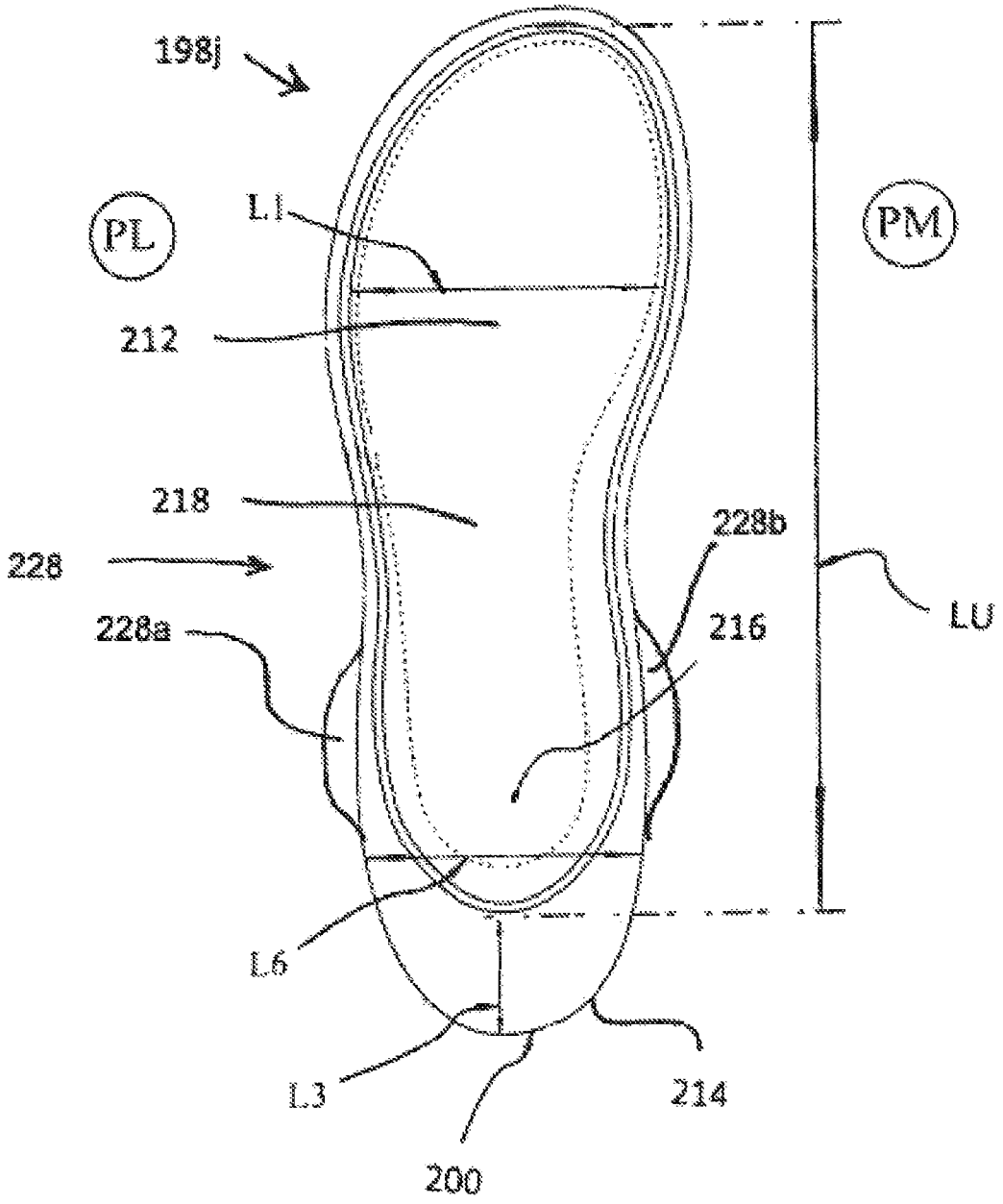
FIG. 31 is a top view of a further embodiment of the present footwear having a lateral stabilizing member having opposing lobes extending outwardly from a rear portion of the sole.

Referring to FIG. 31, in another embodiment, a shoe 198*j* has a sole 200 with a rear stabilizing member 214 and a lateral stabilizing member 228, where the lateral stabilizing member includes protruding lobes 228*a* and 228*b* that extend outwardly from the rear portion of the sole. In an embodiment, the lobes 228*a* and 228*b* are integrally formed with and extend outwardly from the outsole 200 and are separated from the rear stabilizing member. In another embodiment, the shoe only includes the lateral stabilizing member 228 with lobes 228*a* and 228*b* and does not include the rear stabilizing member 214. In each embodiment, the lobes 228*a* and 228*b* provide lateral support and stability to a user while reducing impact forces on the user's feet. It should be appreciated that in each embodiment, the lobes 228*a* and 228*b* have a width, i.e., lateral distance from the upper, that is at least 5% of the length (LU) of the upper.

In an embodiment of the present footwear or shoe, a semi-rigid support plate, such as a carbon plate, is inserted between the midsole and the outsole to provide additional stability and support to a user's foot. The support plate is a generally planar plate that extends along at least a portion of the midsole. Alternatively, the plate may be inserted in or integrally formed with the midsole. The plate may extend along a portion of the midsole and outsole, such as in the heel area, or along the entire length (L) of the shoe. Additionally, the plate may be made out of metal, metal fibers encased by a resin, plastic or any suitable materials or combination of materials.

In another embodiment, a spring plate is inserted between the midsole and the outsole. The spring plate is a generally planar plate that extends under the upper and beyond the rear end of the wall 206 shown in FIG. 18 to provide resilient support in the heel area of the shoe to help absorb the impact force on a user's heel during heel strikes while walking, jogging or running. In another embodiment, the spring plate extends beyond the front end of the wall 206 to provide support during propulsion, i.e., push off force between the forefoot and the ground. It is contemplated that the spring plate may extend along the entire length (L) of the shoe, extend from the front end of the wall 206 to a point beyond the rear end of the wall 206, extend from the rear end of the wall 206 to a point beyond the front end of the wall 206 or extend beyond both the front end and the rear end of the wall 206. In this embodiment, the spring plate is made of a resilient metal, but may be made with plastic or any suitable material or combination of materials.

Figure 32:
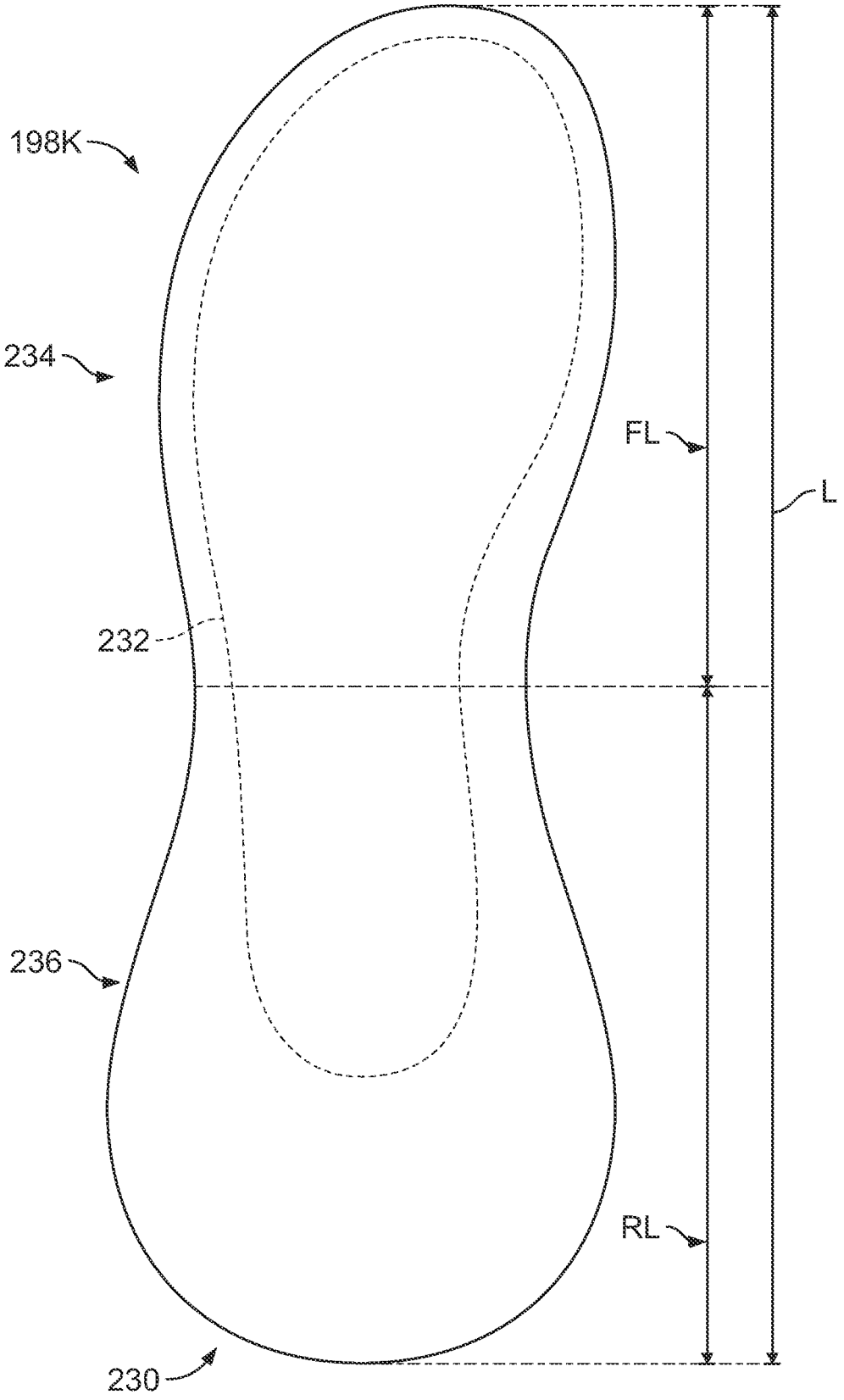
FIG. 32 is a top view of another embodiment of the present footwear having a front portion and a rear portion with different contact surface areas.

Referring to FIG. 32, in another embodiment, a shoe 198*k* includes an upper 232 having a bottom surface and a length, and a sole 230 secured to the bottom surface of the upper 232 and including a midsole and an outsole. As shown, the sole 230 has a front portion 234 with a front contact surface area and a rear portion 236 with a rear contact surface area, where the front portion has a front length (FL) and the rear portion has a rear length (RL) that are equal to each other relative to the overall length of the shoe (L) as shown in the illustrated embodiment. In this embodiment, the rear contact surface area (area of the bottom of the sole that contacts the ground) is equal to or greater than the front contact surface area to provide stability and balance to a user during walking, jogging and running, and to spread or reduce the impact force on a user's heel along the rear contact surface area thereby reducing the impact force on the user's body while enhancing propulsion. It should be appreciated that the length of the front portion 234 may be less than, equal to or greater than the rear portion 236 as long as the rear contact surface area is equal to or greater than the front contact surface area.

Figure 33:
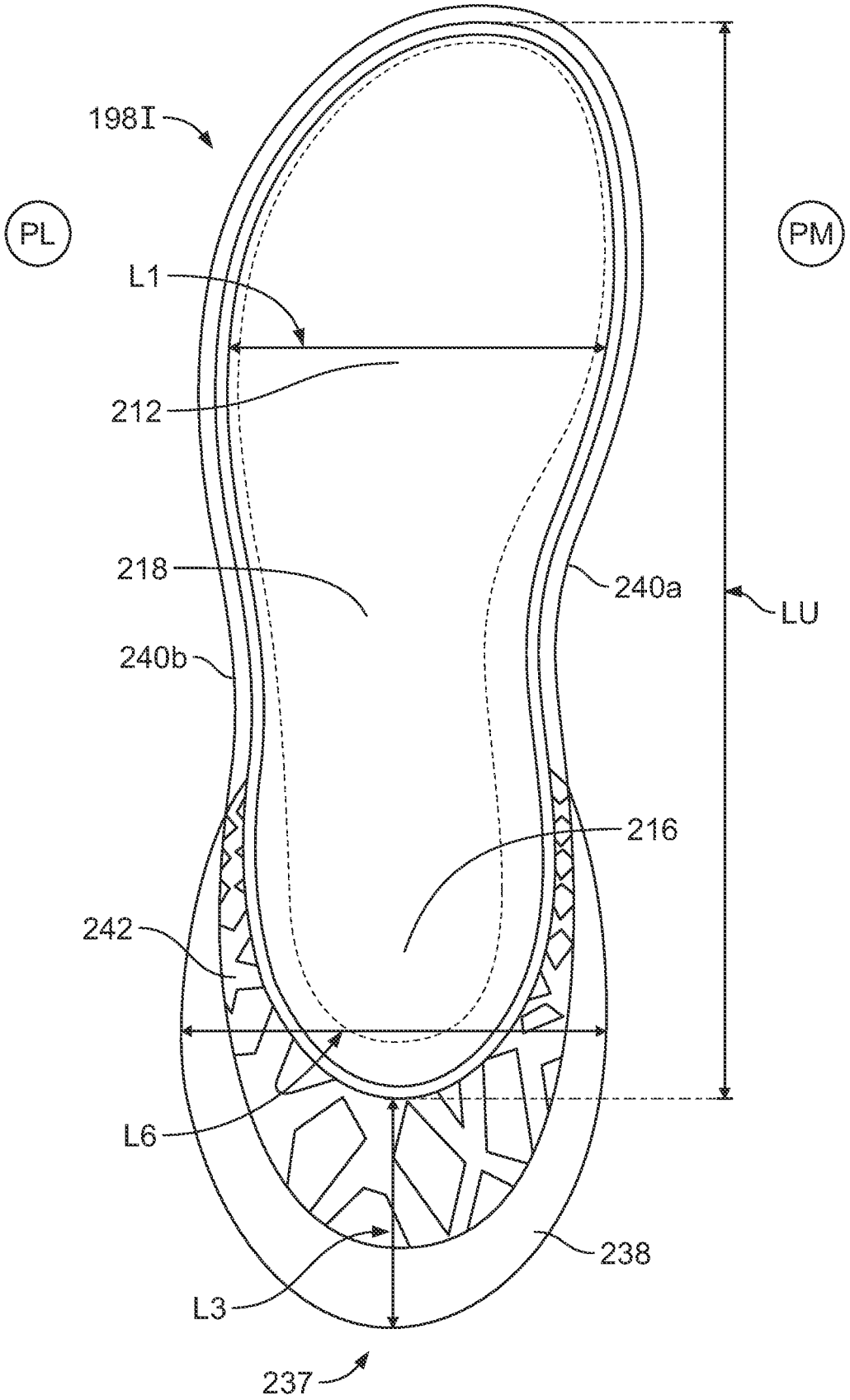
FIG. 33 is a top view of an embodiment of the present footwear including a peripheral stabilizing member connected to the sole by a peripheral support member.
Figure 34:
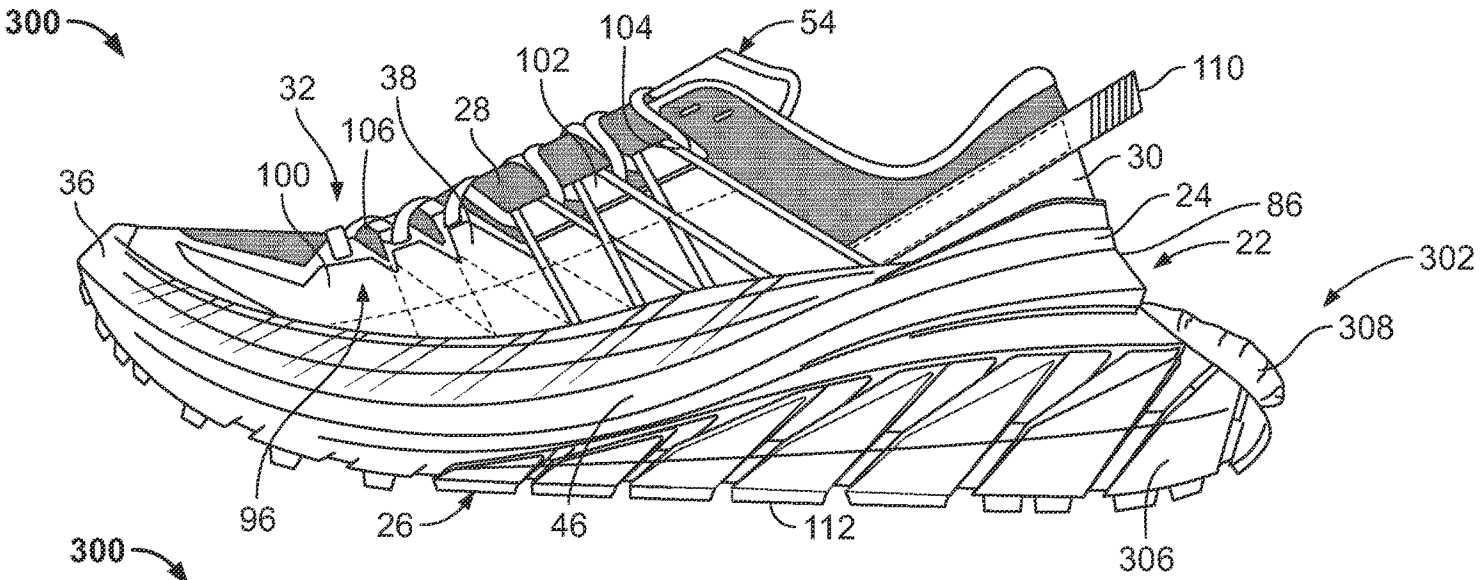
FIG. 34 is a left side view of another embodiment of the present footwear.
Figure 35:
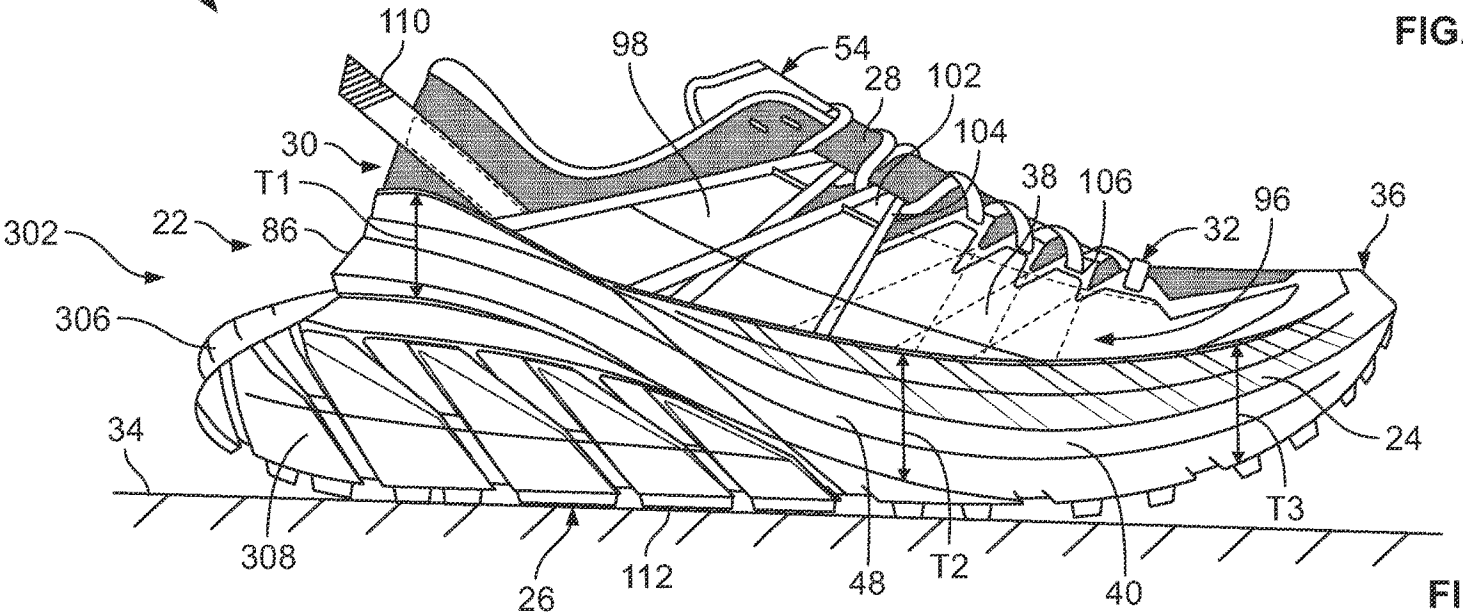
FIG. 35 is a right side view of the footwear of FIG. 34.
Figure 36:
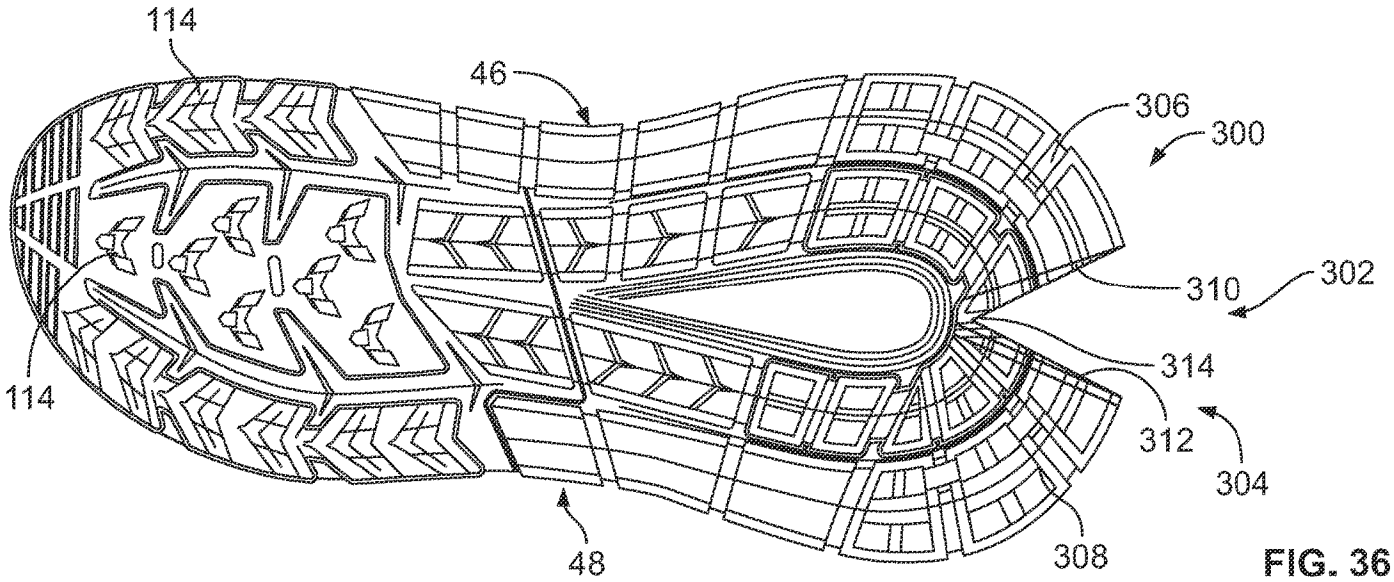
FIG. 36 is a bottom view of the footwear of FIG. 34.
Figure 37:
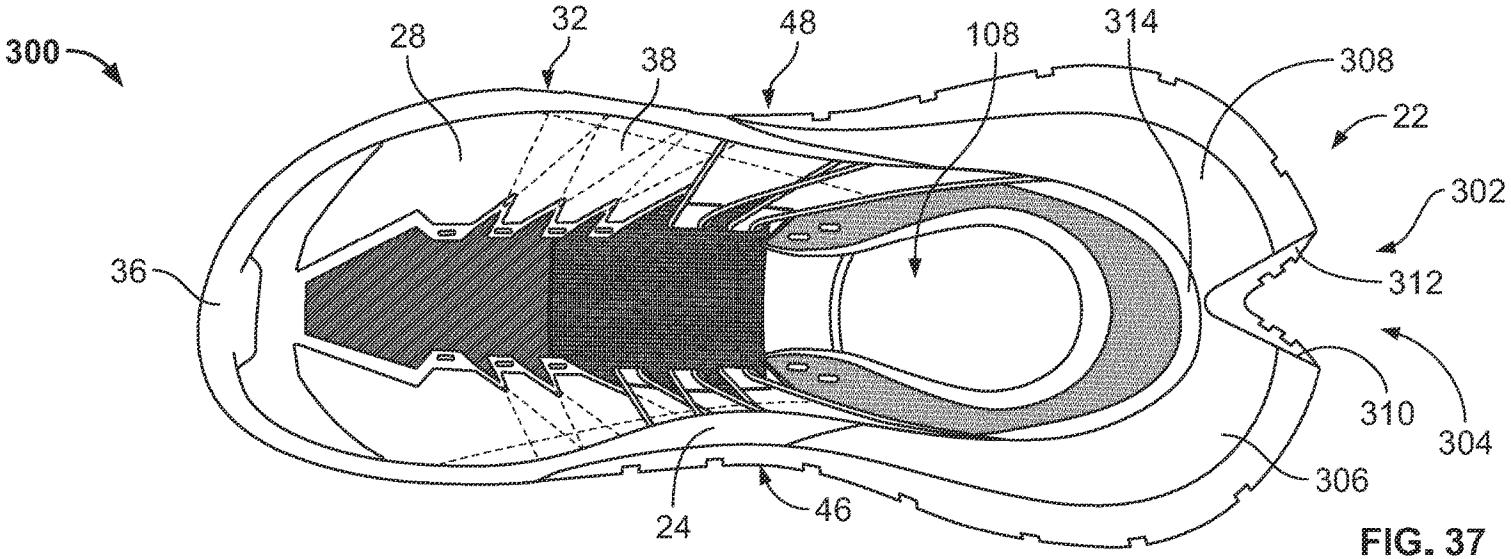
FIG. 37 is a top view of the footwear of FIG. 34 with the tongue and laces removed.
Figure 38:
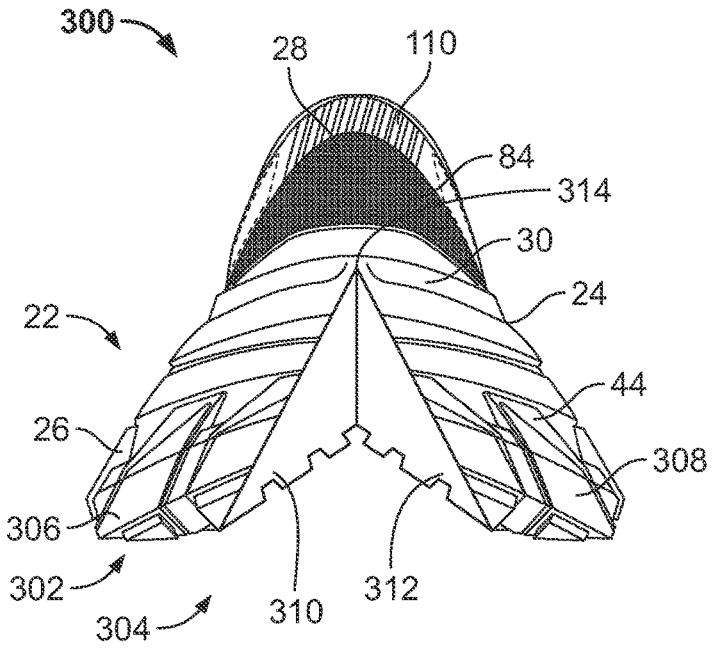
FIG. 38 is a rear view of the footwear of FIG. 34.
Figure 39:
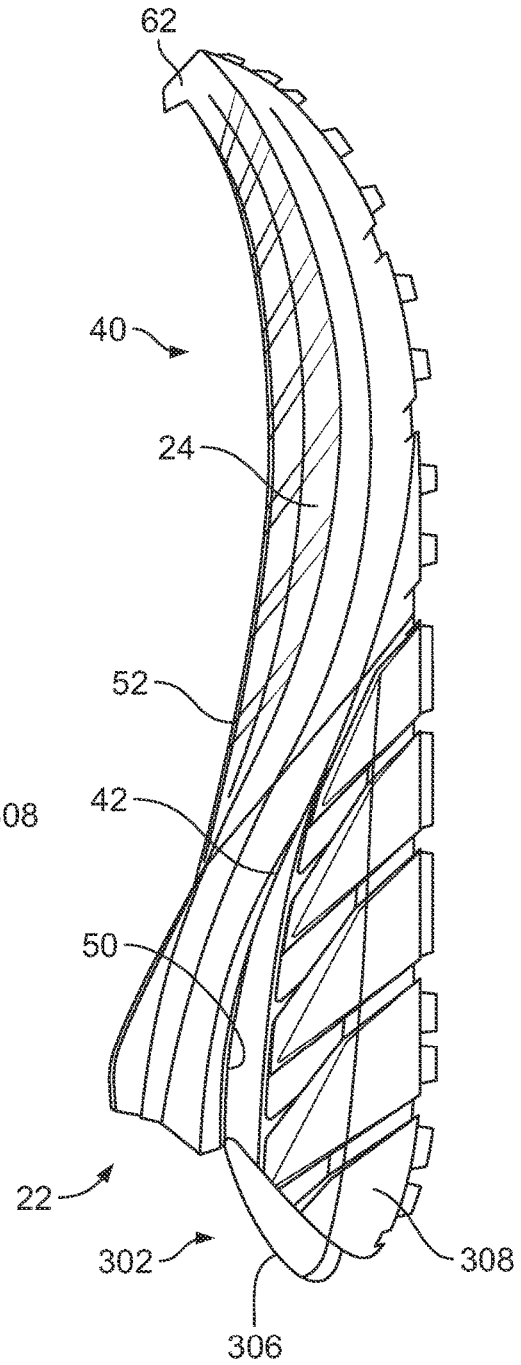
FIG. 39 is a right side view of an embodiment of a sole of the footwear of FIG. 34.
Figure 40:
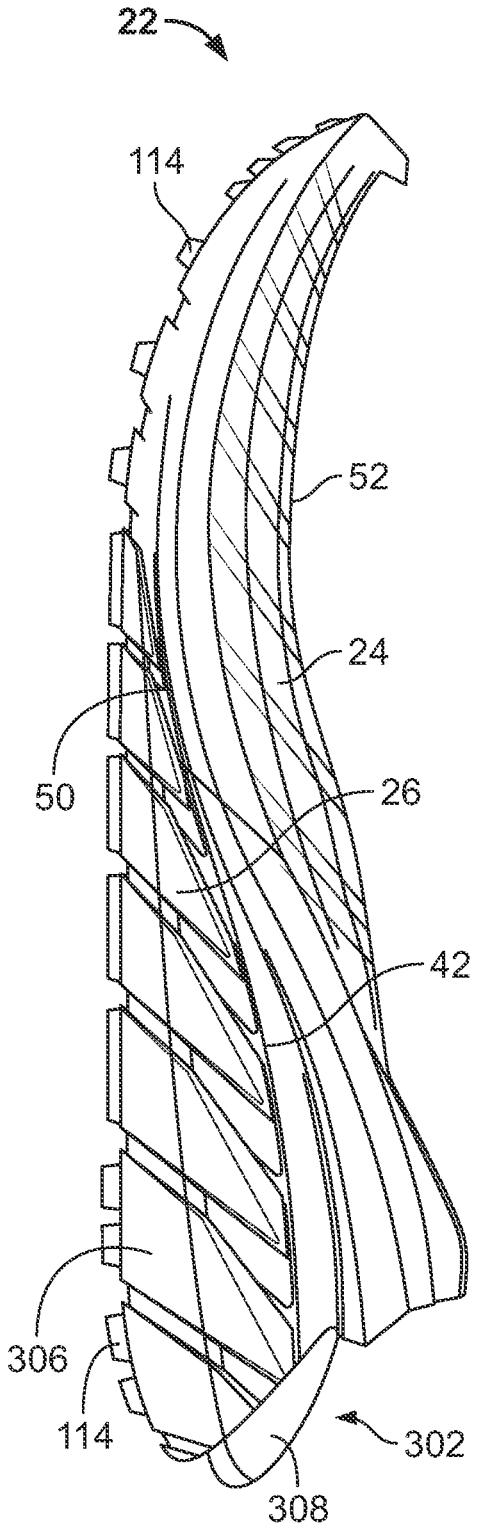
FIG. 40 is left side view of the sole of FIG. 39.
Figure 41:
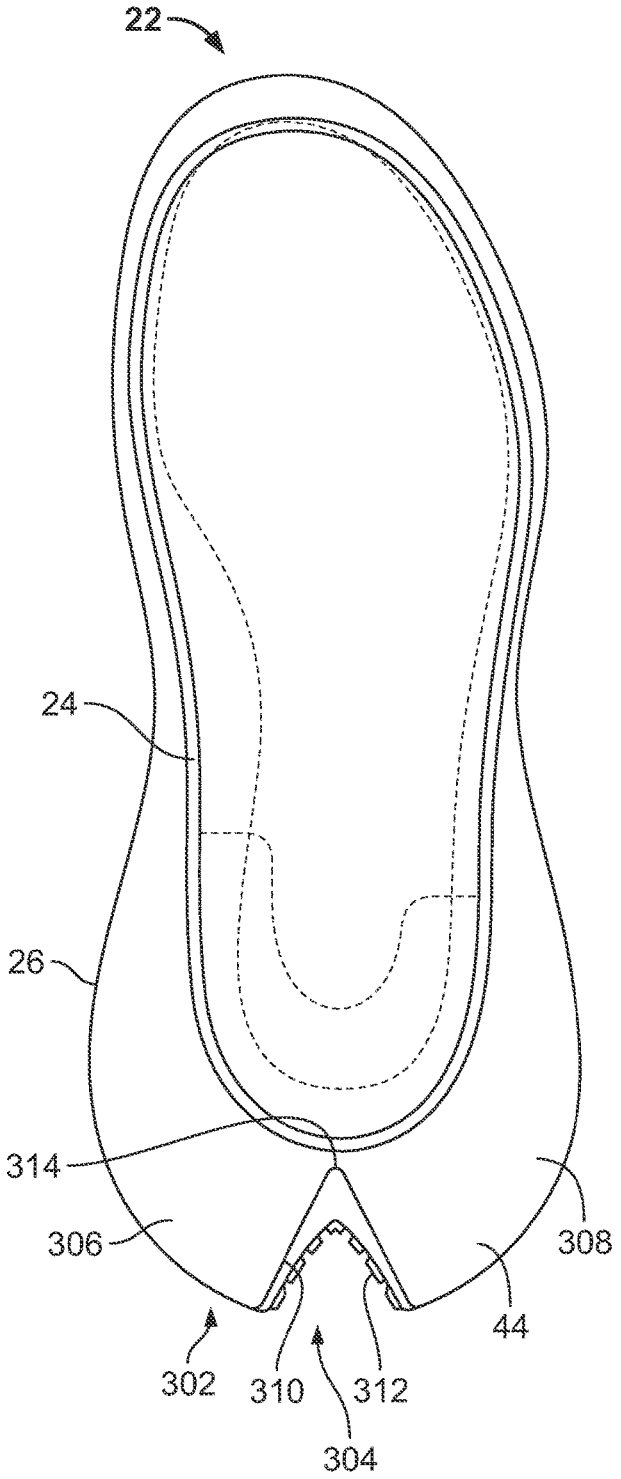
FIG. 41 is a top view of the sole of FIG. 39.
Figure 42:
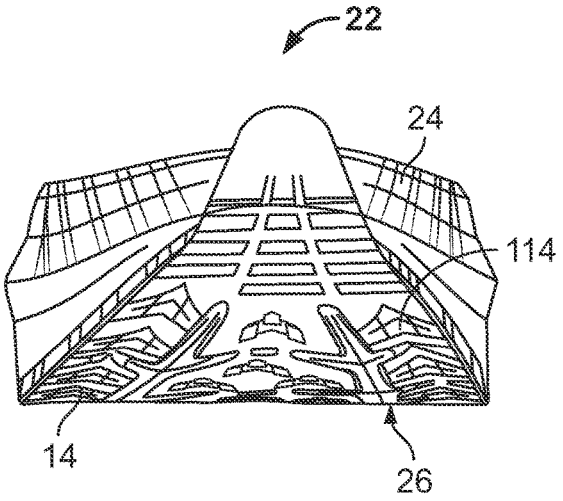
FIG. 42 is a front view of the sole of FIG. 39.
Figure 43:
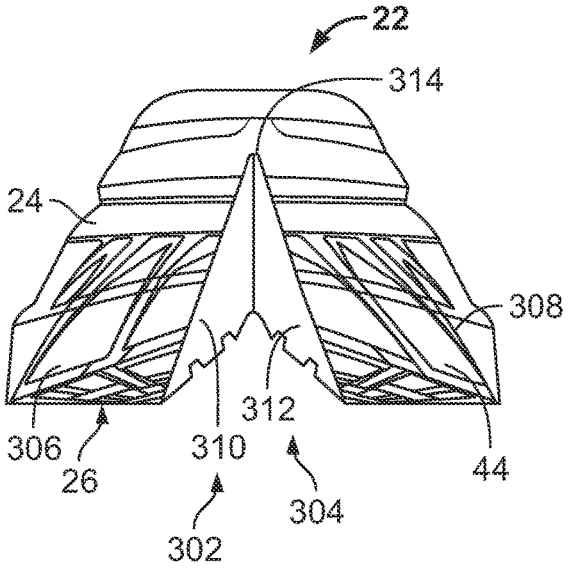
FIG. 43 is a rear view of the sole of FIG. 39.

Referring to FIG. 33, in a further embodiment, a shoe 198*l* includes sole 237 having a midsole and an outsole. A peripheral stabilizing member 238 extends from a medial side 240*a* to a lateral side 240*b* of the sole and is attached to the midsole by a peripheral support member 242. In this embodiment, the peripheral support member 242 is a lattice structure that extends outwardly from the midsole to the peripheral stabilizing member 238 such that the peripheral stabilizing member is not directly connected to the sole 237. This provides a hollow space below the peripheral support member between the sole 237 and the peripheral stabilizing member 238 that allows the support member 242 and the peripheral stabilizing member 238 to flex during use to provide support and balance to a user on different terrains while reducing the impact force on the user's feet. In another embodiment, the peripheral stabilizing member is attached to the outsole by the peripheral support member. It should be appreciated that the peripheral stabilizing member 238 and the peripheral support member 242 may extend about a portion of the peripheral surface of the sole 237 from the medial to lateral sides of the sole or about the entire rear peripheral surface of the sole as shown in FIG. 33. It should also be appreciated that the peripheral support member 242 may be a lattice structure, a solid structure or any suitable structure that attaches the peripheral stabilizing member to the sole 237.

Furthermore, in the above embodiments, the front stabilizing member, the lateral stabilizing member including the opposing lobes, and the rear stabilizing member may be made out of the same material or different materials. Similarly, the front stabilizing member, the lateral stabilizing member and rear stabilizing member may be made of materials having the same hardness value or different hardness values. For example, one or more of the front stabilizing member, the lateral stabilizing member and rear stabilizing member may have the same hardness value or different hardness values.

Referring to FIGS. 34-47, another embodiment of the present article of footwear or shoe, generally indicated as 300, includes a sole having a midsole 24 and an outsole 26, and an upper 28 attached to the sole. It should be appreciated that the shoe components in this embodiment are described above and have the same reference numbers. In this embodiment, the sole, and more specifically, the rear stabilizing member 302 of the sole, includes a v-shaped groove or cutout 304, extending from the midsole 24 and through the entire outsole 26. The v-shaped groove 304 separates the rear stabilizing member 302 into a medial balancing member 306 and a lateral balancing member 308. In this embodiment, the groove has a v-shape, but it is contemplated that the groove may be have a v-shape, u-shape or any suitable shape. In the illustrated embodiment, the inner surfaces 310, 312 respectively of the medial balancing member 306 and the lateral balancing member 308 forming the v-shaped groove 304 are each substantially flat surfaces. It should be appreciated that the groove 304 between the medial balancing member 306 and the lateral balancing member 308 may have any suitable shape, such as a v-shape, u-shape or other shape. Further, the inner surfaces 310, 312 of the medial and lateral balancing members 306, 308 may be flat (as shown), curved outwardly, curved inwardly or have any suitable shape or configuration. The rear end or rear edge 314 of the groove 304, i.e., the end or edge of the groove closest to the upper 28, may be directly adjacent to the upper 28 or at any suitable distance from the upper. For example, in the illustrated embodiment, the rear edge 314 of the groove 304 is 2.0 cm from the upper 28.

The groove 304 in the rear stabilizing member 302 enables the medial and lateral balancing members 306, 308 to move independently of each other and flex outwardly upon impact on an underlying surface 34 to provide enhanced support, balance and stability to a user's foot and help with turning and banking during movement, such as while walking, hiking, jogging or running. For example, when the shoe 300 impacts an underlying surface on the medial side 46 of the shoe, the medial balancing member 306 flexes outwardly away from the lateral balancing member 308 to provide more stability and balance on the medial side of the shoe. Similarly, when the shoe 300 impacts an underlying surface on the lateral side 48 of the shoe, the lateral balancing member 308 flexes outwardly away from the medial balancing member 306 to provide more stability and balance on the lateral side of the shoe. A central impact between the heel 30 of the shoe 300 and an underlying surface, causes both the medial and lateral balancing members 306, 308 to flex outwardly to provide more stability on the underlying surface. In this way, the shoe 300 provides enhanced support, suspension and stability on different terrains. The groove 304 also reduces the weight of the rear stabilizing member 302 and thereby the weight of the shoe 300 to help reduce stress and fatigue on a user's feet and legs. In this embodiment, the medial and lateral balancing members 306, 308 may be made of the same material or different materials. For example, the medial and lateral stabilizing members 306, 308 may be made with materials having different hardness values to provide more stability and balance or more shock absorption on the medial or lateral sides of the shoe 300. Furthermore, the medial and lateral balancing members 306, 308 may have different hardnesses to enhance propulsion during movement. It should be appreciated that the medial and lateral balancing members 306, 308 may be made of materials having the same hardness, different hardnesses or portions having different hardnesses.

Figure 44:
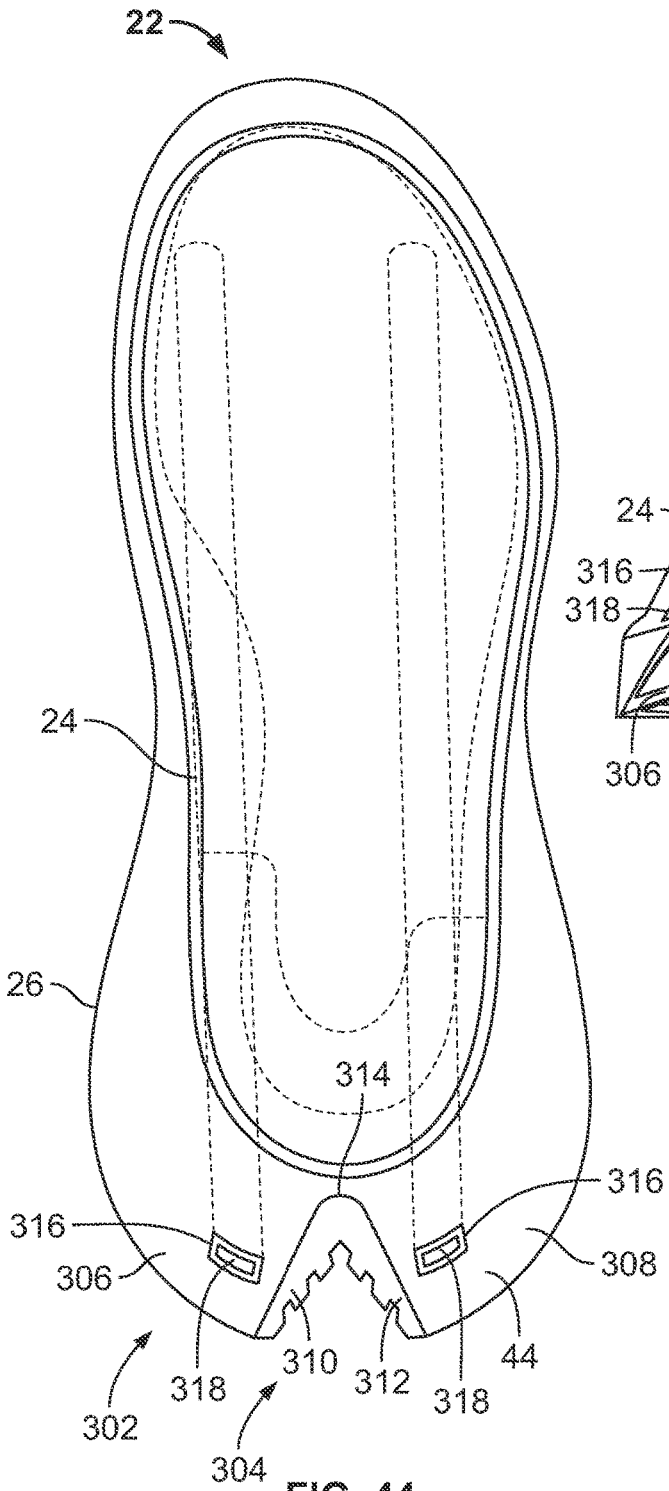
FIG. 44 is a top view of the embodiment of the sole of FIG. 39 where the stabilizing member includes slots extending along the length of the shoe.
Figure 45:
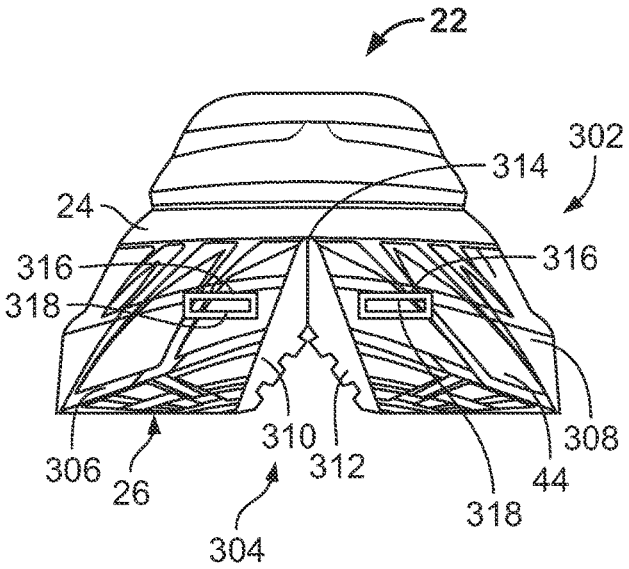
FIG. 45 is a rear view of the sole of FIG. 44.
Figure 46:
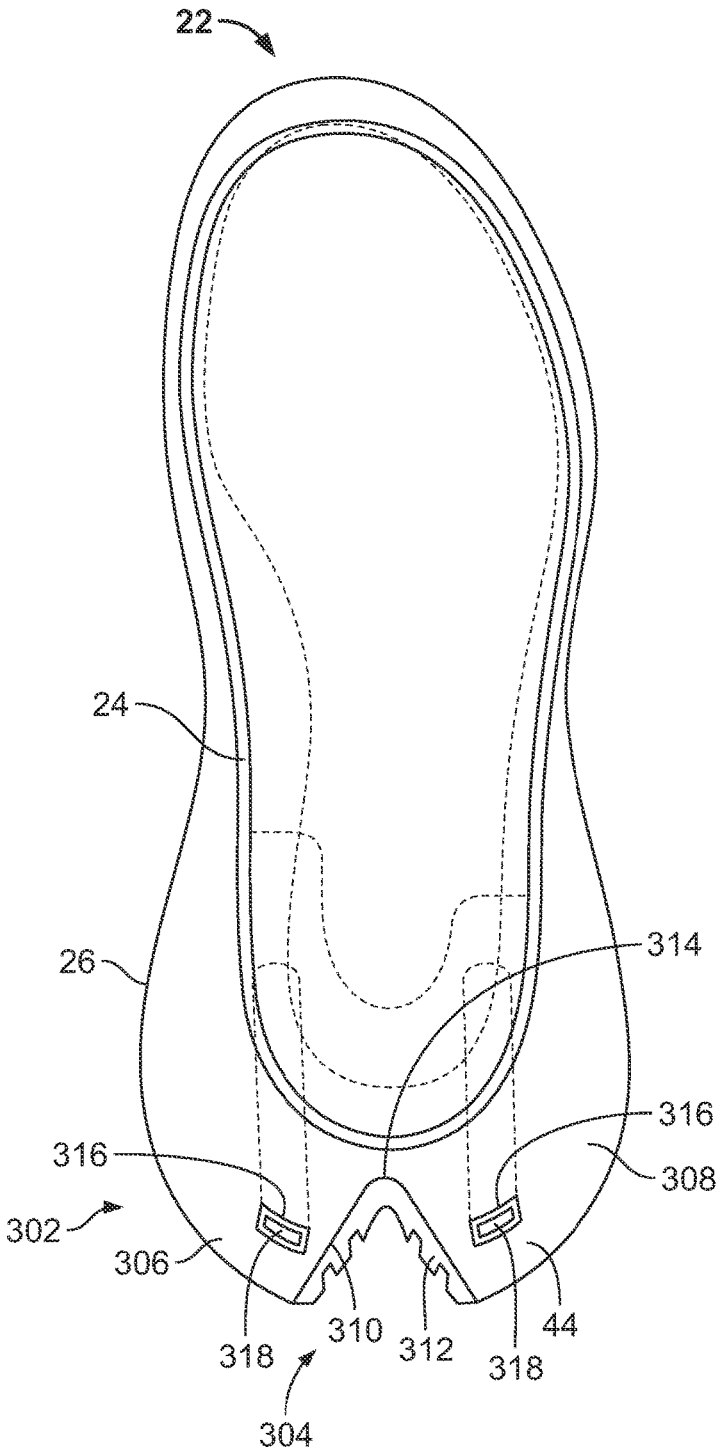
FIG. 46 is a top view of another embodiment of the sole of FIG. 39 where the stabilizing member includes slots extending within the medial and lateral balancing members.

Referring to FIGS. 44-47, in a further embodiment, the medial and lateral balancing members 306, 308 of the rear stabilizing member 302 include elongated slots 316 that extend from the end of the rear stabilizing member 302 to the front of the sole, i.e., front of the shoe 300. The slots 316 are each configured to receive an elongated plate 318 having a designated width, length and thickness. The plates 318 may be carbon plates or made with any suitable material or combination of materials. Further, in an embodiment, the plate 318 inserted in the slot 316 associated with medial balancing member 306 is different from the plate 318 inserted in the slot 316 associated with the lateral balancing member 308. In this regard, the plates 318 may differ in size, shape, length, thickness, hardness or any combination of these properties. In one embodiment, each plate 318 varies in hardness along the length of the plate. For example, different portions of the plates 318 may have a greater hardness than other portions of the plates to provide more stability at designated locations of the shoe, such as in the heel area 30 or in the arch on the medial side 46. Also, the plates 318 may have different lengths. For example, the plates 318 may extend the length of the shoe 300 as shown in FIG. 44 or extend only within the medial and lateral balancing members 306, 308 as shown in FIG. 46. It should be appreciated that the plates 318 may be the same length or different lengths and may also be any suitable length.

Figure 47:
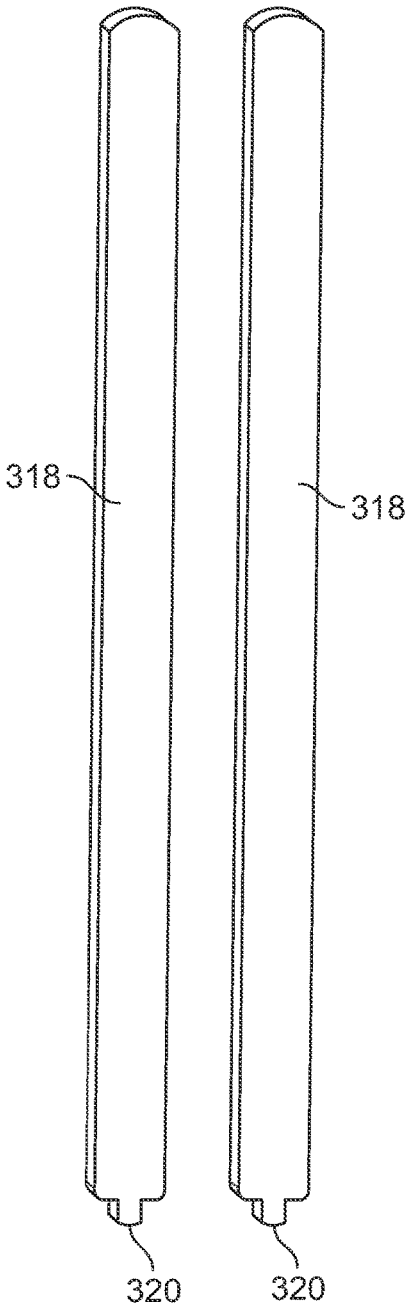
FIG. 47 is an embodiment of plates inserted in the slots shown in FIG. 44.

In the above embodiment, the plates 318 may be molded in the sole during manufacturing of the shoe 300, such that the plates are not removable from the sole. In another embodiment, the plates 318 are removable from the slots 316 formed in the medial and lateral balancing members 306, 308 so that a user may replace the plates with different plates, such as plates with a lesser or greater hardness, or replace broken or damaged plates. In this embodiment, the plates 318 include a gripping member 320 at the ends of the plates so that a user can easily grab and pull the plates out of the slots 316 and also insert and push the plates 318 into the slots 316. In these embodiments, that plates 318 may have a symmetrical shape as shown in FIG. 47, or have an asymmetrical shape such as a curved shape. It should be appreciated that the plates 318 may have any suitable shape.

In another embodiment, the slots 316 formed in the sole are in a different plane or at positioned at a different angle relative to each other within the sole or in a different plane and at a different angle relative to each other. For example, one of the slots 316 may be a greater distance above the underlying surface than the other slot 316. Alternatively, one of the slots 316 may be at an angle of 25 degrees relative to the bottom surface of the upper and the other slot may be at an angle of 60 degrees relative to the bottom surface of the upper. In this way, the plates 318 may be in different planes in the sole and/or positioned at different angles relative to the bottom surface of the upper to adjust the support, balance, stability and propulsion of the shoe. It should be appreciated that the slots 316, and thereby the plates 318, may be at any suitable plane and at any suitable angle within the sole.

Figure 48:
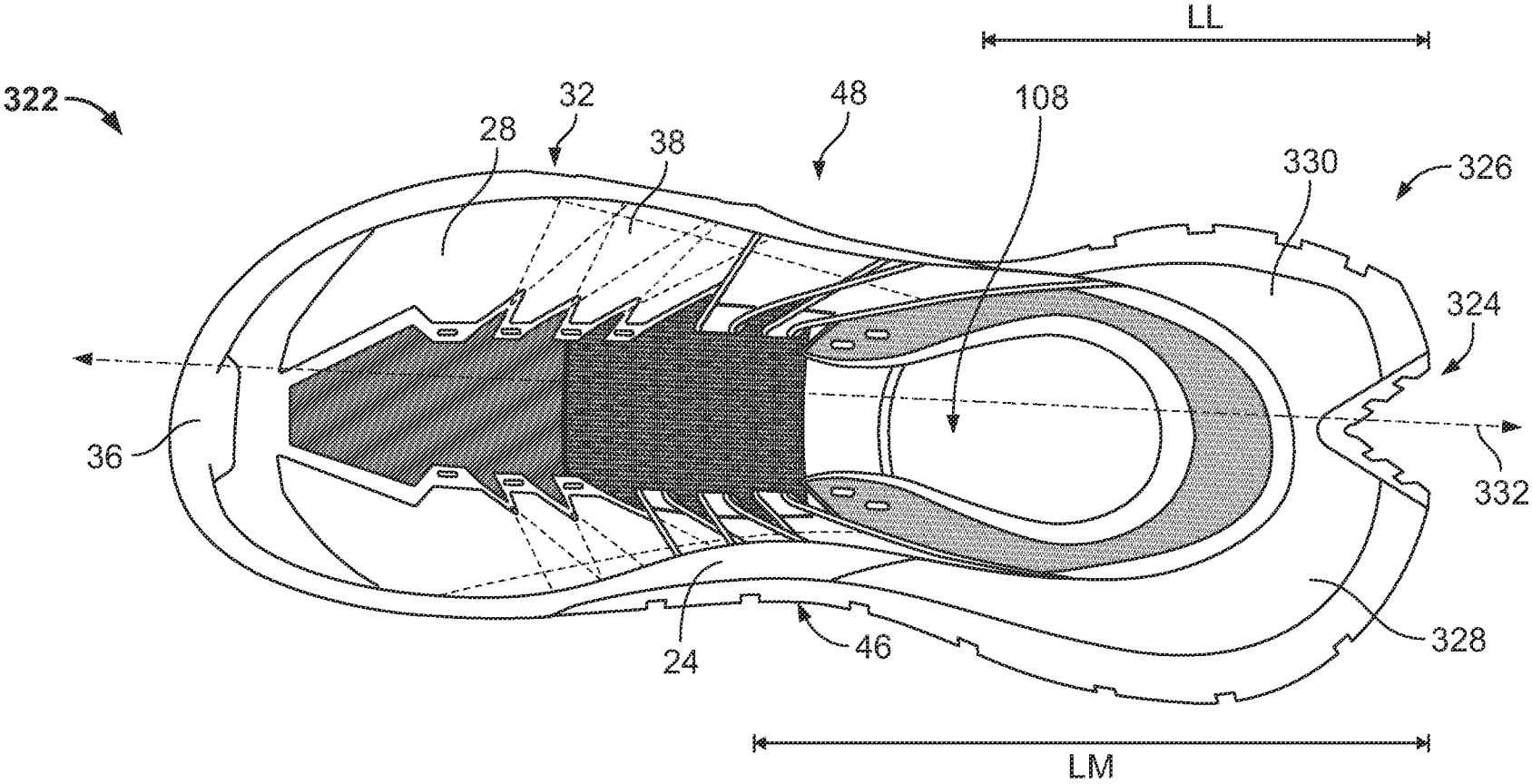
FIG. 48 is a top view of another embodiment of the present footwear.

Referring to FIG. 48, another embodiment of the present article of footwear or shoe, generally referred to as reference number 322, is shown and includes a groove 324 formed in the stabilizing member 326 of the sole that separates the stabilizing member into a medial balancing member 328 and a lateral balancing member 330 as described in the above embodiments. In this embodiment, the medial and lateral balancing members 328, 330 are asymmetrical relative to a longitudinal axis 332 extending through the center portion of the shoe 322. More specifically, the medial balancing member 328 has a length LM that is greater than a length LL of the lateral balancing member 330. It should be appreciated that the medial and lateral balancing members 328, 330 may be symmetrical or asymmetrical in length, width, thickness or any combination of these parameters. In this way, the medial and lateral balancing members may be adjusted or tuned to enhance balance, stability, support, propulsion or other desired performance characteristics of the shoe.

Figure 49:
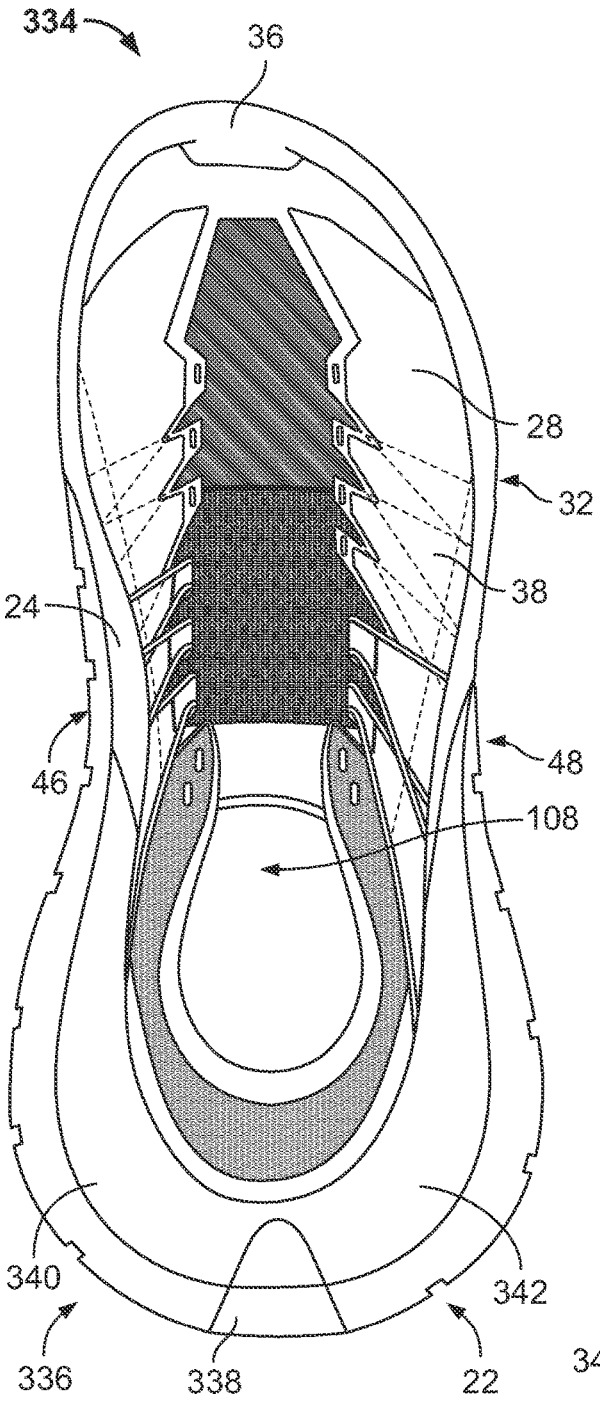
FIG. 49 is a top view of a further embodiment of the present footwear.
Figure 50:
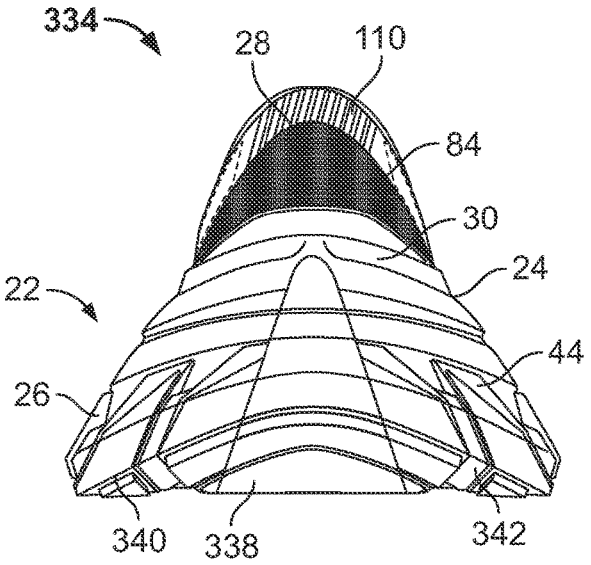
FIG. 50 is a rear view of the footwear shown in FIG. 49.
Figure 51:
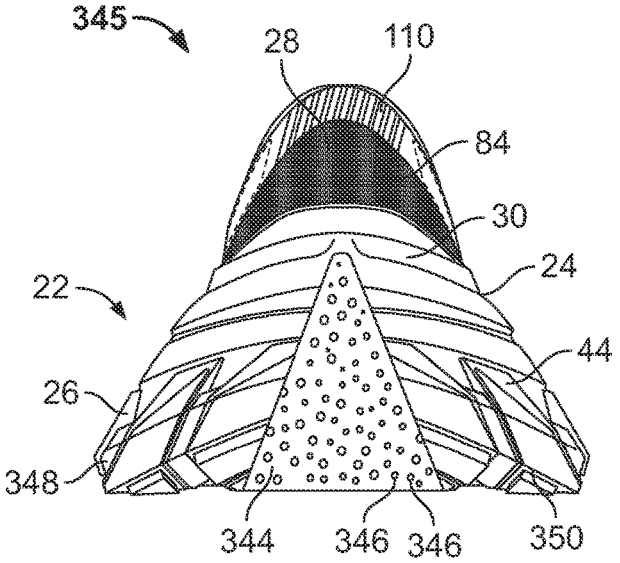
FIG. 51 is a rear view of another embodiment of the footwear of FIG. 49 in which the separating portion includes perforations.

Referring now to FIGS. 49-51, another embodiment of the present shoe is shown where the shoe 334 includes a stabilizing member 336 having a separating portion 338 instead of a groove, where the separating portion 338 is made of a material that is different than the material of the stabilizing member. Specifically, in this embodiment, the separating portion 338 is made of a material that is softer than the material of the stabilizing member 336, to form the medial and lateral balancing members 340, 342. Forming the separating portion 338 with a softer material, enables the separating portion to flex and move to allow the medial and lateral stabilizing members 340, 342 to move independently of each other as described above. In another embodiment shown in FIG. 51, the separating portion 344 of shoe 345 is made of a perforated material having several holes 346 that enable the separating portion, and thereby the medial and lateral balancing members 348, 350, to flex and move in a similar way to the softer material. It should be appreciated that the separating portion may be made out of any suitable material or combination of materials.

Figure 52:
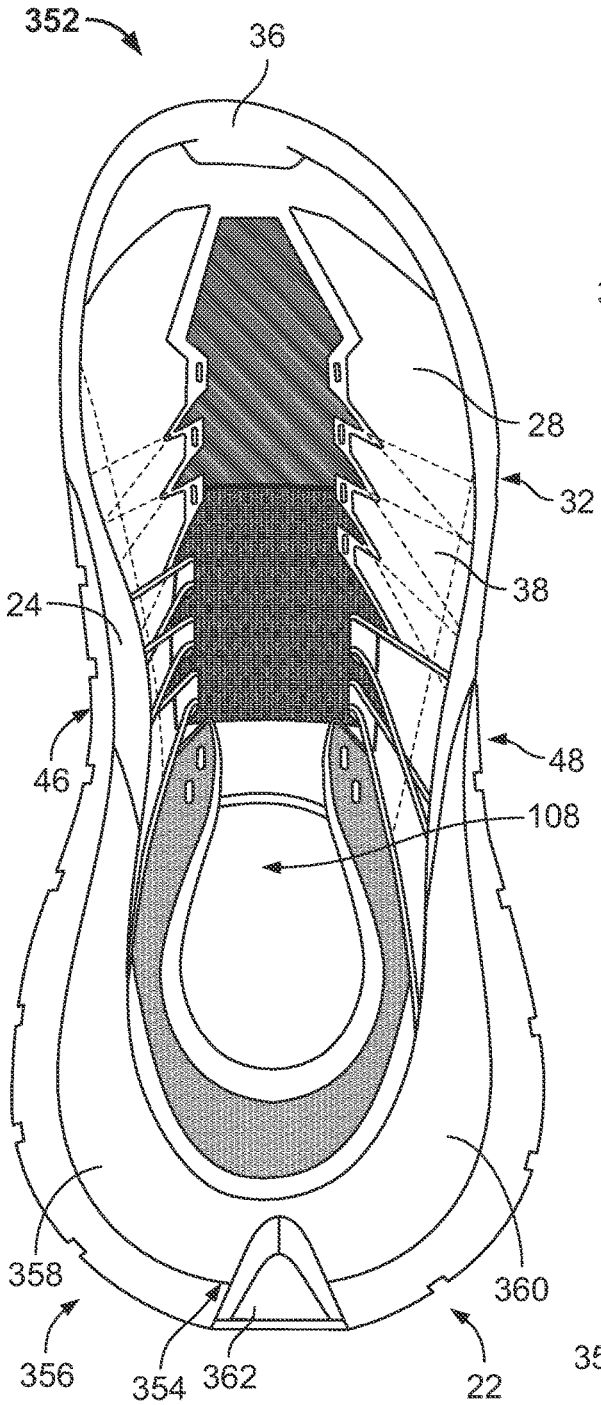
FIG. 52 is a top view of a further embodiment of the present footwear in which the sole includes a partial groove.
Figure 53:
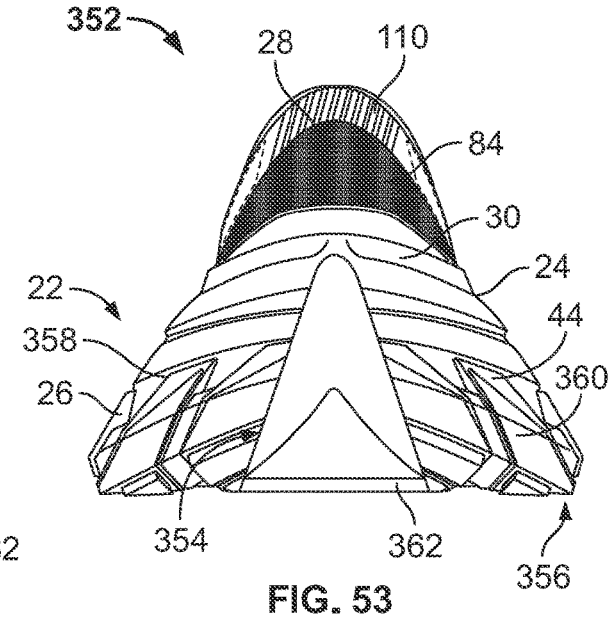
FIG. 53 is a rear view of the footwear shown in FIG. 52.
Figure 54:
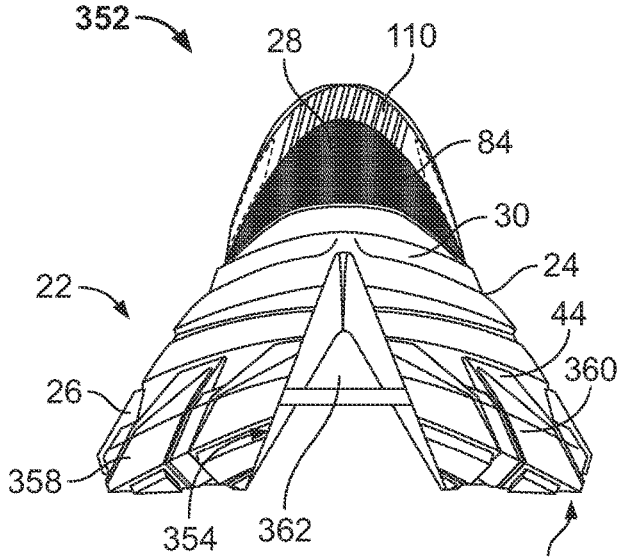
FIG. 54 is a rear view of another embodiment of the footwear shown in FIG. 52 in which a platform is positioned at an intermediate position in the groove in the sole.

Referring to FIGS. 52-54, a further embodiment of the present shoe is shown where the shoe 352 includes a groove 354 having different depths. For example, the groove 354 in stabilizing member 356 in FIG. 52 forms medial and lateral balancing members 358, 360 where the groove 354 does not extend completely through the sole. Instead, a platform 362 is located at the bottom of the groove and extends between the medial and lateral stabilizing members. In this embodiment, an upper surface of the platform 362 is substantially flat. It should be appreciated that the upper surface of the platform 362 may flat or angled, and may have any suitable thickness. Additionally, the platform 362 may be positioned at any distance or height above the underlying surface as shown in FIG. 54. It should be appreciated that the platform 362 may be at the top end of the groove 354 such that the groove extends from the bottom surface of the platform 362, through the sole and is open to the underlying surface, or at any suitable position in the groove. It should also be appreciated that a plurality of platforms by be positioned within the groove 354 and extend between the medial and lateral balancing members. In this embodiment, the platforms may be separated from each other or be positioned directly adjacent to each other, and two or more of the platforms may be made of the same material or different materials.

Figure 55A:
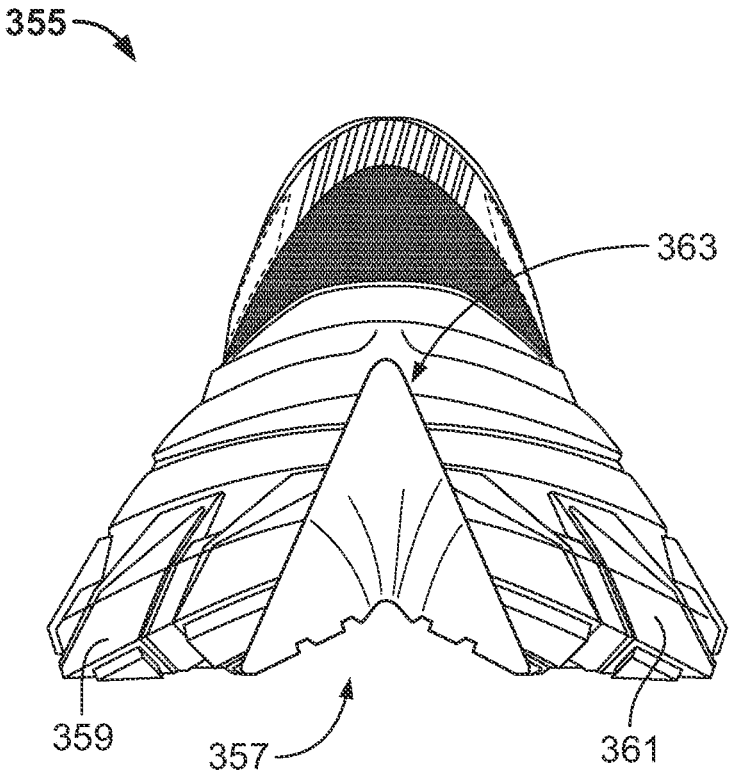
FIG. 55A is a rear view of a further embodiment of the present footwear in which the sole includes material between the medial and lateral balancing members that forms a bottom groove where the material gradually increases in thickness toward the upper.

Referring to FIG. 55A, in a further embodiment, a shoe 355 is shown and includes a groove 357 formed by the medial and lateral balancing members 359 and 361. As shown in the illustrated embodiment, the groove 357 is located at a bottom end of the medial and lateral balancing members 359 and 361 and the portions of the medial and lateral balancing members forming the groove gradually increase in thickness toward the upper such that the top end 363 is primarily filled with material between the medial and lateral balancing members. It should be appreciated that the groove may be formed in any suitable portion of the rear stabilizing member and that thicknesses of the medial and lateral balancing members 359, 361 may be any suitable thickness. It should also be appreciated that the material between the medial and lateral balancing members 359, 361 may be the same material as the medial and lateral balancing members or a different material.

Figure 55B:
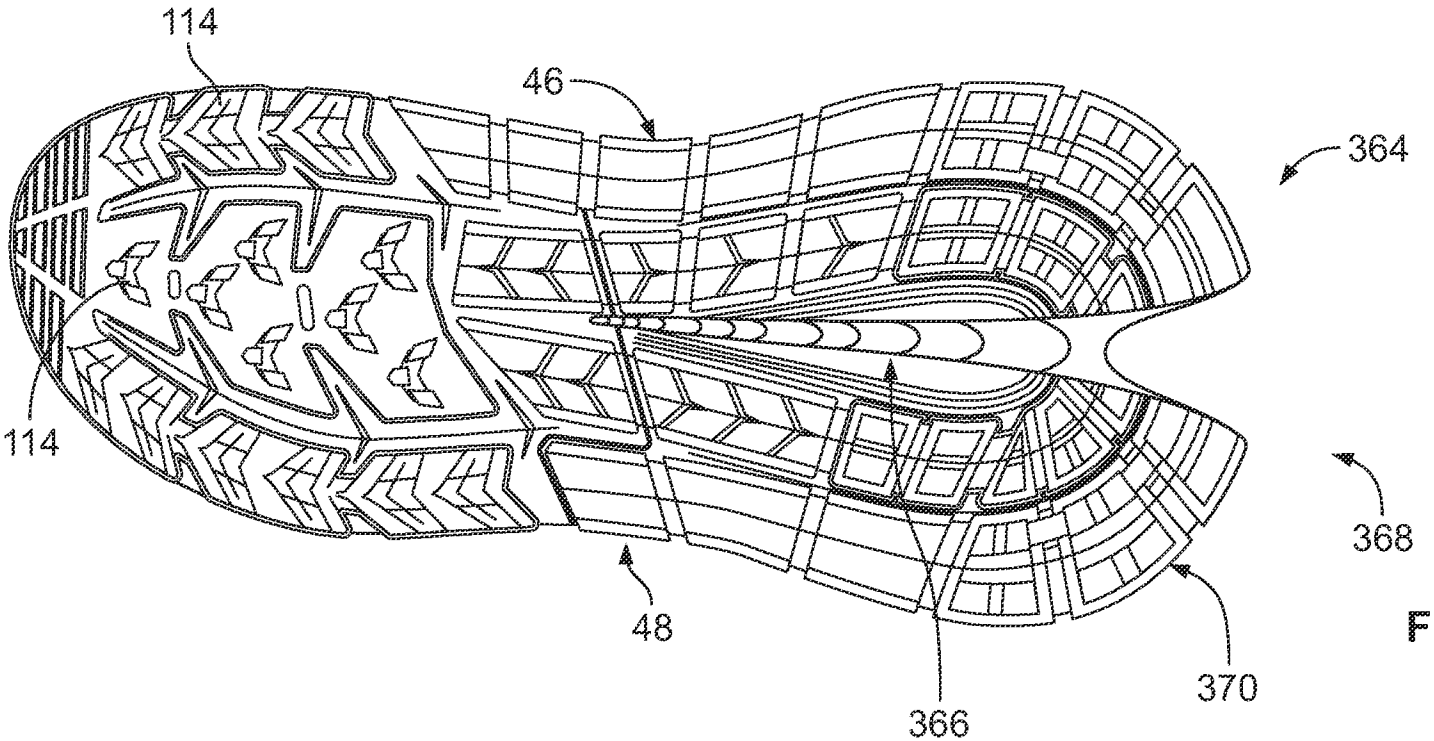
FIG. 55B is a bottom view of another embodiment of the present footwear in which the sole includes an elongated channel leading to a groove in the sole.

Referring to FIG. 55B, in another embodiment, a shoe 364 is shown and includes an elongated channel 366 formed in the bottom of the sole that extends from the midfoot portion of the shoe to a groove 368 formed in the stabilizing member 370. In this embodiment, the depth of the channel 366 gradually increases until reaching the groove 368. It should be appreciated that the channel may extend from any portion of the shoe including the front end or the forefoot portion of the shoe. Further, the channel 366 may have any suitable length, width and/or depth.

Figure 56:
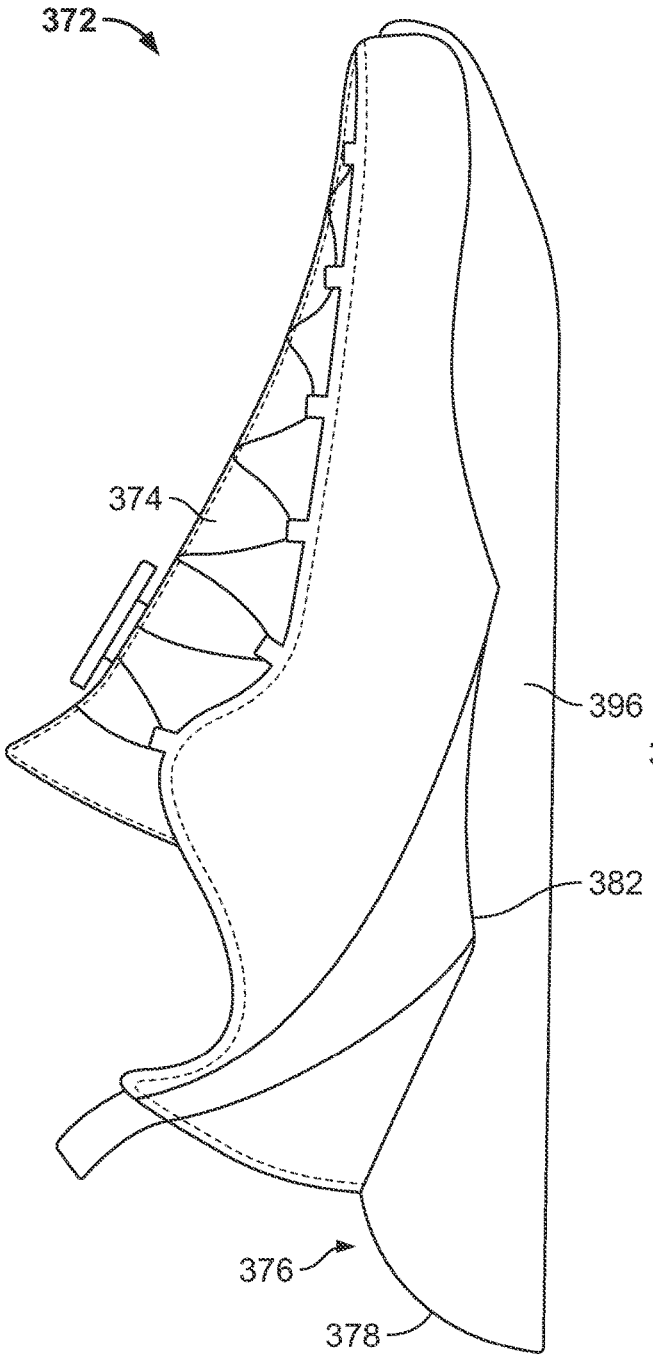
FIG. 56 is a side view of another embodiment of the present footwear including a support plate forming a space between the upper and the sole.
Figure 57:
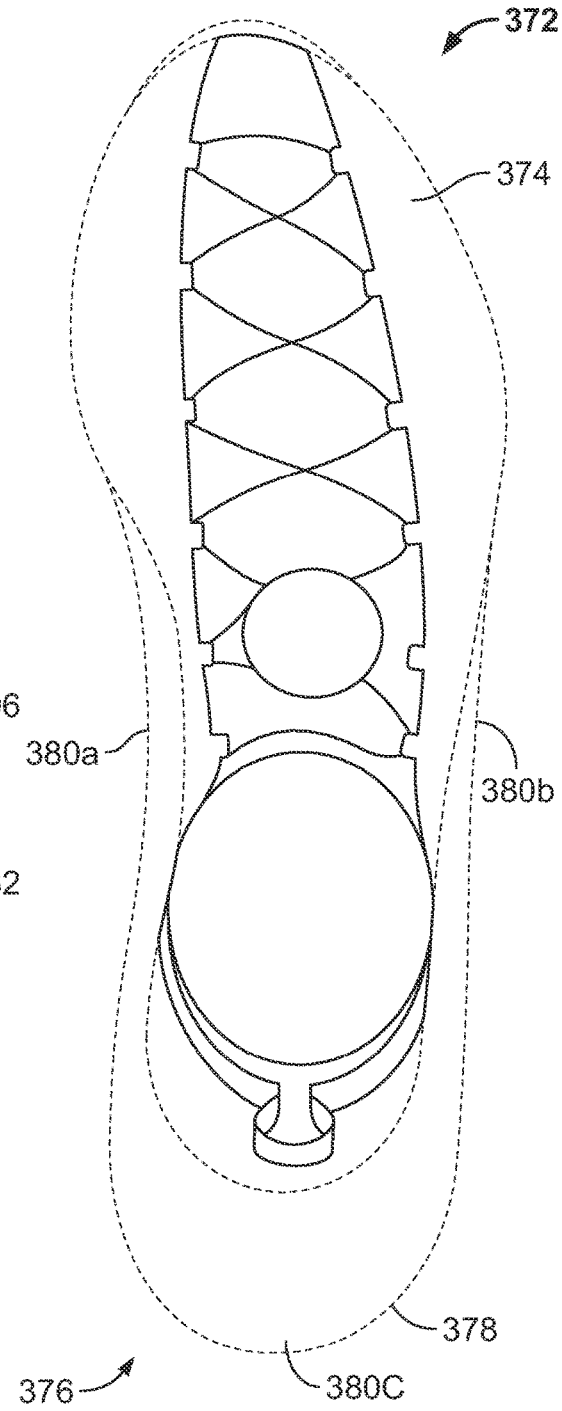
FIG. 57 is a top view of the footwear shown in FIG. 56.
Figure 58:
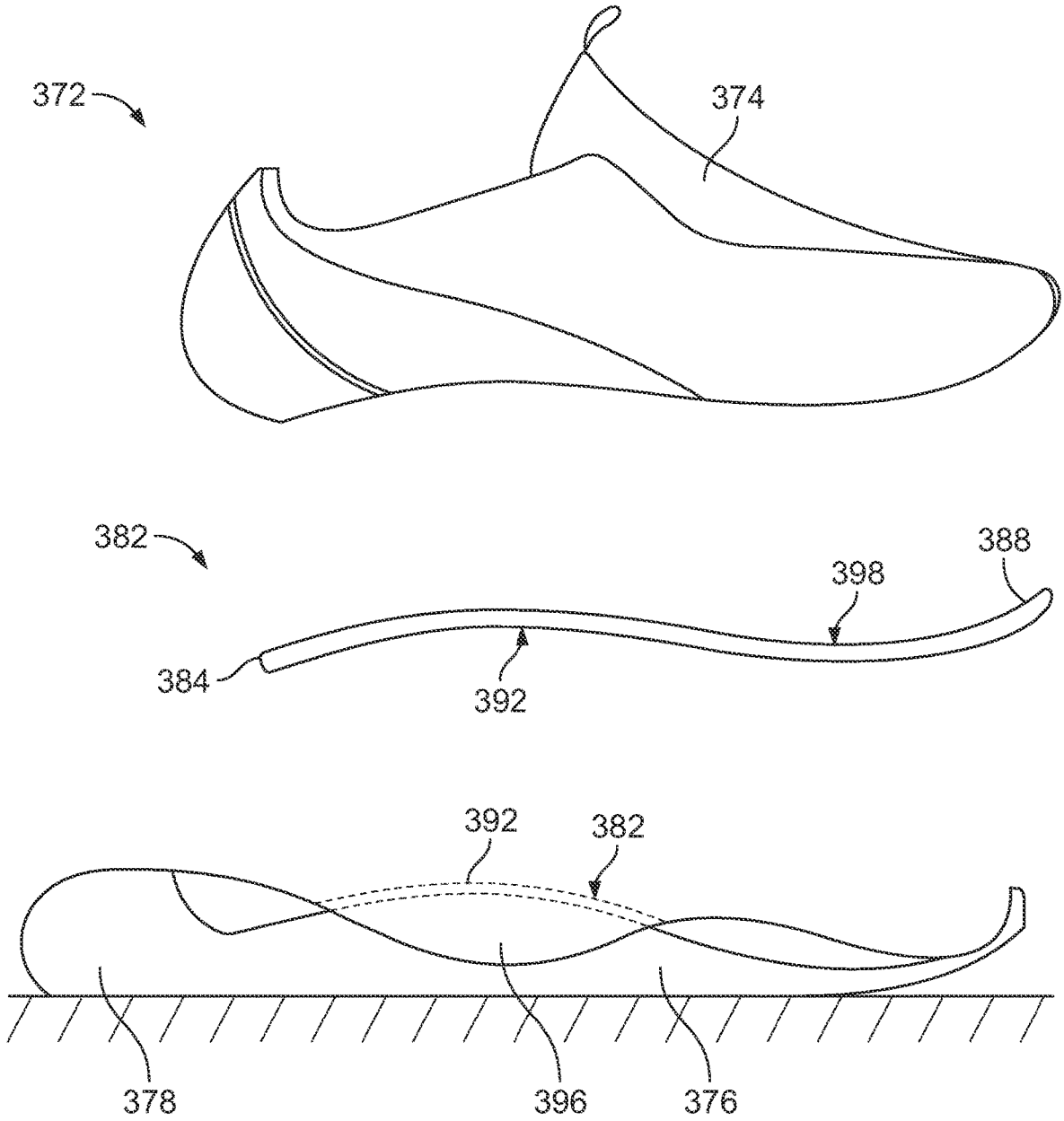
FIG. 58 is an exploded side view of the footwear shown in FIG. 56.
Figure 59:
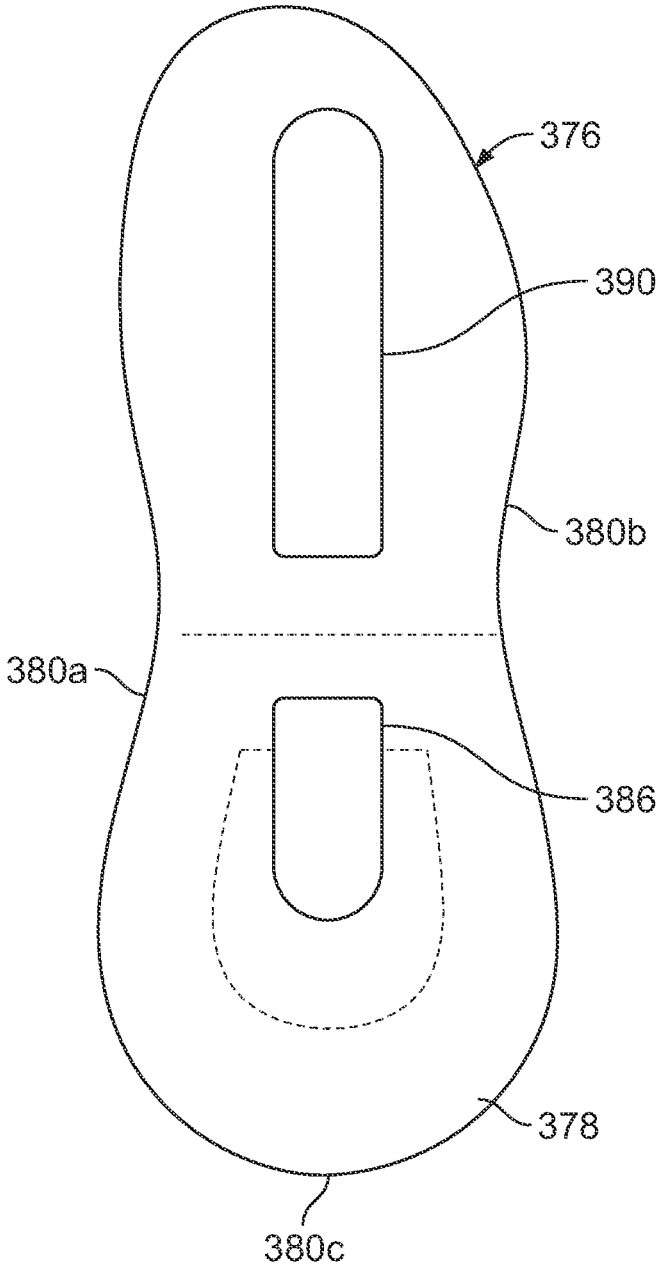
FIG. 59 is a top view of an embodiment of the sole of the footwear of FIG. 56 where the sole includes recessed areas for receiving the support plate.
Figure 60:
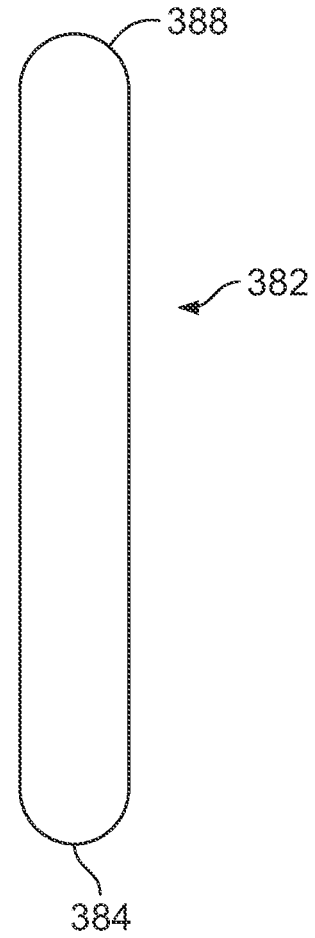
FIG. 60 is a top view of the support plate shown in FIGS. 56 and 58.

Referring now to FIGS. 56-60, in a further embodiment, a shoe generally referred to as reference number 372 is shown, and includes an upper 374 and a sole 376, which may be comprised of a midsole and an outsole, or just an outsole. The sole 376 has a balancing portion 378 that extends outwardly from the upper 374 and continuously along the medial, lateral and rear portions 380*a*, 380*b* and 380*c* of the shoe. In this embodiment, a curved support plate 382 is positioned between the upper 374 and the sole 376 as shown in FIGS. 56 and 58. More specifically, the support plate 382 is positioned in recessed areas shown in FIG. 59 so that the rear end 384 of the support plate 382 is in recessed area 386 and the front end 388 of the support plate is in recessed area 390 where recessed areas 386 and 390 are separated or spaced from each other. The curves in the support plate 382 enable the support plate to be positioned on the sole 376 so that the rear curved portion 392 of the support plate 382 is at a distance above the upper surface 394 of the sole 376. In this way, a space 396 is formed between the support plate 382 and the sole 376 so that the support plate is able to flex or move upwardly and downwardly relative to the sole 376 to provide support and spring to a user's foot during movement. In the illustrated embodiment, the support plate 382 has two curved portions, namely, the rear curved portion 392 and front curved portion 398, but may have any suitable number of curved portions depending on the desired support and spring. Further, each curved portion 392, 398 may have any suitable degree of curvature. Preferably, the support plate 382 has a generally elongated, narrow rectangular shape but may be any shape. Also, the support plate 382 is made of carbon fibers and resin but may be made out of any suitable material or combination of materials.

Referring now to FIGS. 61-72, in another embodiment, a sole for an article of footwear is shown and generally indicated as 400, where the sole includes an upper surface 402 configured to receive an upper 404, and a bottom surface 406. More specifically, the sole 400 includes a midsole 408 made with a material that provides cushioning and support to a user's foot, such as EVA or other suitable material. An outsole 410 is attached to a bottom surface 412 of the midsole 408 and includes tread members 414 that contact and at least partially grip an underlying surface for support and stability while moving on different terrain. The outsole 410 is preferably made with rubber, but may be made with any suitable material or combination of materials.

Figure 61:
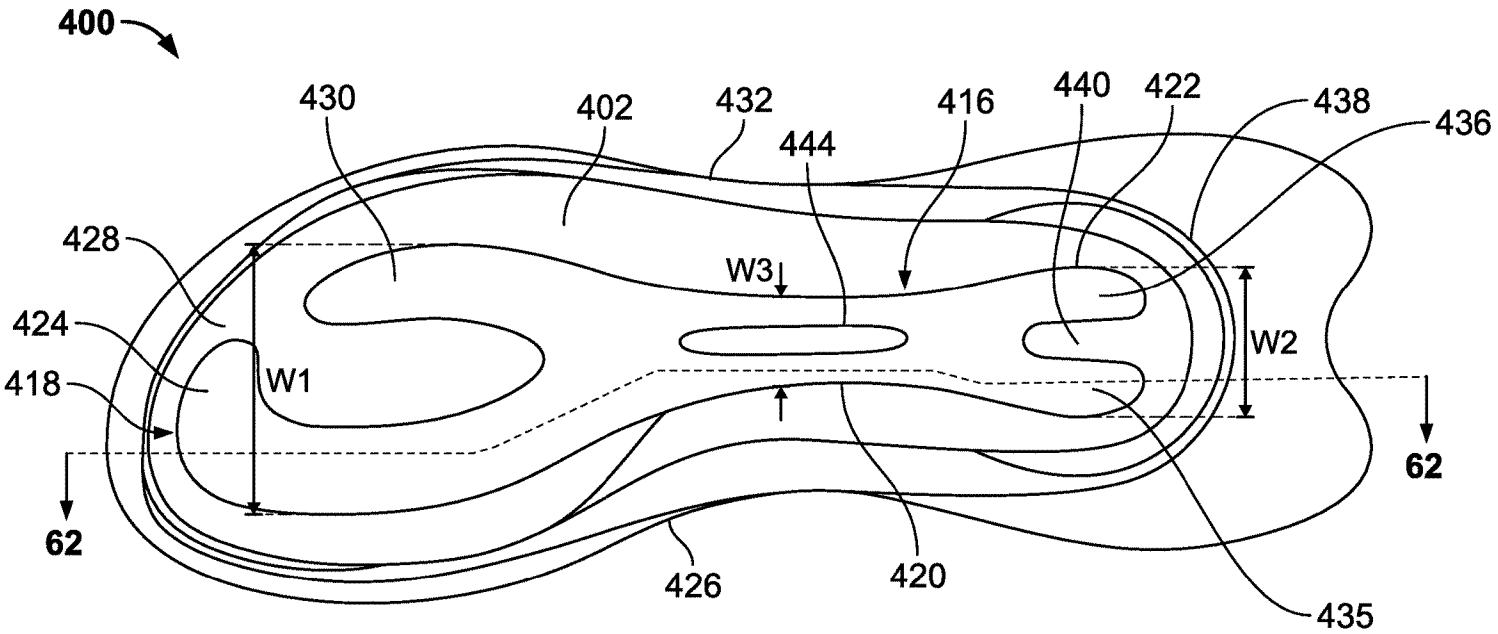
FIG. 61 is a top view of another embodiment of a sole including a support plate.
Figure 62:
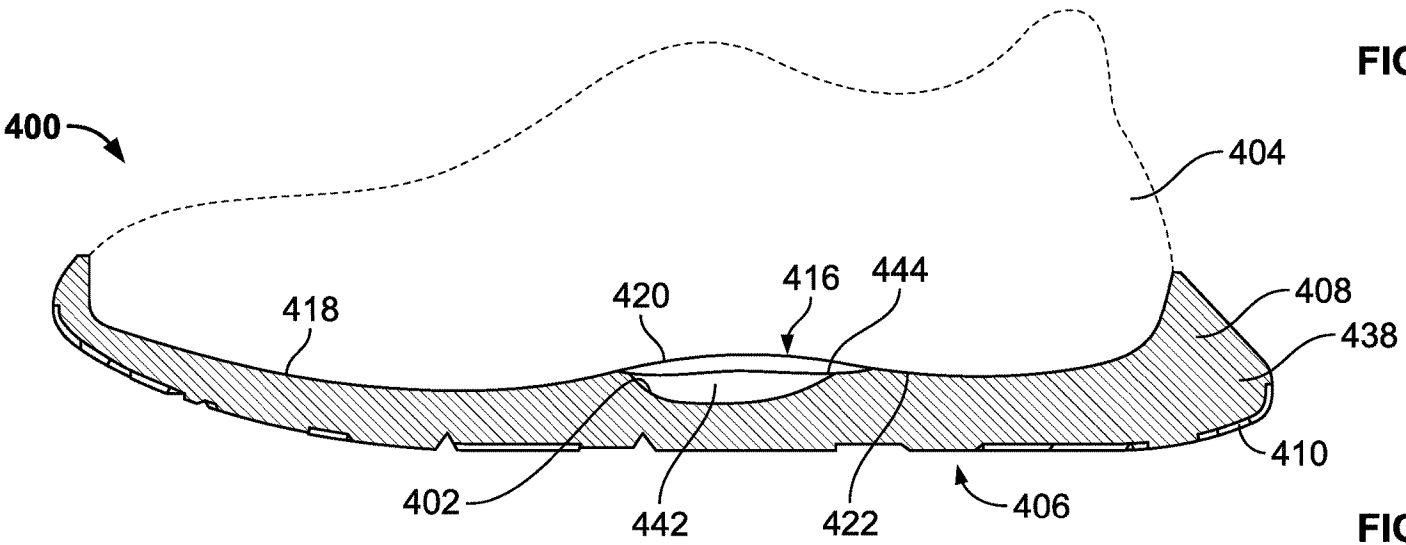
FIG. 62 is a cross-section view of the sole in FIG. 61 taken substantially along line 62-62 in the direction generally indicated.
Figure 63:
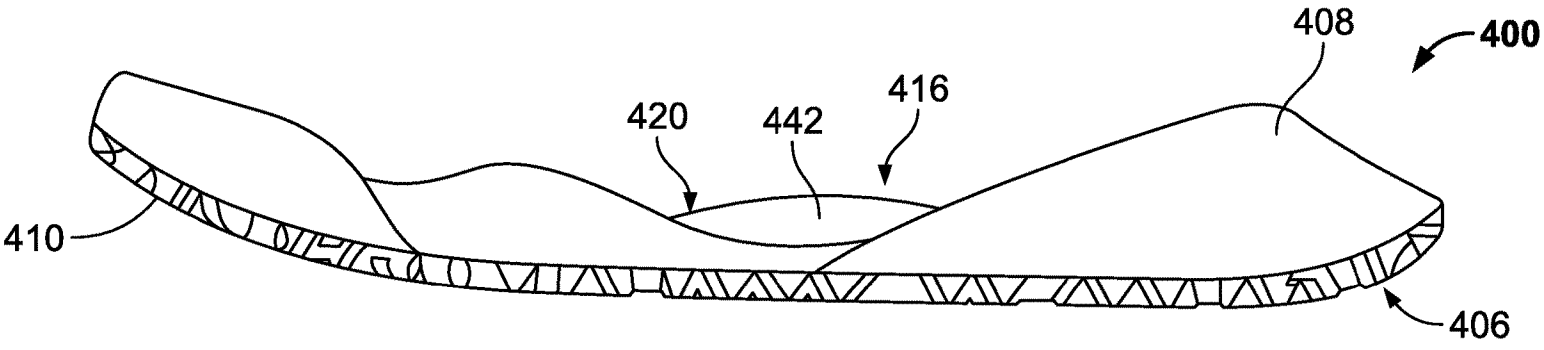
FIG. 63 is a left side view of the sole of FIG. 61.
Figure 64:
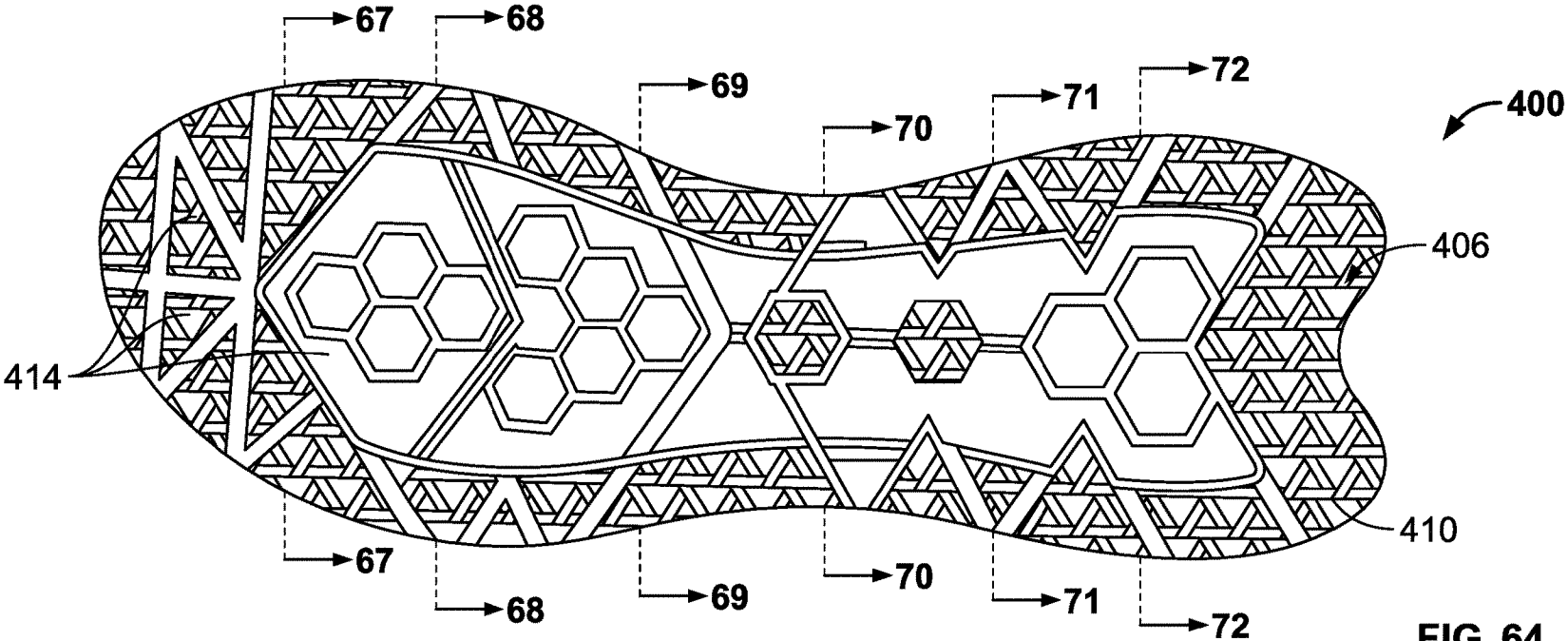
FIG. 64 is a bottom view of the sole of FIG. 61.
Figure 65:
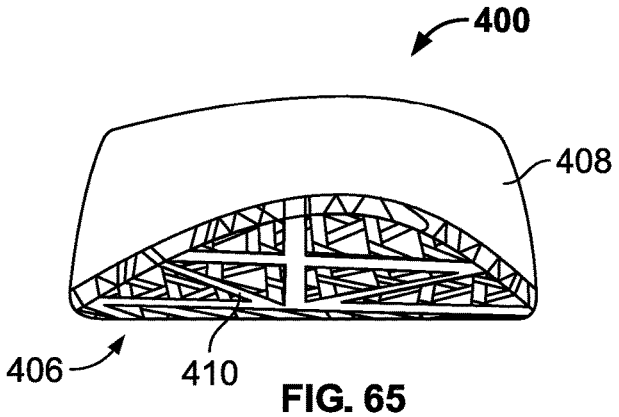
FIG. 65 is a front view of the sole of FIG. 61.
Figure 66:
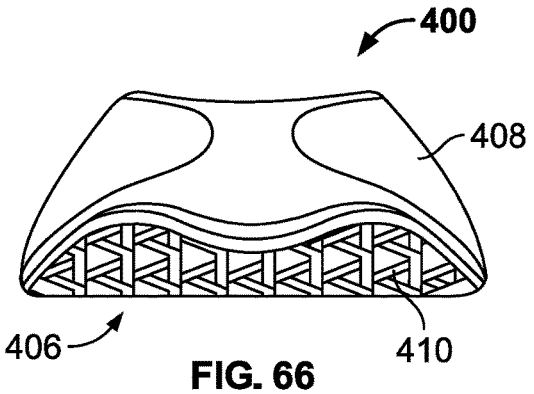
FIG. 66 is a rear view of the sole of FIG. 61.
Figure 67:
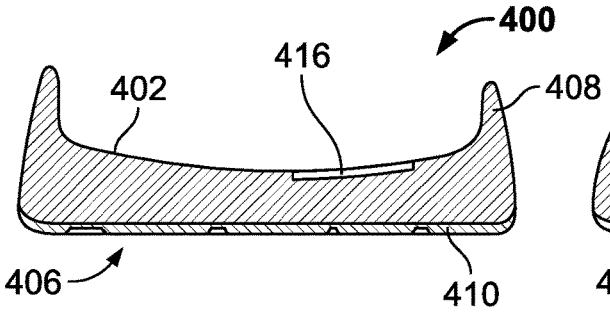
FIG. 67 is a cross-section view of the sole in FIG. 64 taken substantially along line 67-67 in the direction generally indicated.
Figure 68:
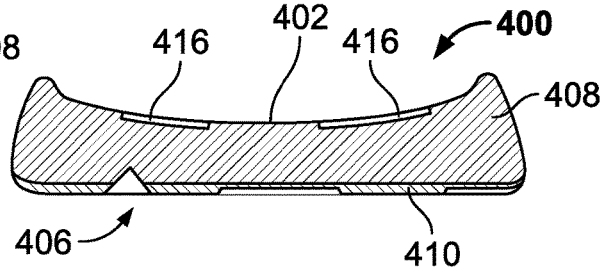
FIG. 68 is a cross-section view of the sole in FIG. 64 taken substantially along line 68-68 in the direction generally indicated.
Figure 69:
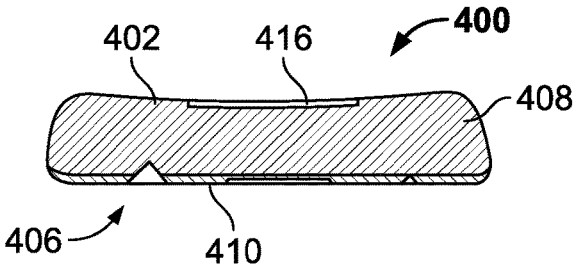
FIG. 69 is a cross-section view of the sole in FIG. 64 taken substantially along line 69-69 in the direction generally indicated.
Figure 70:
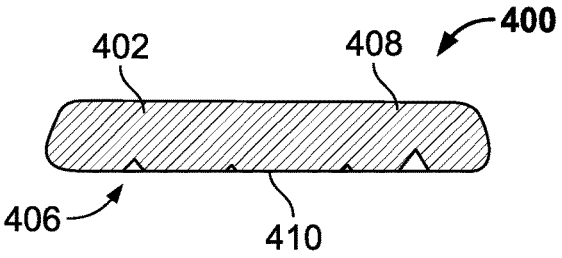
FIG. 70 is a cross-section view of the sole in FIG. 64 taken substantially along line 70-70 in the direction generally indicated.
Figure 71:
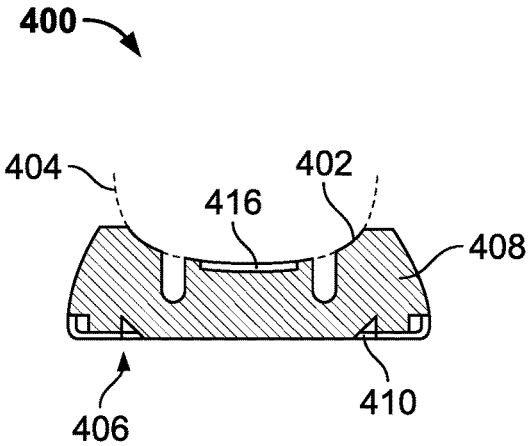
FIG. 71 is a cross-section view of the sole in FIG. 64 taken substantially along line 71-71 in the direction generally indicated.
Figure 72:
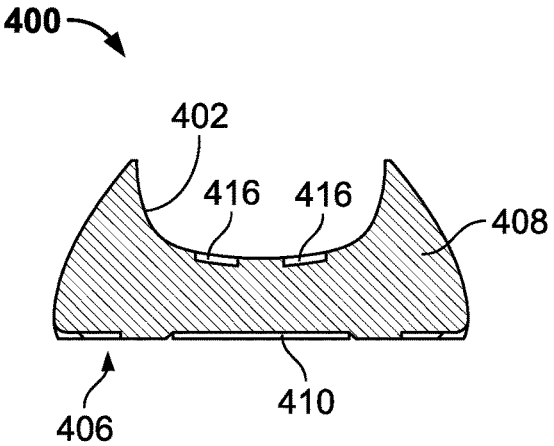
FIG. 72 is a cross-section view of the sole in FIG. 64 taken substantially along line 72-72 in the direction generally indicated.
Figure 73:
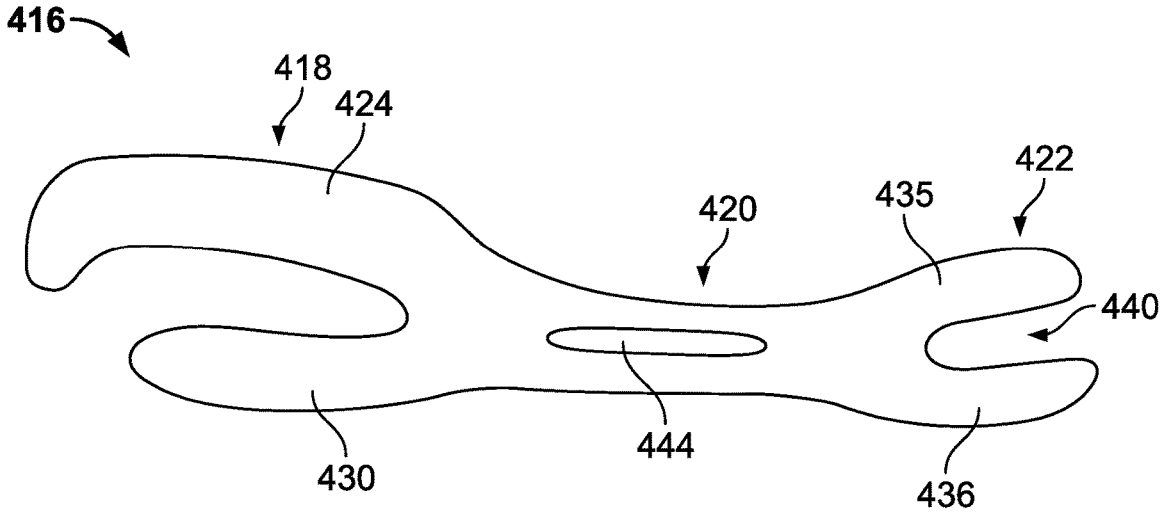
FIG. 73 is a top view of the support plate shown in FIG. 61.
Figure 74:
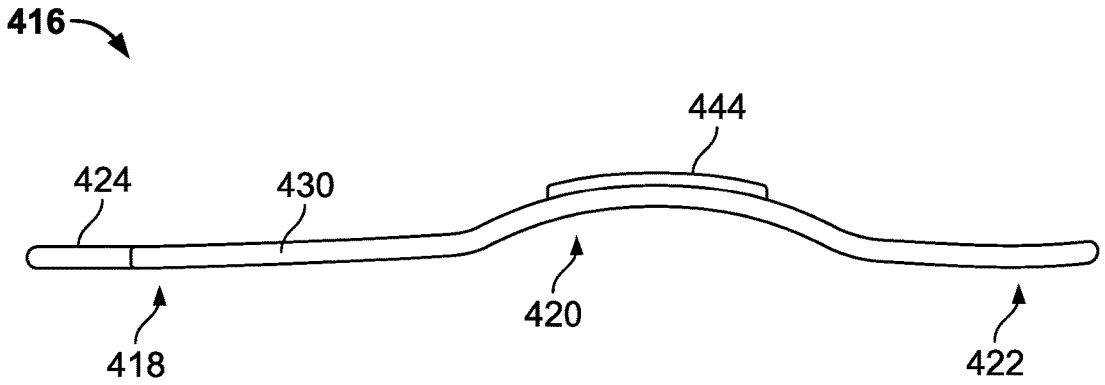
FIG. 74 is a left side view of the support plate of FIG. 73.
Figure 75:
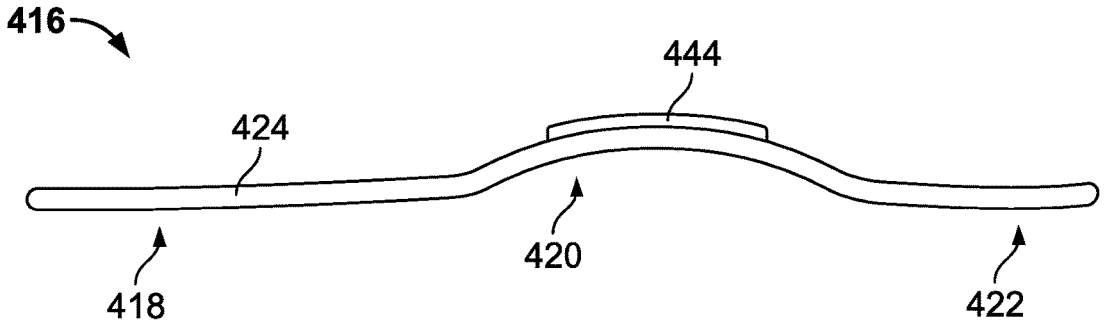
FIG. 75 is a right side view of the support plate of FIG. 73.

As shown in FIGS. 61 and 62, a support member, such as support plate 416, is placed on the upper surface 402 of the sole 400 to provide stability and support to different areas of a user's foot. The support plate 416 has a front part 418, a middle part 420 and a rear part 422. In the illustrated embodiment, the front part 418 is positioned at least partially in a forefoot area of a user's foot and includes a front medial arm 424, which extends along a medial side 426 of the sole 400 and into a toe area 428 of the sole. A front lateral arm 430 is spaced from the front medial arm 424, and extends at least partially along a lateral side 432 of the sole 400 and at least partially in the forefoot area 434. As shown in the illustrated embodiment, the front medial arm 424 has a length that is greater than a length of the front lateral arm 430. In another embodiment, the length of the front lateral arm 430 is greater than the length of the front medial arm 424. It should be appreciated that the lengths of the front medial arm 424 and the front lateral arm 430 may be adjusted to provide different levels of stability and support on the medial and lateral sides 426, 432 of the sole.

To provide lateral balance, the rear part 422 of the support plate 416 has a V-shape formed by a rear medial arm 434 and a rear lateral arm 436. As shown in FIG. 61, the rear medial arm 435 and the rear lateral arm 436 each have lengths that are the same. In another embodiment, the lengths of the rear medial arm 434 and the rear lateral arm 436 are different. As with the front part 418 described above, the lengths of the rear medial arm 434 and the rear lateral arm 436 may be adjusted based on a desired level of stability and support in the heel area 438 of the sole 400. Separating the rear medial arm 434 and the rear lateral arm 436 so that there is a space 440 between the rear medial arm and the rear lateral arm, enables the rear medial arm 434 and the rear lateral arm 436 to move or flex relative to or independently of each other.

The middle part 420 of the support plate 416 connects the front part 418 and the rear part 422. Preferably, the middle part 420 is flexible and positioned a designated distance above the upper surface of the sole to form space 442, so that the middle part is able to move toward and away from the upper surface 402 of the sole. This configuration provides resilient support to the insole area of user's foot while the user is walking, jogging or running. For example, as the user's foot presses down on the middle part 420 of the support plate 416, the support plate 416 moves at least partially through the space 442 and toward the upper surface 402 of the sole 400. As the user's foot releases pressure on the middle part 420, the middle part 420 moves away from the upper surface 402 and back to its original position. As shown in FIG. 61, the middle part 420 of the support plate 416 has a width that is less than a width of the front part 418 and a width of the rear part 422. The width of the middle part 420 may be adjusted to provide different levels of support to the user's foot. Similarly, the middle part 420 of the support plate 416 may be formed with a curved shape, such as a convex shape as shown in FIGS. 61 and 62, to adjust the level of support provided to the user's foot.

In an embodiment, the middle part 420 of the support plate 416 includes an upwardly projecting ridge 444 that extends along at least a portion of the middle part. The ridge 444 is used to adjust the stiffness of the middle part 420, which corresponds to the rigidity or flexibility of the middle part, where the ridge 444 may extend along a portion of the length of the middle part 420 or along the entire length of the middle part 420. In another embodiment, the ridge 444 is replaced by an opening or through-hole (not shown) that also adjusts the stiffness and flexibility of the middle part.

In the illustrated embodiment, the front part 418 has a width W1 and the rear part 422 has a width W2 that are both greater than a width W3 of the middle part 420 of the support plate 416. It should be appreciated that the widths W1, W2 and W3 may be the same or each width may be different as shown in FIG. 61. Further, the width W1 may be the same as the width W2 or the width W3, and the width W3 may be the same as the width W2. Adjusting the widths of the support plate 416 in different areas of a user's foot, adjusts the support provided by the support plate 416 in the different areas of the user's foot. Similarly, the thickness of the support plate 416 may be uniform along the entire length of the support plate 416 or the support plate may have different thicknesses relative to the different areas of the user's foot. Further, in the above embodiments, the support plate 416 is preferably made of a carbon-fiber material. It should be appreciated that the support plate may be made of metal, a composite material or any suitable material or combination of materials.

Also in the above embodiments, the support plate 416 may be positioned on the upper surface 402 of the sole 400, embedded or molded within the sole 400 or the sole 400 may have a recessed area that has a size, a shape and a depth that corresponds to the size, the shape and the thickness or thicknesses of the support plate 416. In this way, the recessed area limits the movement of the support plate 416 relative to the sole 400 and thereby secures the support plate in position on the sole. In another embodiment, the support plate 416 is secured to the upper surface 402 of the sole 400 using an adhesive or other suitable attachment method.

In use, a user's foot is inserted in an article of footwear, such as a shoe or sandal, so that the user's foot is adjacent to the support plate 416 and more specifically, so that the arch of the user's foot is on the middle part 420 of the support plate 416. As the user walks, jogs or runs, their foot presses against the middle part 420 when the shoe is relatively flat on an underlying surface, such that the middle part 420 moves downward through the space 442 toward the upper surface 402 of the sole 400. The amount of compression of the middle part 420 of the support plate 416 depends on the configuration of the middle part, such as the thickness, the width and the material used to form the middle part, as well as if there is a ridge 444 or opening formed in the middle part as described above. As the pressure of the user's foot decreases on the middle part 420, such as when the user's foot is rolling onto the forefoot area of the sole 400, the resilient middle part 420 moves away from the upper surface 402 of the sole 400 to its original non-compressed or non-flexed position. In this way, the middle part 420 provides support to the arch or insole of the user's foot to help the user's foot to propel the user forward.

Figure 76:
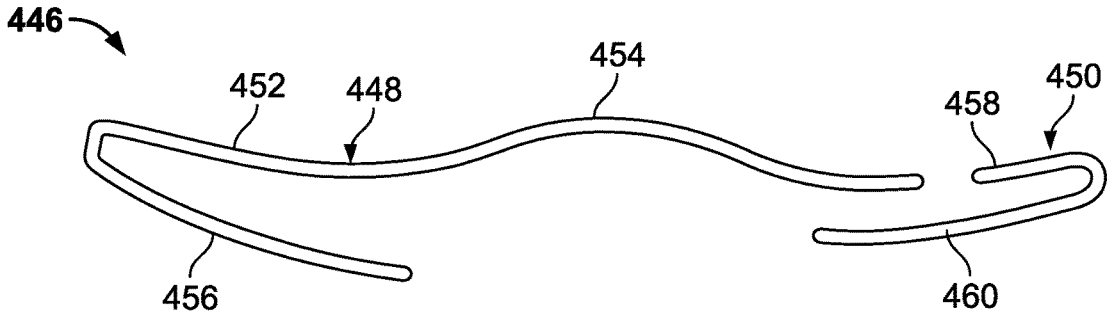
FIG. 76 is a side view of another embodiment of the support plate.
Figure 77:
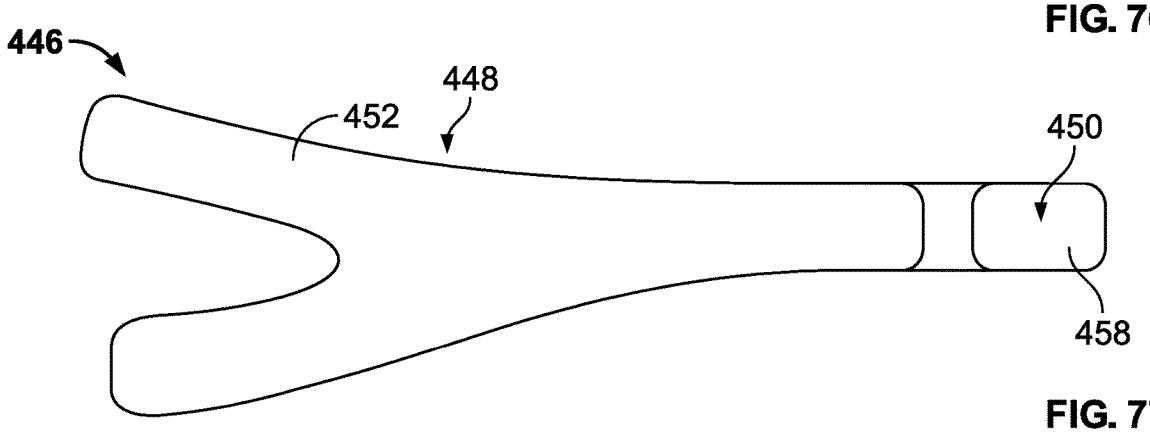
FIG. 77 is a top view of the support plate of FIG. 76.
Figure 78:
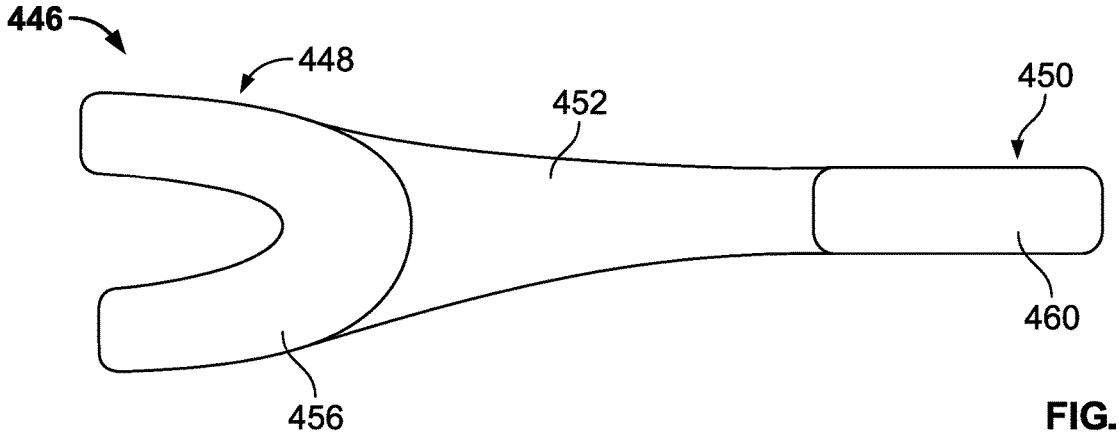
FIG. 78 is a bottom view of the support plate of FIG. 76.
Figure 79:
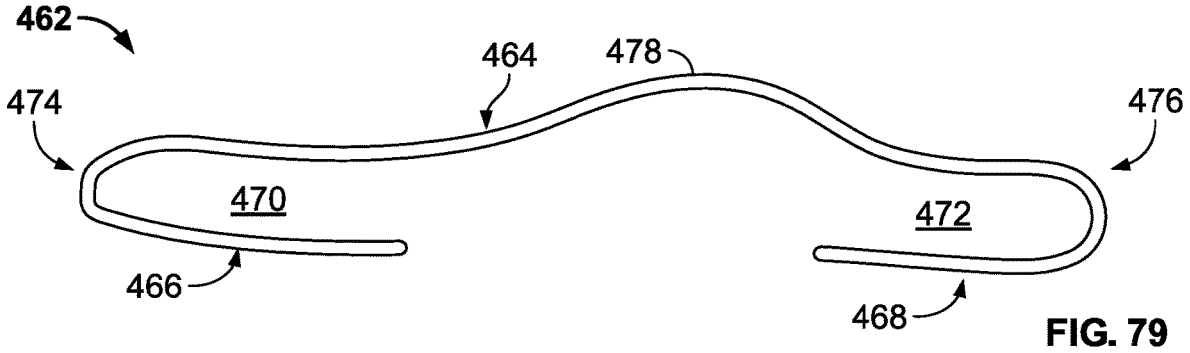
FIG. 79 is a side view of another embodiment of the support plate.

Referring now to FIGS. 76-79, another embodiment of the support plate 446 is shown where the support plate 446 has a first support member 448 and a second support member 450 that combine to form the support plate. In this embodiment, the first support member 448 has an upper part 452 with a curved portion 454 and a lower part 456 that extends from an end of the upper part 452 and beneath at least a portion of the upper part as shown in FIG. 76. Similarly, the second support member 450 is a separate component that has an upper part 458 and a lower part 460 that extends from an end of the upper part 458 and underneath at least a portion of the upper part. The lower parts 456 and 460 of the first support member and the second support member are spaced a designated distance from the upper parts 452 and 458 and are each made of a resilient material so that the lower parts 456, 460 act as springs as the lower parts move toward and away from the upper parts 452, 458 during use. In the illustrated embodiment, the support plate 446 includes the first support member 448 and the second support member 450 where the first and second support members are separate components that are positioned on, embedded in or molded in a sole of an article of footwear. In another embodiment, the support plate 446 is a single, integral component that includes the first support member 448 and the second support member 450 as shown in FIG. 79. It should be appreciated that the support plate 446 may have the same or different thicknesses and/or the same or different widths as described above. Further, the support plate 446 is preferably made with a carbon-fiber material but may also be made with a metal, a composite material or any suitable material or combination of materials.

Referring to FIG. 79, in another embodiment, a support plate 462 is formed as an integral unit or integral component. In this embodiment, the support plate 462 has an upper part 464 and lower parts 466 and 468 that extend from each end of the upper part and at least partially beneath each end of the upper part. As shown, the lower parts 466, 468 are spaced a designated distance from the upper part, where the spaces 470 and 472 between the upper part and each lower part may be adjusted so that the distances between the upper part and each lower part are the same or different. The support plate 462 is preferably made of a stable, resilient material, such as a carbon fiber-based material, so that the upper part 464 may flex or move toward and away from the lower parts 466, 468 when pressure is placed on a front end 474 and/or a rear end 476 of the upper part 464. In the illustrated embodiment, the upper part 464 includes a curved portion 478 that is positioned at or near the arch or insole of a user's foot. The curved portion 478 provides support to the user's foot when the upper part 464 is pressed toward one or both of the lower parts 466, 468 by a user's foot. It should be appreciated that the support plate 462 may also be made of a metal, a composite material or any suitable material or combination of materials.

While particular embodiments of the present sole are shown and described, it will be appreciated by those skilled in the art that changes and modifications may be made thereto without departing from the invention in its broader aspects and as set forth in the following claims.

What is claimed is:

1. An article of footwear comprising:

an upper;

a sole secured to said upper and including an upper surface;

a support member positioned on the sole, said support member including a front portion, an opposing rear portion and an intermediate portion between said front portion and said rear portion, wherein said front and rear portions contact said upper surface of said sole and said intermediate portion is positioned a designated distance above a recessed area in said upper surface of said sole to form a space between said support member and said sole, said intermediate portion having a height relative to a bottom surface of said sole that is greater than a height of said front portion and a height of said rear portion relative to the bottom surface of said sole, wherein said intermediate portion of said support member moves toward said recessed area in said upper surface when pressure is applied to said portion of said support member, and moves away from said recessed area in said upper surface when pressure is decreased or released from said portion of said support member.

2. The article of footwear of claim 1, wherein said intermediate portion of said support member has a curved shape.

3. The article of footwear of claim 1, wherein said support member has a first end and a second end, said first end or said second end has a curved portion.

4. The article of footwear of claim 1, wherein said support member has a first end and a second end, and said first end and said second end each have a curved portion.

5. The article of footwear of claim 1, wherein said upper surface of said sole includes a first recessed area in the forefoot area of said sole and a second recessed area in the heel area of said sole such that a first part of said support member sits in said first recessed area and a second part of said support member sits in said second recessed area.

6. The article of footwear of claim 1, wherein said intermediate portion of said support member is made of a resilient material.

7. The article of footwear of claim 1, wherein said support member has a first thickness and said intermediate portion of said support member has a second thickness, and wherein said second thickness is less than said first thickness.

8. The article of footwear of claim 1, wherein said support member has a uniform thickness.

9. The article of footwear of claim 1, wherein a second end of said support member has a second spring portion that extends at least partially below said second end.

10. The article of footwear of claim 9, wherein a foam material is placed between said second end and said second spring portion of said support member.

11. The article of footwear of claim 1, further comprising a first support member and a second support member, wherein said first support member and said second support member are separated from each other, and wherein said first support member has an end that extends at least partially below said end of said first support member, and said second support member has a second end that extends at least partially below said end of said second support member.

12. The article of footwear of claim 1, wherein said sole includes a stabilizing member extending outwardly from said upper, said stabilizing member including a groove that separates the stabilizing member into a medial balancing member and a lateral balancing member, wherein the medial balancing member and the lateral balancing member move independently of each other to provide balance and stability on different terrains.

13. The article of footwear of claim 11, wherein the stabilizing member extends outwardly from a periphery of said sole between a medial side and a lateral side of the upper.

14. The article of footwear of claim 11, wherein said groove is directly adjacent to said upper.

15. An article of footwear comprising:

an upper;

a sole secured to said upper and including an upper surface and a recessed area below said upper surface that is between a forefoot area and a heel area of said sole;

a support plate on said sole, said support member having a front portion, an opposing rear portion and a curved portion that is positioned between said front portion and said rear portion and adjacent to said recessed area of said sole, said front and rear portions being in contact with said upper surface of said sole, wherein said curved portion of said support plate flexes toward said recessed area when pressure is applied to said curved portion of said support plate, and flexes away from said recessed area when pressure is decreased or released from said curved portion of said support plate.

16. The article of footwear of claim 15, wherein at least a portion of said support member is made of a resilient material.

* * * * *